US008683832B2

(12) United States Patent
Watanabe et al.

(10) Patent No.: US 8,683,832 B2
(45) Date of Patent: Apr. 1, 2014

(54) PUSH BUTTON LOCK

(75) Inventors: Akemaru Watanabe, Hiki-gun (JP); Kenji Naito, Hiki-gun (JP)

(73) Assignee: Nagasawa Manufacturing Co., Ltd., Saitama (JP)

( * ) Notice: Subject to any disclaimer, the term of this patent is extended or adjusted under 35 U.S.C. 154(b) by 0 days.

(21) Appl. No.: 13/582,677

(22) PCT Filed: Apr. 19, 2011

(86) PCT No.: PCT/JP2011/002265

§ 371 (c)(1),
(2), (4) Date: Sep. 4, 2012

(87) PCT Pub. No.: WO2011/151967

PCT Pub. Date: Dec. 8, 2011

(65) Prior Publication Data

US 2012/0324970 A1 Dec. 27, 2012

(30) Foreign Application Priority Data

May 31, 2010 (JP) ..... 2010-125070

(51) Int. Cl.
*E05B 13/00* (2006.01)

(52) U.S. Cl.
USPC ..... 70/214; 70/220; 70/299; 70/323; 70/327; 70/328

(58) Field of Classification Search
USPC ..... 70/214, 284, 285, 220, 287, 288, 70/296–300, 313–319, 323, 326–328, 70/DIG. 1, DIG. 9, DIG. 22, DIG. 25, 70/DIG. 31, DIG. 44, DIG. 76, DIG. 63, 70/DIG. 71
See application file for complete search history.

(56) References Cited

U.S. PATENT DOCUMENTS

| | | | | |
|---|---|---|---|---|
| 1,085,894 | A * | 2/1914 | Eagle | 70/298 |
| 1,871,303 | A * | 8/1932 | Chesick | 70/284 |
| 4,748,833 | A * | 6/1988 | Nagasawa | 70/214 |
| 6,298,698 | B1 | 10/2001 | Nakajima et al. | |
| 6,334,346 | B1 * | 1/2002 | Wang | 70/214 |
| 7,043,948 | B1 * | 5/2006 | Wang | 70/214 |
| 7,316,139 | B2 | 1/2008 | Nakazima et al. | |
| 8,276,413 | B2 * | 10/2012 | Talpe | 70/214 |
| 2005/0210937 | A1 * | 9/2005 | Okuda | 70/214 |
| 2008/0115546 | A1 * | 5/2008 | Hu | 70/214 |
| 2008/0216531 | A1 * | 9/2008 | Waller et al. | 70/298 |

FOREIGN PATENT DOCUMENTS

| | | |
|---|---|---|
| JP | 58-80074 | 5/1983 |
| JP | 62-54951 | 11/1987 |
| JP | 2803804 | 7/1998 |
| JP | 2002-322838 | 11/2002 |
| JP | 3542797 | 4/2004 |
| JP | 3648043 | 2/2005 |
| JP | 2009-127342 | 6/2009 |

* cited by examiner

*Primary Examiner* — Lloyd Gall
(74) *Attorney, Agent, or Firm* — Jordan and Hamburg LLP

(57) ABSTRACT

To provide a push button lock which includes a housing on which a plurality of depressible push buttons are located, a lock pin which moves axially with the push button and being engageable with and disengageable from the push button, a lock plate formed with a plate key hole and plate lock hole, a reset plate which is provided parallel to the lock plate, a driving cam linked to a deadbolt lock, and the security-code controller detachably attached to the housing. A mechanism and components for setting and storing a security code for locking and unlocking are assembled in a cartridge. The cartridge is detachably attached to the inside of the housing so that various surface designs are available.

33 Claims, 32 Drawing Sheets

(a)

(b)

(a) Auto Lock (b) Latch (Free)

(c) Deadlock

Setting Security Number

Procedure of Setting Security Number
Security Number "1A6"

(a) After Assembly (b) Press Push Button and Maintain the Depressed Position (c) Rotating the Upper Cylinder (Set)

(d) Reset

Procedure of Releasing the Lock
Security Number "1 A 6"

(a) Reset (b) Press Push Button and Maintain the Depressed Position

Releasing Security Number

PUSH BUTTON LOCK

BACKGROUND OF THE INVENTION

1. Field of the Invention

The present invention relates to a push button lock which includes a mechanism and its components assembled in a cartridge for setting and storing a security code for locking and unlocking. The cartridge is detachably attached in a housing so that various designs are available on the surface of the housing. The lock is manufactured and designed in an efficient manner, and requires less maintenance, thereby facilitating mass production. The security code for the lock is easily and readily set or altered with the lock attached to a door and without using a tool. The lock has an increased protection function, thereby improving convenience and safety. Further, a streamlined design of the push button lock reduces the load applied to a lock pin, prevents damage by tampering and erroneously pushing the push buttons, and thereby enhancing safety in use and increasing productivity.

2. Description of the Related Art

Recently, keyless locks are widely used for doors of houses, stations, stores, and hospitals. One such keyless lock is a mechanical lock, which is locked and unlocked by a mechanical manner, requires no wiring, and there is no worry about a power outage and power source, as opposed to the electric lock, which is operated by an electrical manner. The mechanical lock has increased security function and requires less maintenance. Due to high mechanical strength, the demand is increasing.

The mechanical lock is installed at a door, a case frame of the mechanical lock comprises a plurality of push buttons for programming a security number, and a door handle. A dead bolt lock is provided inside the door. The lock is locked and unlocked by the deadbolt which moves in accordance with operation of the push buttons. One mechanical lock is provided inside with a plate-like block on the surface of a case frame, and a plurality of plate bodies is laminated inside the case frame. Each plate body is provided with a plurality of slits or through holes. A substantially S-shaped and plate-like button having a slit is inserted in the slits or through holes, with the button upright or inverted. Then, a security number is entered by setting the push button at a memory or non-memory state (refer, for example, to patent documents 1 and 2).

However, the mechanical lock has following problems. In order to set or alter the security number, the block and the case frame need to be detached to uncover the button. Further, adjacent components needs to be disassembled to change the orientation of the buttons either upright or inverted, and then buttons are inserted in the slits of the plate body again. This operation causes trouble because the upright and inverted states of the button are very similar and confusing. Each plate body is laminated in sequence in the case frame and integrally attached to each other. Thus, the case frame and the plate bodies cannot be separated, and making efficient, mass production difficult. The size and shape of each component is restricted, such that the design of the case frame is limited.

In order to solve the above-described problems, other such mechanical lock includes a plurality of slide plates laminated inside the case frame, and a plurality of slits or holes are formed on the slide plates. A push button provided with a plurality of notches on the shaft periphery is inserted in the slits or holes. The notch, the end portion of the push button, is provided to appear on the back side of the door. A screwdriver is engaged with the notch and turned in either direction. A security number is entered by setting the push button in a memory state or non-memory state (refer, for example, to patent documents 3 and 4).

In the above-described mechanical lock, the components do not need to be detached when setting or altering the security number and the operation becomes easier, however, there are following problems. Use of tools, such as a screwdriver is required. Further, each plate body is laminated in sequence in the case frame, such that efficient and mass production is difficult. The size and shape of each component is restricted, such that the design of the case frame is limited. Further, the complicated structure of the button makes manufacturing difficult.

Further, when the mechanical lock is unlocked, the position of the push button is parallel to the slit and then a key plate is movable. After engagement between the cam pin and the plate is released, the door handle is turned. Thus, there is a danger of bending or damage of the push button because the incorrect push button is engaged with the key plate when the push button is not pressed correctly and further the door handle is turned by, for example, tampering. If stronger material is employed for the push button as a means to solve the above-described problem, the material costs would increase and the productivity would decrease.

Other such mechanical lock includes a plurality of buttons on the surface of the case for entering a security code, a hole provided near the button for inserting an operational tool, a button gear provided inside the case and being rotatable when the button is operated, a terminal gear engageable with the button gear, and a reset gear engageable with the terminal gear. When the security number is set or altered, the operational tool is inserted in the hole, and then corresponding button is pressed given times (refer, for example, to patent document 5).

The above-described mechanical lock reduces trouble in operation, such as detaching the components when setting or altering the security number, however, use of tools is required. Further, each plate body is laminated in sequence in the case frame, making efficient and mass production difficult. Additionally, size and shape of each component is restricted, such that the design of the case is limited.

PATENT DOCUMENTS

Patent Document 1: Japanese Examined Patent Application Publication No. 62-54951

Patent Document 2: Japanese Patent No. 2803804

Patent Document 3: Japanese Unexamined Patent Application Publication No. 58-80074

Patent Document 4: Japanese Patent No. 3648043

Patent Document 5: Japanese Patent No. 3542797

SUMMARY OF THE INVENTION

The object of the present invention is to provide a push button lock which solves the aforementioned problems, and which includes a mechanism and its components assembled in a cartridge for setting and storing a security code for locking and unlocking. The cartridge is detachably attached in a housing so that various designs are available on the surface of the housing. The lock is manufactured and designed in an efficient manner, and requires less maintenance, thereby facilitating mass production. The security code for the lock is easily and readily set or altered with the lock attached to a door and without using a tool. The lock has an increased protection function, thereby improving convenience and safety. Further, a streamlined design of the lock reduces the load applied to a lock pin, prevents damage by tampering and erroneously pushing the push buttons, and thereby enhancing safety in use and increasing productivity.

1. Means for Solving the Problems

The present invention in a first aspect thereof comprises a housing on which a plurality of depressible push buttons are located, a lock pin engageable with and disengageable from the push buttons and movable coaxially with the push buttons, a lock plate formed with a plate key hole into which the lock pin is insertable and a plate lock hole that contacts the lock pin, a reset plate arranged in parallel with the lock plate and provided inside with a reset spring, thereby enabling axial displacement of the lock pin inserted via the reset spring to be maintained and released, a driving cam rotatably and engageably provided in a movement area of the lock plate and linked to a deadbolt lock, whereby controlling a movement of the lock plate via the lock pin upon pressing of the push button, making the lock plate and the driving cam disengageable, and a security-code controller which receives the reset plate and the lock plate slidably and in parallel to each other and which is detachably attached to the housing.

In a second aspect of the present invention, the security-code controller is constructed of a controller case and a controller cover that are closely attached and fixed, and the lock plate and the reset plate and the lock pin are received in the security-code controller.

In a third aspect of the present invention, the controller case is disposed inside the housing, and the controller cover is attached to the door side.

In a fourth aspect of the present invention, the housing has a common security-code controller, and a shape of the housing, a shape of the push button, and number and intervals of the push buttons are selectable based on a mechanism of the security-code controller.

In a fifth aspect of the present invention, the lock pin is rotatively supported by the security-code controller. The lock pin is provided on the middle with an engaging pawl.

In a sixth aspect of the present invention, a memory set plate is movably disposed between the controller cover and the reset plate, and the memory set plate is formed with a dog engageable with the engaging pawl.

In a seventh aspect of the present invention, a memory reset plate is movably disposed between the memory set plate and the reset plate, and the memory reset plate is formed with a dog engageable with the engaging pawl.

In an eighth aspect of the present invention, the engaging pawl of the lock pin is engageable with the memory set plate and the memory reset plate.

In a ninth aspect of the present invention, the memory set plate and the memory reset plate each have an end portion which is engageably linked to a memory change cam which rotates forwardly and reversely, rotation of the memory change cam enables the memory set plate or the memory reset plate to move in the opposite direction.

In a tenth aspect of the present invention, the memory change cam is linked to rotational displacement of a rotator which is mounted inside a door and is rotated forwardly and reversely.

In an eleventh aspect of the present invention, when setting a security code: the memory set plate is movably arranged, the dog is engaged with the engaging pawl of the lock pin, and the lock pin is rotatable.

In a twelfth aspect of the present invention, the lock pin is kept in its rotational position when setting, releasing, or altering security code.

The present invention in a thirteenth aspect thereof comprises a stop washer rotatably received inside the controller cover on which a protrusion is formed, a square hole which is formed in the washer and into which an end portion of the lock pin is engageably inserted, wherein the washer is biased to press against an inner side of the controller cover, the washer has a cross-shaped engaging groove formed on a reverse side and engaging with the protrusion, and the washer moves in accordance with rotation of the lock pin and keeps the rotational position.

In a fourteenth aspect of the present invention, when setting the security code: the lock pin is moved in an axial direction via each push button, the lock pin is kept in its moving position in the security-code controller, the dog is engaged with the engaging pawl of the lock pin and rotated, the lock pin is moved to an original position in the axial direction while maintaining the rotational position, and the lock pin is engageably arranged in the plate lock hole, whereby the lock is lockable.

In a fifteenth aspect of the present invention, after setting the security code: the lock pin is moved axially via a predetermined push button, thereby keeping a moving position of the lock pin in the security-code controller, engagement between the lock pin and the plate lock hole is releasable, whereby lock is unlockable.

In a sixteenth aspect of the present invention, after setting the security code: the engagement between the lock pin and the plate lock hole is releasable, the lock plate is moved back from the driving cam via an enter pin, whereby the lock is unlockable.

In a seventeenth aspect of the present invention, the enter pin is provided movably in an axial direction at a lower side of the security-code controller, the enter pin is arranged at an open window of the lock plate, a slider movable in an orthogonal direction is attached to the enter pin, and the slider is engageably mounted on an edge of the open window.

The present invention in an eighteenth aspect thereof comprises a cushion plate movably attached to a lower side of the lock plate via a brake spring, wherein the slider is engageably arranged on the cushion plate, the enter pin is moved axially and the slider is moved in the orthogonal direction, and the cushion plate is movable against the brake spring.

In a nineteenth aspect of the present invention, when releasing a security code set by a user: the memory reset plate is arranged movably in an opposite direction of movement of the memory set plate at a time of setting the security code, the dog of the memory reset plate is engaged with an opposite side of the engaging pawl at the time of setting the security code, and the lock pin is rotatable in an opposite direction from when setting the security code.

In a twentieth aspect of the present invention, after releasing a security code set by a user: the rotator is rotated in the opposite direction from when setting the security code, the lock pin is moved axially via each push button that corresponds to a new security code, keeping a moving position in the security-code controller, the dog is engaged with the engaging pawl of the lock pin and rotated, the lock pin is moved to an original position in an axial direction while keeping a rotational position, the lock pin is engageably arranged in the plate lock hole, whereby the security code is alterable.

In a twenty-first aspect of the present invention, the security-code controller is provided with a reset pin which is axially movable, the reset pin is rotatable and interconnected with rotational displacement of a changeover knob provided inside a door, the reset pin is provided with an engagement piece and a protrusion, an end face of the engagement piece and the protrusion are engageable with an edge of an opening of the lock plate, whereby operation of the lock plate is controllable via a rotational position of the reset pin.

In a twenty-second aspect of the present invention, the end face of the engagement piece and the protrusion of the reset pin are positioned in the opening, thereby increasing operational displacement of the lock plate.

in a twenty-third aspect of the present invention, the protrusion of the reset pin is engaged with a cutout groove formed on an upper-opening edge of the opening, thereby making operational displacement of the lock plate controllable.

In a twenty-fourth aspect of the present invention, the protrusion of the reset pin is engaged with a lower-opening edge of the opening, thereby preventing operational displacement of the lock plate.

The present invention in a twenty-fifth aspect thereof comprises a changeover plate disposed inside the door and provided with the rotator interconnected with a memory change pin and the changeover knob interconnected with the reset pin.

In a twenty-sixth aspect of the present invention, the rotator rotates forwardly and reversely when setting or releasing a security code and is normally positioned at a neutral position.

In a twenty-seventh aspect of the present invention, the rotator is rotatable with a key, thumbturn, or coin.

In a twenty-eighth aspect of the present invention, the changeover knob is changeable to a position of a latch, an auto lock, or a deadlock and is normally positioned at the auto lock.

In a twenty-ninth aspect of the present invention, the changeover plate is provided with air openable cover, and the rotator and the changeover knob are disposed under the cover.

in a thirtieth aspect of the present invention, the changeover plate is provided with a depressible deadlock button, the changeover knob is rotatably provided and interconnected with depression displacement of the deadlock button, the rotational displacement of the changeover knob is interconnected with the reset pin, and the protrusion of the reset pin is engageable with the lower-opening edge of the opening of the lock plate.

The present invention in a thirty-first aspect thereof comprises a handle-mounting plate provided inside the door, wherein the handle-mounting plate and the changeover plate are disposed at separate locations inside the door.

The present invention in a thirty-second aspect thereof comprises a cylinder lock provided in a lower part of the housing and interconnected with a rotational mechanism of a square rod of the deadbolt lock, and unlocking operation of the cylinder lock allows the door to be opened when the door is deadlocked.

The present invention in a thirty-third aspect thereof comprises a button presser plate disposed in the housing and having a plurality of apertures for push-button shafts, a tamper-proof plate disposed adjacent at one side of the button presser plate and having a plurality of elongated holes and being biased to move downwardly, wherein the tamper-proof plate has an aperture into which an enter button is insertable, and a tapered portion of the enter button is provided so as to be engageable with a rim of the aperture.

In a thirty-fourth aspect of the present invention, the lock pin is formed by die-casting.

2. Operation Etc.

In a first aspect of the present invention, a mechanism and components of the security-code controller are assembled into a cartridge.

The present invention in a second aspect provides rigidity of the security-code controller, In a third aspect of the present invention, the function of the security-code controller is maintainable.

In a fourth aspect of the present invention, the mechanism of the security-code controller can be adapted for various surface designs of the housing.

In a fifth aspect of the present invention, the lock pin is provided with the rotational function, which is new and simple.

In a sixth aspect of the present invention, the security code is set with the memory set plate.

In a seventh aspect of the present invention, the security code can be released or altered with the memory reset plate.

In an eighth aspect of the present invention, the engaging pawl is used for both the memory set plate and the memory reset plate.

In a ninth aspect of the present invention, the memory change cam is used for both the operation of the memory set plate and the memory reset plate.

In a tenth aspect of the present invention, the security code is easily and readily set, released, and altered by rotation of the rotator. Further, the lock does not need to be detached from the door, making use of tools unnecessary.

In an eleventh aspect of the present invention, the rotator is rotated when the security code is set, and the lock pin is rotatable by engaging the dog with the engaging pawl of the lock pin.

In a twelfth aspect of the present invention, the security code is reliably set, released, and altered.

In a thirteenth aspect of the present invention, the rotational position of the lock pin is maintainable by the simple structure while the security code is set, released, and altered.

In a fourteenth aspect of the present invention, the security code is easily and reliably set.

In a fifteenth aspect of the present invention, the lock is locked easily and reliably.

In a sixteenth aspect of the present invention, operation of the enter pin releases the engagement between the lock plate and the driving cam reliably.

in a seventeenth aspect of the present invention, when the lock is unlocked, the axial displacement of the enter pin is converted into displacement of the slider in the orthogonal direction, i.e., a moving direction of the lock plate, and the lock plate is moved in the same direction. Accordingly, the engagement between the lock plate and the driving cam is released.

In an eighteenth aspect of the present invention, when unlocking the lock, the shaft force of the enter pin is absorbed in displacement of the cushion plate. When a correct security code is not entered for unlocking, engagement force of the lock plate against the lock pin of the push button is reduced. Accordingly, the lock pin is prevented from being damaged and bent.

In a nineteenth aspect of the present invention, the security code is released or altered easily and reliably without detaching the lock from the door and without using tools.

In a twentieth aspect of the present invention, the security code is easily and reliably altered.

In a twenty-first aspect of the present invention, the rotational position of the reset pin is easily and reliably changed by rotational operation of the changeover knob.

In a twenty-second aspect of the present invention, the driving cam is properly rotated and the lock is locked automatically when the door is closed.

In a twenty-third aspect of the present invention, the lock is not locked when the door is closed.

In a twenty-fourth aspect of the present invention, the lock is automatically locked when the door is closed, and the door is opened by inserting a key into the cylinder lock from outside.

In a twenty-fifth aspect of the present invention, the security code is easily set, released, and altered by operation of the rotator or the changeover knob from inside. The lock can be adapted to various modes, such as, the auto lock, the latch mode, and the deadlock. The changeover can be carried out easily.

In a twenty-sixth aspect of the present invention, the rotator is reliably operated.

In a twenty-seventh aspect of the present invention, the rotator is easily operated.

In a twenty-eighth aspect of the present invention, the changeover knob is operated reliably.

In a twenty-ninth aspect of the present invention, the rotator and the changeover knob can be protected.

In a thirtieth aspect of the present invention, the function of the deadlock is achieved by pressing the deadlock button.

In a thirty-first aspect of the present invention, the changeover plate and the handle-mounting plate that are attached inside have simple structures.

In a thirty-second aspect of the present invention, security while the deadlock is used is ensured.

In a thirty-third aspect of the present invention, operation of the enter button moves the button presser plate, the elongated hole closes the part or the whole of the aperture of the button presser plate, and whereby the push button shaft is prevented from being inserted.

In a thirty-fourth aspect of the present invention, the load applied to the lock pin is reduced.

3. Advantages of the Invention

Due to the above-described features, the mechanism of the security-code controller can be shared, and various surface designs are available. Rational production and design are possible, less maintenance is required, and mass production is facilitated.

In the present invention, the lock plate, the reset plate, and the lock pin, received inside the security-code controller are effectively protected and the security-code controller can be attached in an efficient manner.

The security-code controller mechanism can be adapted for various surface designs of the housing. The lock pin is easily manufactured.

The security code is set with the memory set plate, and the security code can be released or altered with the memory reset plate.

The structure of the lock pin is simplified, and the number of components is reduced, so that the lock pin can be produced at low cost.

The memory set plate and the memory reset plate are structured simply and the number of components can be reduced.

Due to the rotation of the rotator, the security code is easily and readily set, released, and altered. Further, the lock does not need to be detached from the door so that use of tools becomes unnecessary.

The security code is easily and readily set, released, and altered.

The rotational position of the lock pin is maintainable by the simple structure while the security code is set, released, and altered.

Operation of the enter pin releases the engagement between the lock plate and the driving cam reliably.

The load applied to the lock pin is reduced, material strength of the lock pin can be reduced, and whereby the lock pin is manufactured easily and at low cost. Further, tampering or trouble caused by erroneously pushing the push buttons can be prevented.

The security code is released or altered easily and reliably without detaching the security-code controller or the lock pin from the door and without using tools.

The rotational position of the reset pin is easily and reliably changed by rotational operation of the changeover knob.

The present invention is suitable for auto-lock use, in which the lock is unlocked when the programmed code is entered via each push button outside. The present invention is also suitable for latch-mode use, in which the door is openable by lever handles attached inside and outside without pressing the push button. Further, present invention is suitable for deadlock use, in which the door is automatically locked when closed, and the door is opened by inserting a key into the cylinder lock from outside.

The security code is easily set, released, and altered by operation of the rotator or the changeover knob from inside. The lock can be adapted to various modes, such as, the auto lock, the latch mode, and the deadlock. The changeover can be carried out easily.

Operation of the rotator is reliably and easily carried out. Further, operation of the changeover knob can be reliably carried out.

The rotator and the changeover knob can be protected.

The function of the deadlock is achieved by pressing the deadlock button.

The changeover plate and the handle-mounting plate attached inside become small and light so that the appearance of the door inside is improved.

Security while the deadlock is used is ensured,

Illegal operation, such as pressing the push button for knowing whether the security code has been entered, can be prevented.

Finally, the lock pin can be produced easily and at low cost.

BRIEF DESCRIPTION OF THE DRAWINGS

FIG. 19(*a*) is a back view showing an assembly of the lock plate and the driving cam. FIG. 19(*b*) is an exploded back view of the cushion plate.

FIG. 25(*a*) shows a state in which the auto lock mode is in use. FIG. 25(*b*) shows a state in which the latch mode is in use. FIG. 25(*c*) shows a state in which the deadlock mode is in use.

FIG. 34(*a*) shows the security-code controller immediately after assembly. FIG. 34(*b*) shows the depressed push button, maintaining the depressed position. FIG. 34(*c*) shows a cylinder of the changeover plate mounted on the interior side of the door after rotating it to the position for setting the security code (a set position). FIG. 34(*d*) shows the security-code controller showing a state in which the reset operation is completed after rotating the cylinder to the set position.

FIG. 35(*a*) shows the security-code controller after completing the reset operation. FIG. 35(*b*) shows a state in which the lock is unlocked when the set code is entered by the push button with the depressed position maintained.

DESCRIPTION OF THE EMBODIMENTS

Figure 1:
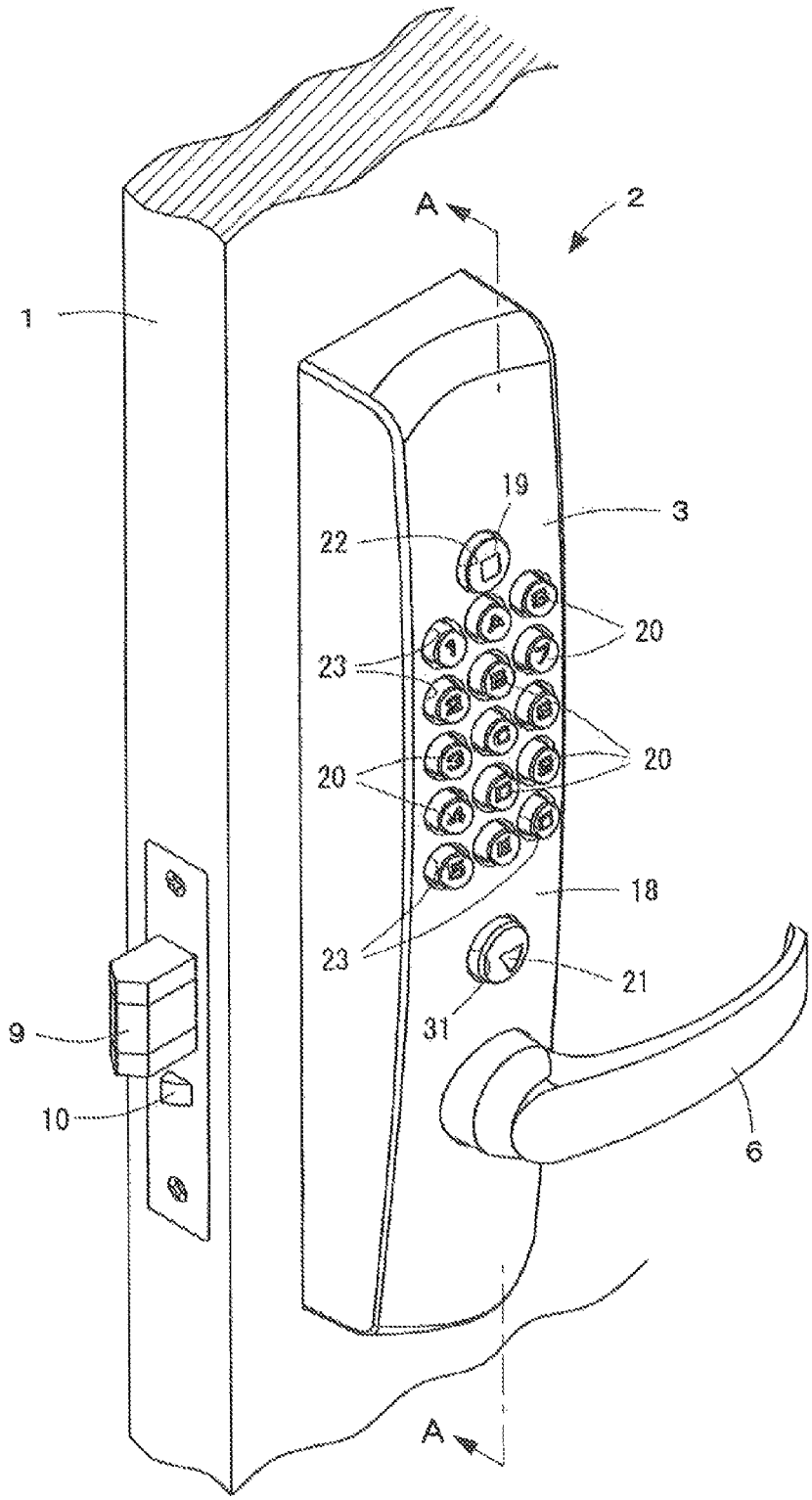
FIG. 1 is a perspective view of the present invention showing the exterior plate in use mounted on the exterior side of the door.
Figure 2:
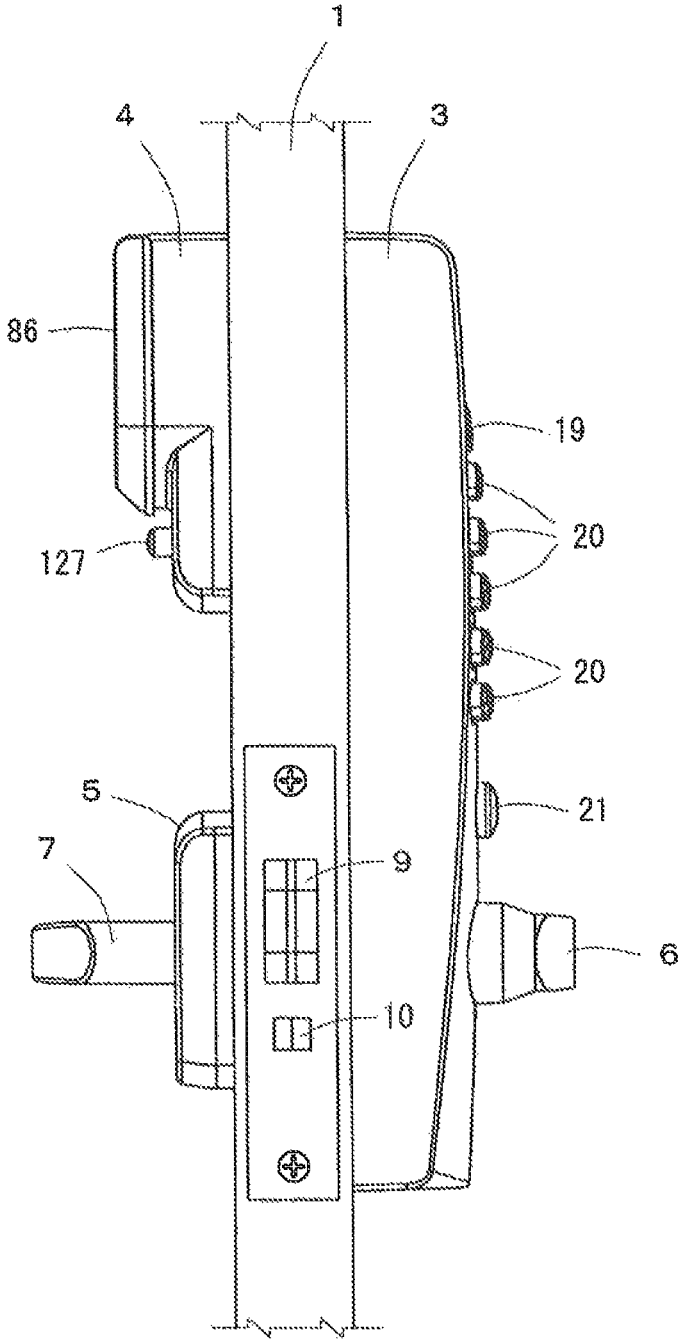
FIG. 2 is a side view of FIG. 1.

An embodiment of the present invention is shown in FIGS. 1 to 36. Reference numeral 1 denotes a door one side of which is rotatably attached to a frame (not shown) with a hinge. The middle to high position on the other side is provided with a push button lock 2, a mechanical lock. The push button lock 2 includes the exterior plate 3 having various operation buttons attached on the exterior side of the door 1, a changeover plate 4 mounted on the interior side of the door 1 for setting and altering the security code and setting and releasing the function of the push button lock 2, a handle-mounting plate 5 disposed below the changeover plate 4, and lever handles 6, 7 rotatably protrude from the lower part of the exterior plate 3 and a handle-mounting plate 5, respectively.

The deadbolt lock 8 is buried in the middle to high position of the door 1, the deadbolt 9 is extendable and retractable from the other side of the door 1 by locking and unlocking operation of the push button lock 2. Reference numeral 10 denotes an extendable latch trigger provided immediately below the deadbolt 9 and allows the deadbolt 9 to protrude. In Figures, reference numerals 11, 12, 13, and 14 denote pipe insertion holes formed at the middle to high position of the door 1, into which a connection pipe, as described later, is inserted. The pipe is protruded from the back of the exterior plate 3. Reference numerals 15 and 16 denote through holes formed immediately below the pipe hole 11, reference numeral 17 denotes a rod insertion hole formed coaxially with the lever handles 6 and 7.

The exterior plate 3 includes a housing 18 which protects the internal mechanism and defines the shape. The housing 18 is formed in substantially a rectangular-box shape by zinc alloy die-casting, and the front surface is forwardly projecting and gently curved. A reset button 19 having a large diameter, a plurality of push buttons 20 having a slightly smaller diameter than the reset button 19 are disposed on the upper front surface, and an enter button 21 is disposed below them. The shaft of the lever handle 6 is rotatably attached immediately below the button 21.

The push button 20 in the embodiment includes 15 push buttons in total. Ten push buttons indicate numbers on each top surface from one to zero. Five push buttons indicate alphabets on each top surface from A to E. The five push buttons with numbers are arranged in two rows, right and left. The push buttons with alphabets are arranged in a row therebetween. The fifteen push buttons enable the users to set the security code in $2^{15}$ ways, i.e. 32768 ways. The push buttons 20 have substantially the same shape. Thus, instead of using two types of characters, only one type of characters can be used for the indication, such as, the alphabet, Japanese Hiragana characters, Japanese Katakana characters, and Roman numbers.

Figure 12:
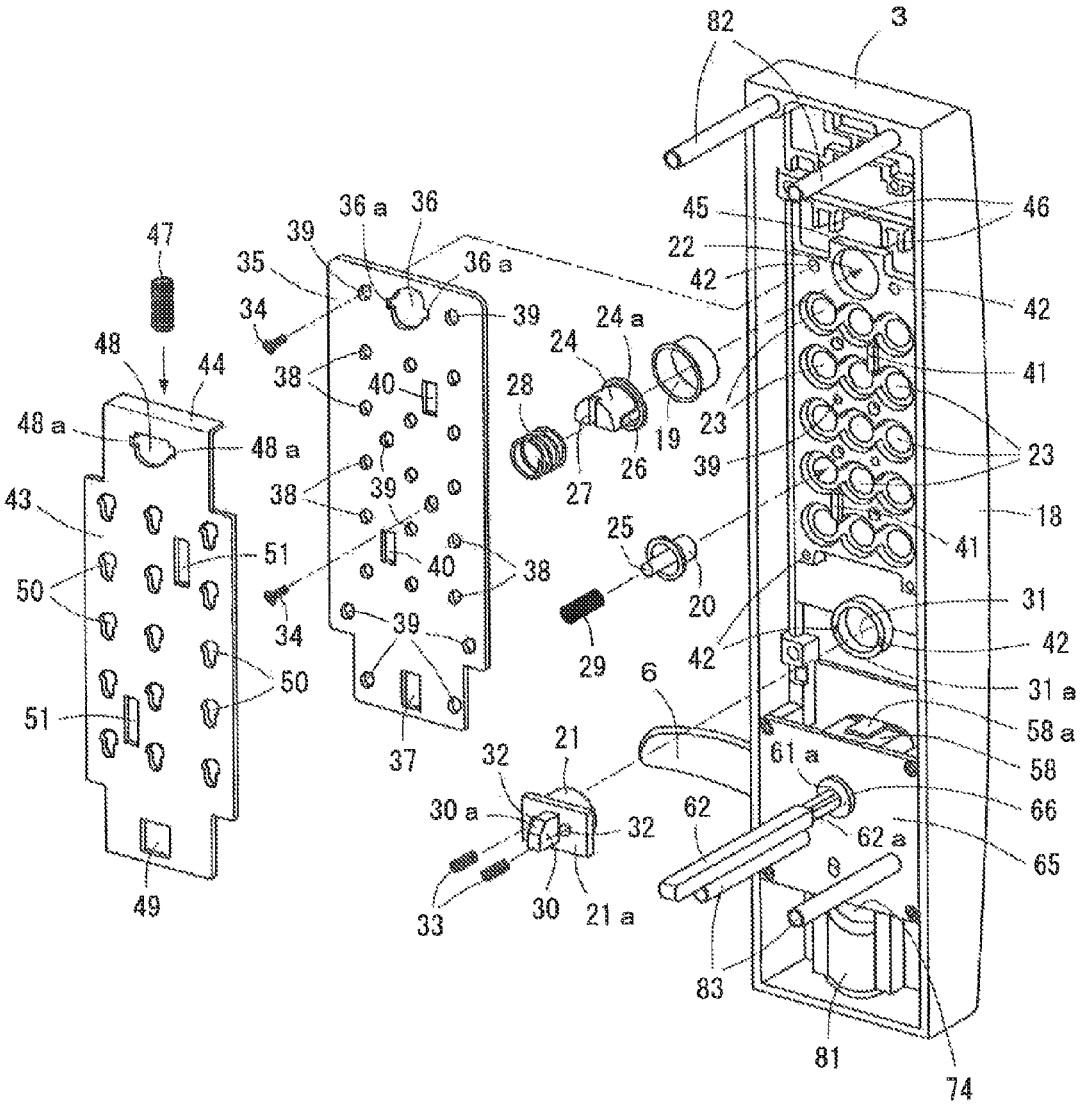
FIG. 12 is an exploded perspective view showing the back of the exterior plate applied to the present invention.

The upper half on the front surface of the housing 18 is provided with a reset button insertion hole 22 and a plurality of push button insertion holes 23 having an oval shape. Flanges of the push buttons 20 and the cup-like reset button 19 are engaged with the rims of the openings of the holes 22 and 23. A flange 24*a* of the reset-button shaft 24 is received in the reset button 19. The push button 20 is integrally formed with a cup portion and a button shaft 25. The button shaft 25 is projected from the inner surface of the cup portion. The reset-button shaft 24 has a substantially semicylindrical shape as shown in FIG. 12, and protrusions 26 are formed on both sides of the periphery. The end surface of the reset-button shaft 24 is formed with a concave groove 27 engageable with the protrusion of a reset pin, as described later. A reset-button spring 28 is received in the reset button 19. One end of the spring 28 contacts a button presser plate, as described later, and is compressed. The reset button 19 is projected outwardly against the resilience of the spring.

Figure 3:
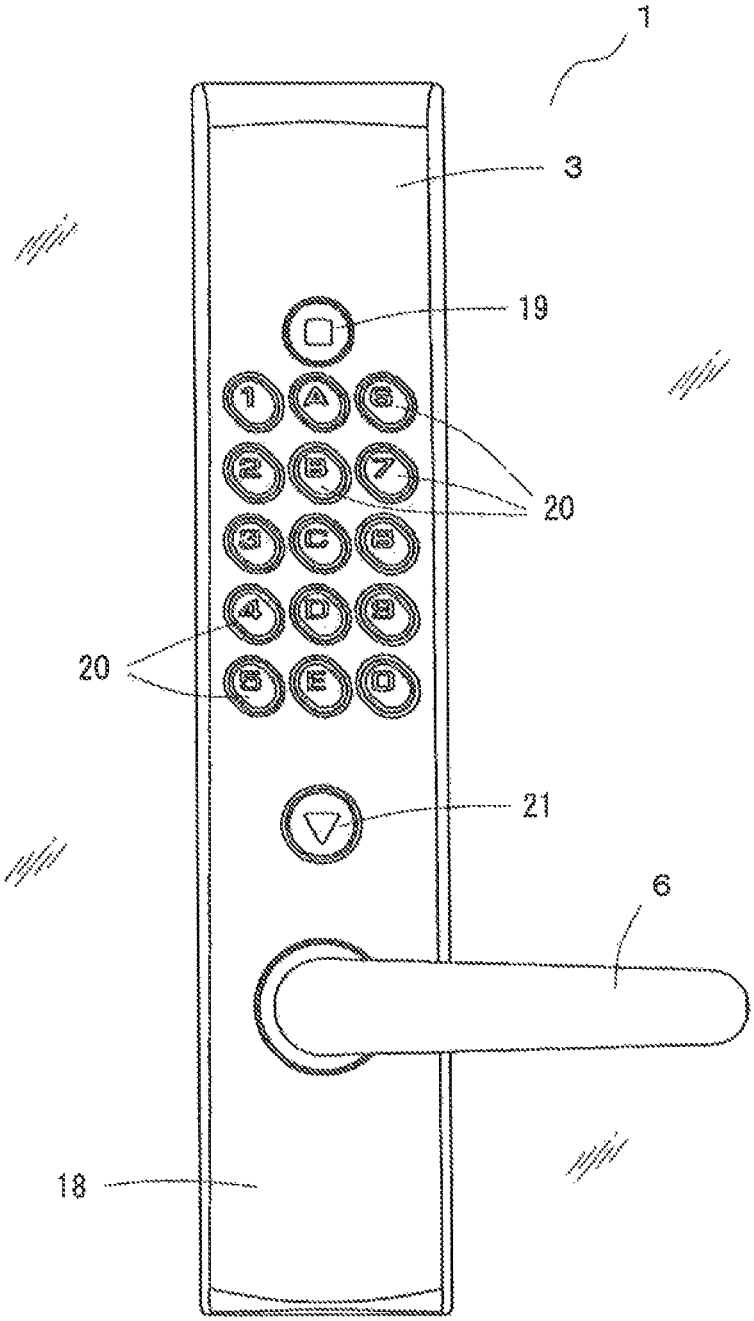
FIG. 3 is an elevation view of FIG. 1.
Figure 4:
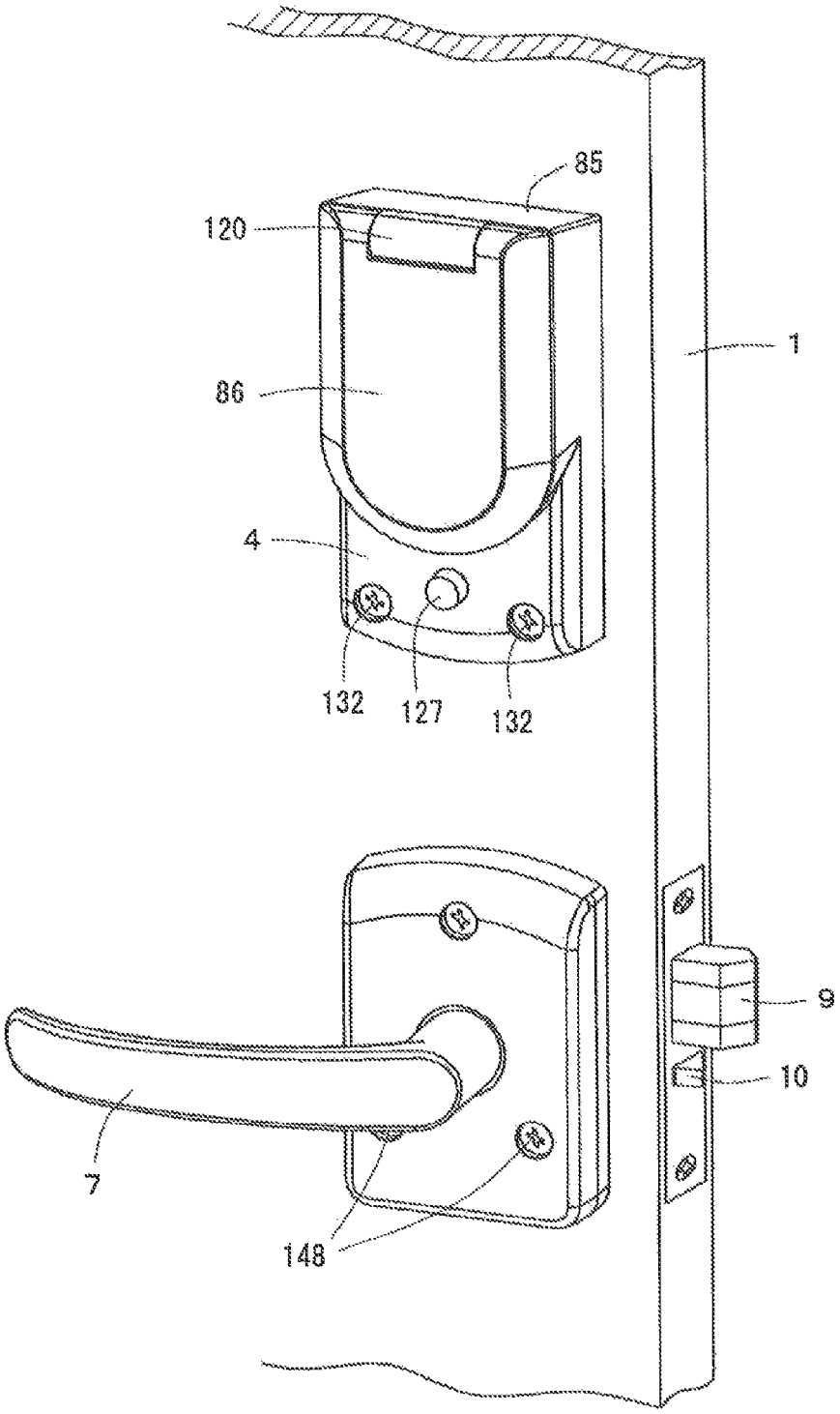
FIG. 4 is a perspective view showing the present invention in use and showing the changeover plate and the handle-mounting plate in use mounted on the interior side of the door.

As shown in FIG. 3, the push button 20 is formed in an oval shape and arranged obliquely. The pressing surface has a convex surface, and indication such as a letter or a number is marked thereon. The button shaft 25 is integrally formed in the push button 2.0 and the distal end is projected outwardly and arranged so as to engage with the head of a lock pin, which will be described later. A push button spring 29 is inserted into the push button shaft 25 and one end of the spring 29 contacts a button presser plate, which will be described later, and is compressed. The push button 20 is projected outwardly against the resilience of the spring.

The enter button 21 has a substantially cylindrical shape and a flange 21*a* is formed at the inner end. A square-rod-like dog 30 engageable with an enter pin, as described later, is projected from the center of the back end surface of the flange 21*a*. The distal end of the dog 30 is formed with a tapered portion 30*a*. The enter button 21 is inserted in an enter-button insertion hole 31 provided at the lower part of the housing 8, and the flange 21*a* is engaged with the hack end surface 31*a*.

A concave hole 32 is formed on both sides of the dog 30, the enter-button spring 33 is received in the concave hole 32. One end of the spring 33 contacts the button presser plate, as described later, and is compressed. The enter button 21 is projected outwardly against the resilience of the spring.

A steel button presser plate 35 is secured in the exterior plate 3 via a screw 34. The button presser plate 35 is formed in a vertically long rectangular shape and the upper part is provided with an engaging hole 36 having a convex portion 36*a* engageable with the reset-button shaft 24. The lower part of the button presser plate 35 is provided with a rectangular square hole 37 through which the dog 30 is inserted. A plurality of through holes 38 into which the button shaft 25 is inserted are aligned horizontally and vertically between the square hole 37 and the engaging hole 36.

In the figures, reference numeral 39 denotes a screw hole for the screw 34, reference numeral 40 denotes a square hole for positioning the button presser plate 35 and is engageable with a projection 41 provided on the bottom inner side of the exterior plate 3. Reference numeral 42 denotes a screw hole for a screw 34 and provided on the inside bottom of the exterior plate 3.

A steel tamper-proof plate 43 is disposed inside the button presser plate 35. The tamper-proof plate 43 is formed in a substantially vertically long rectangular shape and slightly narrower than the button presser plate 35. The top edge of the plate is provided with a bent piece 44 which is bent outwardly, and the bent piece 44 is engaged with a protrusion 45 provided on the inside bottom of the exterior plate 3. The inside bottom of the exterior plate 3, which faces the protrusion 45, is provided with concaved spring bearings 46, 46. A spring 47 is interposed between the spring bearing 46 and the bent piece 44, and the tamper-proof plate 43 is biased downwardly against the resilience of the spring 47.

The upper part of the tamper-proof plate 43 is provided with an engaging hole 48 having a substantially semicircular shape and including a convex 48*a* engageable with the reset-button shaft 24. The lower end of the tamper-proof plate 43 is formed with a rectangular square hole 49 through which the dog 30 extends and retracts, and the square hole 49 is arranged to engage with a tapered portion 30*a* of the dog 30. In Figures, reference numeral 50 denotes a plurality of elongated holes formed on the tamper-proof plate 43 and into which the button shaft 25 is inserted. Reference numeral 51 denotes a square hole for positioning and is engageable with the projection 41.

When the enter button 21 is pressed, the tapered portion 30*a* of the dog 30 is engaged with the square hole 49 and the tamper-proof plate 43 is moved upwardly against the spring 47, and the elongated hole 50 is moved simultaneously. Then, the part or the whole area of each through hole 38 is closed and the push button 20 is prevented from being pressed and the button shaft is prevented from moving. Thus, wrongful operation, for example for knowing whether the security code is entered to the lock pin, as described later, is prevented.

A shaft hole 52 is formed at the lower side of the housing 18 and to which a shaft of the lever handle 6 is rotatably attached via a sleeve 53. The outer side of the shaft hole 52 is provided with the shaft of the lever handle 6 and the inner side of the shaft hole 52 is provided with a stud 54, a washer 55 and a retaining ring 56 are mounted on the outer surface of the square shaft of the stud 54. A bolt 57 is screwed tightly to the shaft of the lever handle 6 from inside of the stud 54, and whereby the lever handle 6 and the stud 54 are connected together and move simultaneously.

A driving cam 58 is fitted with a square shaft portion of the stud 54 to move simultaneously. The driving cam 58 includes a flat cam surface, a rectangular convex portion 58*a* is formed on the center at one side of the cam surface and is engageable with a notched portion on one side of a bent piece of the lock plate. Then, the upward movement of the lock plate releases the engagement between the convex portion 58*a* and the notched portion, and thereby allowing the driving cam 58 to rotate against the bias of a torsion spring (not shown).

The end of the stud 54 is formed with a square hole 59 and a square shaft portion 60*a* of a joint 60 is fitted therein, and a gear 61 having a substantially fan shape is rotatably mounted to the cylindrical portion formed outside the joint 60. A square rod 62 engaged with the deadbolt lock 8 is rotatably inserted to the inner side of the joint 60 and the gear 61. Two pins 63, 64 are inserted in the square rod 62. The pin 64 is disposed to engage with a pair of fan-shaped grooves (not shown) formed inside the gear 61 and limits the angle of the gear 61. The other pin 63 is disposed to engage with a pair of fan-shaped grooves (not shown) formed inside the joint 60.

In Figures, reference numeral 62*a* denotes an engaging stepped portion on the square rod 62. Reference numeral 65 denotes a plate cover attached to the lower inner part of the housing 18 and the middle part of which is formed with a through hole 66. A boss 61*a* of the gear 61 is rotatably projected from the through hole 66. Reference numeral 67 denotes an engaging hail buried in the shaft of the lever handle 6 and is biased to engage with a sheet 69 via a spring 68, and thereby releasing the overload of the lever handle 6.

As an unlocking means when a deadlock is activated, as described later, a cylinder lock 70 is mounted downwardly to the lower part of the housing 18, and the cylinder lock 70 includes a cylinder 72 which is rotatable with a key 71 and the shaft end of the cylinder 72 is provided with a square shaft portion 73. The square shaft portion 73 is provided to engage with a square hole 75 of a rotation shaft 74, thereby transmitting the rotational force of the square shaft portion 73 to the rotation shaft 74. A shaft of the bevel gear 76 is fixed to the inside of the rotation shaft 74 and the bevel gear 76 is rotatably mounted by a bracket 77 integral with the housing 18.

The bevel gear 76 is disposed to engage with a bevel gear 78 and a support shaft 79 is supported in a blind hole 80 of the housing 18, and the bevel gear 78 is engaged with the gear 61. In Figures, reference numeral 81 denotes a cover attached to the top and bottom of the cylinder lock 70, reference numerals 82, 83 denote connecting pipes that are projected from the upper and lower edges of the back side of the housing 18 and a female screw is provided inside the pipes.

The changeover plate 4 is attached to the interior side of the door 1 via the connecting pipe 82 and a connecting pipe 84 projected from a cartridge, as described later. The changeover plate 4 is structured with a changeover plate body 85 having a substantially box shape and made of synthetic resin, and a cover 86 made of synthetic resin and from which one part of the outer surface of the body 85 appears. A base plate 87 having a rectangular shape is disposed on the back side of the changeover plate body 85, and the upper part of the base plate 87 is integrally provided with a stopper bearing 88. Three sheet surfaces 89 are formed at equal angular intervals in circumferential directions of the stopper 88, and projections 90, 90 are formed to face the sheet surfaces 89 located on right and left.

The center of the stopper hearing 88 is formed with a through hole 91, and an engaging shaft 92 is rotatably inserted in the through hole 15. The engaging shaft 92 has a square hole 92*a* therein and into which a square-shaft-like memory change pin is engageably inserted. The pin will be described later. One end of the engaging shaft 92 is formed with a square shaft portion 93 and the portion 93 fits within a square hole 95 of a stopper 94. A lip portion 96 is formed on a stopper 94 and seated on the sheet surface 89, and the engaging shaft 92 is positioned at a predetermined position. The lip portion contacts the protrusion 90, and thereby limiting the rotational angle of the engaging shaft 92.

On the other hand, the projected portion 85*a* is formed on the surface of the changeover plate body 85, a large-diameter through hole 97 and a blind hole 98 are formed on the center of the projected portion 85*a*, and the through hole 97 is located at the upper part and the blind hole 98 is located at the lower part. The blind hole 98 has a through hole 99 at the center thereof. A cylinder lock 100 is inserted into the through hole 97 as a rotator, a nut 101 is threaded into the threaded portion of the cylinder lock 100, and thereby securing the cylinder lock 100 to the projected portion 85*a*. A cylinder 103 turnable by inserting a key is provided inside the cylinder lock 100. The cylinder 103 has a square shaft portion 104 at the end thereof, the square shaft portion 104 is engaged with a square hole 105 formed at the square shaft portion 93, and enabling the rotational force of the cylinder 103 to be transmitted to the engaging shaft 92.

A spring 106 is interposed between the stopper 94 and the cylinder lock 100, the engaging shaft 92 is biased to the door side against the resilience of the spring 106, and thereby maintaining engagement with a memory change shaft, as described later. To set the security code, the reset button 19 is pressed and then a desired security code is entered with the push buttons 20, and the key 102 is inserted into the cylinder lock 100 and turned 90 degrees from a neutral position to a set direction.

On the other hand, to alter or release the set code, the reset button 19 is pressed, and then the key 102 is inserted into the cylinder lock 100 and turned 90 degrees from the neutral position to a reset direction. More specifically, the cylinder lock 100 normally resides at the neutral position. The lock 100 is turned from the neutral position to the set direction when the security code is set. The lock is turned from the neutral position to the reset direction when the security code is released or altered. After the lock is turned, the key 102 can be taken out when returned to the neutral position.

In this embodiment, the cylinder lock 100 is used as a means of providing a rotational force to the engaging shaft 92 and allows a key-holder to change or set the security code. Instead of the cylinder lock 100, a thumbturn, a tool, a coin may be engaged with the engaging shaft 92 as a rotator to rotate the engaging shaft 92.

A changeover shaft 108 integral with the latch changeover knob 107 is inserted into the through hole 99 and rotatably inserted into the through hole 16 via a through hole 109 formed on the base plate 87. A square hole 110 is formed in the changeover shaft 108 and a reset pin having a square shaft, which will be described later, is engageably inserted therein. The base of the changeover shaft 108 is formed with a square shaft 108*a*, the square shaft 108*a* is fitted within a square hole 112 of a stopper 111. A lip portion 113 of the stopper is provided to engage with a convex portion (not shown) formed on a hack side of the blind hole 98 and limits a rotational angle of the changeover shaft 108.

The latch changeover knob 107 is used to release the lock, which is locked and unlocked by entering the security code with the push button 20, and makes a door open by door handles 6, 7. More specifically, the security code is entered after pressing the reset button 19, the enter button 21 is then pressed, and the door is unlocked by turning the door handle 7. The cover 86 is opened with the state maintained, and the latch changeover knob 107 is turned to the latch side, that is, the direction of free.

In Figures, reference numeral 114 denotes a retaining ring attached to the periphery of the changeover shaft 108. Reference numeral 115 denotes a washer, and further, reference numeral 116 denotes a spring inserted between the washer 115 and the stopper 111. The changeover shaft 108 is biased to the side of the door 1 against the resilience of the spring.

Screw holes 118, 118 into which a screw 133 is inserted are formed on the upper part of the projected portion 85*a*, a projection 119 is formed between the screw holes 118, and a hinge case 120 having a substantially U-shape cross-section is fitted to the projection 119. The hinge case 120 is disposed in a cutout section 121 formed at pivot portions of the upper end of the cover 86, and a pair of pivots 122, 122 having a substantially V-shape apex are formed on the end faces that face the cutout section 121.

A substantially V-shaped engaging groove formed on the end surface of a hinge cam 123 is fitted with the apex of the pivot 122. A spring 124 is inserted between hinge cams 123, 123, and thereby maintaining a snug fit between the apex and the engaging groove. The hinge cam 123 has a square shaft engageable with the inner surface of the hinge case 120, the cover 86 is attached so as to rotate up and down about the pivots 122 via the hinge cams 123, 123, and the opened or closed state is maintainable.

A step portion 125 having a substantially key-hole configuration is protruded from the lower part of the base plate 87 and is defined by a rib 125*a*, a through hole 126 is formed on the lower part of the body 85, and a deadlock button 127 is inserted from the inside of the body 85. A flange 127*a* is formed at the end surface of the deadlock button 127, and the lower part of a switching plate 128 is arranged to contact the flange 127*a*. The switching plate 128 is made of a steel plate and has an elongated rectangular shape, one end has a bent leg 129, and the other end is engageable with the inside of the lip portion 113.

A spring bearing 130 is formed on the middle of the switching plate 128 by bending a pair of plates. A spring 131 is disposed between the step portion 125 and the switching plate 128, and the switching plate 128 is biased to the side of the deadlock button 127 against the resilience of the spring 131. The deadlock button 127 is normally biased outwardly of the door 1 and the leg 129 is seated on the step portion 125 when pressed. The displacement of the other end is increased by leverage of the switching plate 128, the stopper 111 is moved together via the lip portion 113, and rotation of the stopper 111 enables the latch changeover knob 107 to rotate to the side of the deadlock position. In Figures, reference numeral 132 denotes a screw hole formed on the lower part of the changeover plate body 85 and a screw 133 is insertable therein.

The handle-mounting plate 5 is formed substantially in a shape of a box by zinc alloy die-casting and a through hole 134 is formed on the concave center surface, which is inside the plate 5. A square shaft portion 7*a*, which is a shaft end of the lever handle 7, fits within the hole 134. A plurality of engaging teeth 135 are formed on the inner surface of a shaft hole, and thereby enabling a square portion of the square rod 62 to engage with the teeth 135. A washer 136 and a retaining ring 137 are mounted to the square shaft portion 7*a* inserted in the through hole 134, and thereby holding the square shaft portion 7*a* in place.

A back plate 139 is attached to a step portion 5*a* formed inside the handle-mounting plate 5 with screws 138. The through hole 140 is formed on the center of the back plate 139. A boss 142 of a spring bearing 141 is inserted in the through hole 140. A plurality of engaging teeth 143 are formed on the inner surface of a shaft hole of the boss 142 and thereby enabling a square portion of the square rod 62 to engage with the teeth 143.

Large and small spring pegs 144, 145 are projected from the opposed surfaces of the back plate 139 and the spring bearing 141, respectively. A stopper (not shown) is projected from the outer periphery of the spring peg 145 and provided to engage with the spring pegs 144, 145, and thereby limiting the rotational angle of the spring bearing 141 and the lever handles 6, 7. Both ends of the torsion spring 146 are engaged with the spring pegs 144, 145, the square rod 62 and the lever handles 6, 7 are rotatable to the original position against the resilience of the torsion spring 146. In Figures, reference numeral 147 denotes a screw hole formed on the handle-mounting plate 5. The handle-mounting plate 5 is attached to the door 1 by tightening screws 148 to the connecting pipes 83, 175.

The security-code controller 149, which has a rigid cartridge-like structure, is disposed between the exterior plate 3 and the door 1. The controller 149 is detachably attached to the exterior plate 3 and can be replaced. The security code entered with the push button 20 can be set and stored in the security-code controller 149, and is releasable and alterable. The controller 149 is formed in an elongated rectangular block shape, which is smaller than the exterior plate 3, and is structured by laminating a plurality of plate-like components.

The security-code controller 149 is structured by laminating the following components; a controller cover 150 disposed on the side of the door 1, a memory set plate 151 disposed on the outer side of the cover 150 and on the side of the exterior plate 3, a memory change intermediate plate 152 disposed on the outer side of the plate 151, a memory reset plate 153 disposed on the outer side the of plate 152, a reset plate 154 disposed on the outer side the plate 153, a lock plate 155 disposed on the outer side the reset plate 154, and a controller case 156 disposed on the outer side of the plate 155 and adjacent the tamper-proof plate 43.

The security-code controller 149 is made by assembling components 150 to 156. More specifically, a screw 157 is inserted in a screw hole 158 of the controller cover 150, and is screwed in a screw hole 159 on the controller cover 156. Then, a screw 160 inserted in a screw hole 161 on the controller case 156 is screwed into a screw hole 162 formed inside the exterior plate 3 and whereby security-code controller 149 is detachably attached inside the exterior plate 3.

The controller cover 150 is formed in a substantially elongated rectangular plate by zinc alloy die-casting. A stepped hole 164 is provided at the upper part and a memory change pin 163 is insertable therein. A stepped hole 166 is formed at the lower part and a reset pin 165 for changing the position to the latch position is insertable therein. A plurality of stepped washer holes 167 are provided at the middle part, and a through hole 169 having a step is provided at the lower end and an enter pin 168 is insertable therein.

A small-diameter through hole 172 is formed on the bottom of the washer hole 167, a pair of protrusions 173 is formed on the inner side of the opening of the through hole 172, and a disk-like stop washer 174 is rotatably received in the washer hole 167. In Figures, reference numeral 170 denotes an indication of the security code on the outer periphery of the opening and corresponds to an indication of the push button 20. Reference numeral 171 denotes a reinforcing bead.

The stop washer 174 is formed with a square hole 174*a* at the center and engageable with a square shaft of a lock pin, which will be described later. The back side is formed with an engaging groove 174*b* having a cross shape and engageable with the protrusions 173, and thereby, maintaining the rotational position of the lock pin at 90 degrees. In Figures, reference numerals 175 denote connecting pipes protruded from the middle part of the plate cover 170 and from the lower end part of the controller cover 150, and female screw potions are formed on the inner surfaces.

Protrusions 176, 177 for positioning are provided on the upper part and the lower ends of the inner surface of the controller cover 150 and are engageable with the inner wall of the controller case 156. A rectangular step portion 178 having a through hole 169 is protruded from the center of the protrusion 177, concave grooves 179, 180 are formed on the outside the step portion 178, to which a reset pin assembly to be described later, is attached. In Figures, reference numerals 221 denote pin holes for positioning formed on the upper and lower ends of the controller cover 150.

The memory set plate 151 is formed in an elongated rectangular shape by press molding a stainless steel plate and disposed on the inner side of the controller cover 150 and slidable up and down. Cutout portions 181 engageable with the protrusions 176 are formed on the upper part to limit the sliding displacement to the length of the cutout portions 181.

A bent piece 182 is formed on the upper end of the memory set plate 151, springs 190 are interposed between the outer surface of the bent piece 182 and the upper inner surface of the controller case 156, and the memory set plate 151 is biased to move downwardly against the resilience of the springs 190. A memory change cam, which will be described later, is rotatably disposed on the inner side of the bent piece 182 and is engaged with the bent piece 182, and whereby the memory set plate 151 moves up and down.

Openings 183, 184 are formed on the upper part of the memory set plate 151 and the memory change pin 163 and the reset pin 165 are insertable therein, respectively. Rectangular sliding grooves 185 are aligned in three rows from left to right, and a plurality of dogs 186 having a substantially L-shape are provided on one sides of the sliding grooves 185 and are engageable with one ends of the engagement pawls of the lock pins, which will be described later.

The memory change intermediate plate 152 is formed by press molding a corrosion-resistant steel plate and shaped as an elongated rectangular frame, and is secured to adjacent the inner side of the memory set plate 151. Cutout portions 187 engageable tightly with the protrusions 176 are formed on the upper part of the memory change intermediate plate 152, and an opening 188 into which the reset pin 165 is inserted is formed therebetween. The sliding grooves 185 and the dogs 186 appear from an opening 189 formed by cutting the lower part of the plate 152 in a rectangular shape.

The memory reset plate 153 is formed in an elongated rectangular shape by press molding a stainless steel plate and disposed on the inner side of the memory change intermediate plate 152 and is slidable up and down. The upper and lower part of the plate 153 are engaged with the protrusions 176, 177, respectively, and thereby limiting the sliding displacement. A bent piece 191 is formed on the upper end of the memory reset plate 153 and disposed to engage with a protrusion 192 on the inner side of the controller case 156. Springs 193 are interposed between the protrusion 192 and the bent piece 191, and the memory reset plate 153 is biased to move upwardly against the resilience of the spring 193.

Opening 194 is formed on the upper part of the memory reset plate 153 and the reset pin 165 is insertable therein. Rectangular sliding grooves 195 are arranged on the lower part in three rows from left to right, and a plurality of dogs 196 having a substantially inverted L-shape and a symmetrical configuration with the dog 186 are provided to engage with one sides of the sliding grooves 195 and the dogs 196 are provided to engage with the other ends of the lock pins, as described later.

The reset plate 154 is formed in an elongated rectangular shape by zinc alloy die-casting. A reset-spring presser plate 197, having an elongated rectangular shape and made of a corrosion-resistant steel plate, is secured to one side of the memory reset plate 153 by caulking via a pin 154*a*. The reset plate 154 is provided on the inner side of the memory reset plate 153 and slidable up and down. The upper end of the reset plate 154 is engageable with the end of an opening of a concave portion, as described later, and a square portion 154*a* on the lower part is provided to engage with a step portion 198 on the inner side of the controller case 156, and thereby limiting the up and down movement.

A rectangular opening 199 into which the reset pin 165 is inserted is formed on the upper part of the reset plate 154 and a tapered surface 199*a* is formed on the top inner surface and engageable with a tapered portion of the reset in 165, as descried later. A protrusion 200 is formed on the top end of the reset plate 154 and engageably inserted in the protrusion 201 provided on the inner side of the controller case 156. A spring 202 is interposed between the inner surface of the protrusion 201 and the protrusion 200. The reset plate 154 is biased to move downwardly against the resilience of the spring 202.

The reset plate 154 and the a reset-spring presser plate 197 are formed with the same number of oval elongated holes 203 as the push buttons 20, and spring-receiving grooves 204 are provided to face the elongated holes 203. Each end of the spring-receiving groove 204 is provided with a pin 206 that supports a reset spring 205, which is a torsion spring. One end of the reset spring 205 is engaged with one surface of the spring-receiving groove 204 and the other end, which is a free end, is provided on the other side of the spring-receiving groove 204 and engageable with a lock pin, as described later.

More specifically, before entering the password with push button 20, the free end of the reset spring 205 is retracted from the lock pin and positioned at the lower part of a cone flange, as described later, that is the periphery of the smaller diameter. After entering the password with push button 20, the free end of the reset spring 205 is engaged with the top part of the cone flange, that is the larger diameter side, thereby maintaining the lock pin in the depressed position, and the entered password is maintainable. In Figures, reference numeral 250 denotes an opening window formed on the lower end of the reset plate 154 and an enter-pin assembly, as described later, can be attached.

The lock plate 155 is formed in an elongated rectangular shape by press molding a stainless steel plate and is disposed on the inner surface of the controller case 156 and is slidable up and down. The upper end is engaged with the lower end surface of a concave portion 201, the square portion 155*a* on the lower part is engaged with the step portion 198, and thereby limiting the up and down movement of the lock plate 155. A rectangular opening 207 is formed on the upper part of the lock plate 155 and the reset pin 165 is rotatably and engageably inserted therein, and a cutout groove 207*a* is formed at the center of the upper rim.

Figure 25:
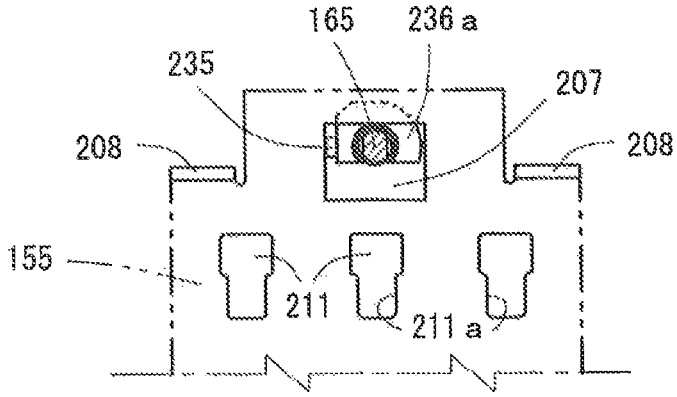
FIG. 25 shows the reset pin and the lock plate of the security-code controller in use applied to the present invention.
Figure 25:
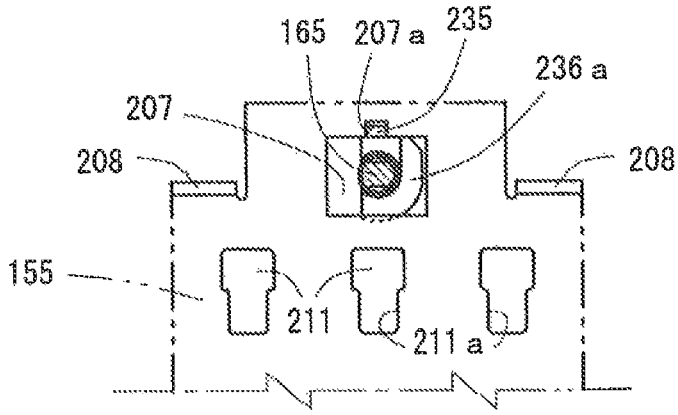
Figure 25:
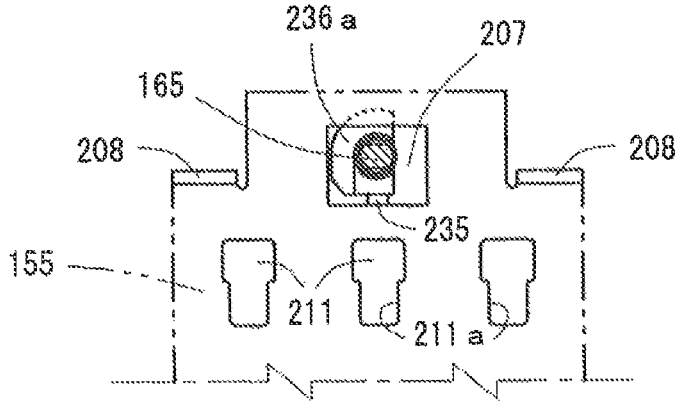
Figure 26:
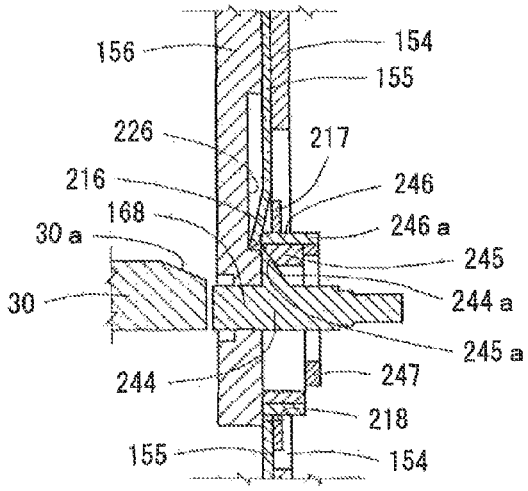
FIG. 26 is an enlarged cross section showing an assembly of the enter pin, the lock plate, the enter button of the security-code controller, and the controller case applied to the present invention.

The up and down position of the lock plate 155 is regulated by rotational angle of the reset pin 165 linked to the set position of the changeover knob 107 of the changeover plate 4 so that the lock can be used in an auto lock state, latch state, and deadlock state. For example, in the auto lock, a door is automatically locked when closed and is unlocked by pressing the set code with the push button 20 on the exterior side. In this case, the changeover knob 107 is set to the auto lock position, a protrusion of the lock pin 165 to be described later is positioned laterally in the opening 207 as shown in FIG. 25(*a*). A large space is formed between the end surface of the engaging piece and the lower edge of the opening 207 as described later, and enabling the lock plate 155 to displace up and down and to respond to rotation of the driving cam 58 when the lock is unlocked.

In the latch mode, the door is not locked when closed and can be opened from inside and outside by the lever handles 6, 7 without pressing the push button 20, in this case, the changeover knob 107 is set to the latch (free) position, rotation of the reset pin 165 allows the protrusion to engage with the cutout groove 207*a* of the opening 207 as shown in FIG. 25(*b*). Thus, the lock plate 155 can be displaced upwardly a given amount and respond to the rotation of the driving cam 58.

Further, in the deadlock mode, the door is automatically locked when closed and opened by key operation of the cylinder lock 70 from the exterior side. In this case, the changeover knob 107 is set to the deadlock position, rotation of the reset pin 165 allows the protrusion to engage with the lower opening edge of the opening 207 and prevents upward displacement of the lock plate 155.

Bent pieces 208 are formed on the both sides of the lock plate 155 and provided to engage with elongated grooves 209 on the inner side of the controller case 156. Springs 210 are interposed between the elongated grooves 209 and the bent pieces 208 so that the lock plate 155 is biased to move downwardly against the resilience of the springs 210.

The same number of plate key holes 211 as the push button 20 are formed on the middle of the lock plate 155 and have a substantially hook shape. The first and second shaft keys 240, 241 of the lock pin, as described later, are rotatable in the plate key holes. Plate lock holes 211*a* having a rectangular shape are formed on the plate key holes 211 and they are in communication with each other. The plate lock hole 211*a* is narrower than the plate key hole 211. The lock plate 155 is moved upwardly when abutment surfaces 240*a*, 241*a* of the first and second shaft keys are in parallel to the plate lock holes 211*a*. The lock plate 155 is prevented from moving upwardly when the abutment surfaces 240*a*, 241*a* of the first and second shaft keys intersect each other, i.e., orthogonal positions.

In the embodiment, before the security code is entered with the push button 20, the abutment surface 241*a* of the second-shaft key 241 is parallel to the plate lock hole 211*a*, and whereby the lock plate 155 is movable. When the lock is locked, that is, resetting the lock after the security code is set with push button 20, the abutment surface 241*a* of the second shaft key 241 of the lock pin, in which the security code is set, is positioned to abut an opening rim of the plate lock hole 211*a*, and thereby preventing movement of the lock plate 155.

Bent pieces 212, 213 are respectively projected inwardly and outwardly from the bottom of the lock plate 155, and are engageable with the driving cam 58. The bent piece 212 is wider than the bent piece 213 and slidably contacts the cam surface of the driving cam 58, and wear and abrasion of the cam surface may be prevented. The bent piece 213 is thicker and narrower than the bent piece 212 and is provided on the middle with the cutout portion 213*a* and is engageable with the convex portion 58*a* of the driving cam 58.

A substantially rectangular opening 214 is formed on the lower part of the lock plate 155 and the enter-pin assembly is provided therein. Bent pieces 215 having an L-shape are protruded toward the exterior plate 3 from both sides of the opening window 214. An engagement pawl 216 is raised toward the exterior plate 3 on the upper edge of the opening window 214 and the end portion is engageable and movable with a recess on the controller case 156, as described later.

A cushion plate 217 is disposed adjacent the engagement pawl 216. A rectangular opening 218, which is substantially the same shape as the opening window 214, is formed on the cushion plate 217, and the upper edge of the opening 218 is engageable with the second slider, as described later. Bent pieces 219 having a substantially L-shape are protruded from both sides of the lower part of the cushion plate 217. The bent pieces 215, 219 are engageable and movable with an elongated groove on the controller case 156, as described later. Brake springs 220 are interposed between the bent pieces 215, 219 and biasing the cushion plate 217 downwardly.

Accordingly, when the lock is unlocked, in a case where the enter button 21 is pressed without entering in the correct code with the push button 20, the lock plate 155 is moved upwardly via the slider by movement of an enter pin, as described later. Then, the cushion plate 217 is moved upwardly via the second slider against bias of the brake spring 220. Thus, the shaft force of enter pin is lowered, improper engagement force of the lock plate 155 to the lock pin is lowered, and whereby damage of the lock pin is prevented.

The controller case 156 is formed in a vertically elongated rectangular box by zinc alloy die-casting, and a cam hole 222 is formed on the inner top surface and the shaft of a memory change cam, as described later, is insertable therein, and a stopper 223 is projected from the adjacent position. A through hole 224 is formed immediately below the protrusion 201 and the reset pin 165 is insertable therein. A plurality of stepped holes 225 for rotatably receiving the head of the lock pin and a first-shaft key 240, as described later, are formed below the through hole 224. A rectangular engaging groove 226 engageable with the engagement pawl 216 is formed at the lower end and a pin hole 227 into which an enter pin 168 is inserted is formed immediately below the groove 226.

In Figures, reference numerals 228 denote long grooves in which the bent pieces 215, 219 are insertable. Reference numerals 229 denote pins protruded from the upper and lower edges on the inner side of the controller case 156 and are inserted in the pin holes 221.

The shaft 231 of the memory change cam 230 resides in the cam hole 222, and the shaft is provided at the end with a square hole 232. A square shaft portion 163*a*, one end of the memory change pin 163, resides in the square hole 232 and the flange 233 is engaged with the opening edge of the square hole 232. The memory change pin 163 is formed like a shaft by zinc alloy die-casting. The other end of the square shaft portion 163*a* is formed in a square shaft and shifted 90 degrees in phase with respect to the square shaft portion 163*a*.

The other end of the memory change pin 163 projected from the controller cover 150 toward the outer surface of the door 1, and is engaged with a square hole 92*a* of the engaging shaft 92 and linked to the cylinder 103 provided on the changeover plate 4. The memory change pin 163 is rotatable with a key in the direction of set or reset, and operable when setting, releasing, and altering the security code.

For example, when setting the security code, depress the reset button 19 first to move up the reset plate 154 and release engagement of the reset spring to a lock pin to be described later. The lock pin is returned to the original position by a set spring, and the push button 20 before setting the code is returned to the original position, clearing an erroneous push. One side surface of the memory change cam 230 is normally engaged with the inner side of the bent piece 182 of the memory set plate 151, the other side is engaged with the bent piece 191 of the memory reset plate 153, and are ready for setting, releasing, and altering the security code.

Under these circumstances, to set the security code, the desired security code is entered with the push button 20. Then, the cylinder lock 100 is rotated in the set direction, a counterclockwise direction in FIG. 8, by inserting a key 102. The memory change cam 230 is rotated in the same direction and the memory set plate 151 is moved up via the bent piece 182. The dog 186 is engaged with the engagement pawl of the lock pin and then the lock pin is rotated. Then, the lock is reset while maintaining the rotational position via a set spring, and the lock pin is returned to the original position.

On the other hand, the security code is released and altered in the following manner. After resetting the lock, the key 102 is turned to the reset direction, that is a clockwise direction in FIG. 18, and rotate the memory change cam 230 in the same direction. Then, the memory reset plate 153 is moved down via the bent piece 191, the dog 196 is engaged with the engagement pawl of the lock pin and the lock pin is rotated in a counterclockwise direction, and thereby returning the memory reset plate 153 to the original position by resilience of the spring 190.

Figure 23:
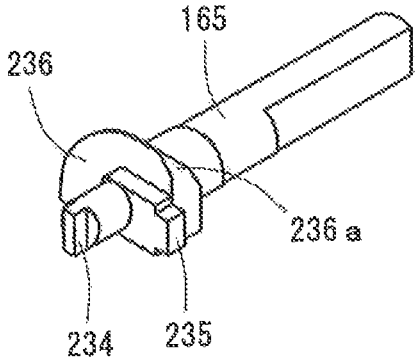
FIG. 23 is a perspective view showing an example of the reset pin of the security-code controller applied to the present invention.
Figure 24:
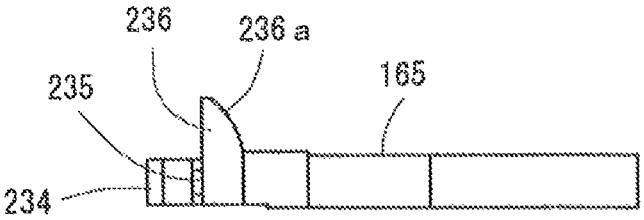
FIG. 24 is an elevation view of FIG. 23.

The reset pin 165 is formed like a square shaft by zinc alloy die-casting and has substantially the same diameter as the memory change pin 163 and is longer than the pin 163 as shown in FIG. 23, and is formed at one end thereof with a square-shaft like protrusion 234 engageable with the concave groove 27 of the reset-button shaft 24. A lateral protrusion 235 is provided on the middle of the reset pin 165, an offset position. An engagement piece 236 having a semicircular shape is formed adjacent the protrusion 235 and formed at one side with an engagement surface 236*a*. The engagement surface 236*a* has substantially a cone shape and is engageable with the tapered surface 199*a* of the reset plate 154.

The reset plate 154 is moved up by the engagement surface 236*a* in accordance with depression displacement of the reset button 19 and engagement of the reset spring to the lock pin is released, and the lock pin is returned to the original position. The other end of the reset pin 165 is formed like a square shaft, the same phase as the protrusion 234, and the square shaft portion is engageably inserted in the square hole 110 of the changeover knob 107.

The lock pin 237 is formed like a shaft by zinc alloy die-casting and provided at one end, the door side, with a square shaft portion 237*a* engageable with the square hole 174*a* of the stop washer 174. An engagement pawl 238 substantially in the form of a triangular prism is protruded radially from the middle part and is engageable with the dogs 186, 196. The engagement pawl 238 is provided at a 45 degree position from the shaft center of major axes of the first and second shaft keys disposed orthogonal to each other, as described later. The engagement pawl 238 is rotatable 90 degrees forwardly and reversely when engaged with the dogs 186, 196.

A cone flange 239 having an inverted-circular truncated cone is provided in proximity to the engagement pawl 238. The first and second shaft keys 240, 241 having the same shape are stacked on the flange 239. The shaft keys 240, 241 have a cross section of an elongated square shaft, formed by cutting the both sides of the shaft periphery to be parallel to each other, and arranged orthogonal to each other, shifting the center of the major axis side in phase by 90 degrees.

The first shaft key 240 on the top side is orthogonal to the cross section of the square shaft portion 237*a*. The second shaft key 241 is arranged immediately above the larger diameter side of the cone flange 239 and has the same phase as the cross section of the square shaft portion 237*a*, and a shaft head 242 is projected from the first shaft key 240.

The shaft head 242 is rotatably inserted in the stepped hole 225 together with the first shaft key 240, the end surface faces the opening of the stepped hole 225 and is engageable with the end of the button shaft 25. The second shaft key 241 is positioned within the plate key hole 211, the abutment surface 241*a*, which is a flat surface, is provided parallel to the plate lock hole 211*a*, and whereby the lock plate 155 is movable.

The square shaft portion 237*a*, one end of the lock pin 237, is inserted in the square hole 174*a* of the stop washer 174 and the other end faces the opening of the stepped hole 225. A lock spring 243 having a conical coil-like configuration is interposed between a step of the square shaft portion 237*a* and the stop washer 174, and the lock pin 237 is biased toward the push button 20 against the resilience of the spring 243.

Figure 34:
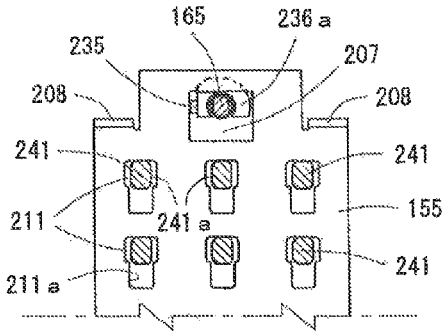
FIG. 34 is an explanatory view showing procedures of setting the security code for the security-code controller applied to the present invention.
Figure 34:
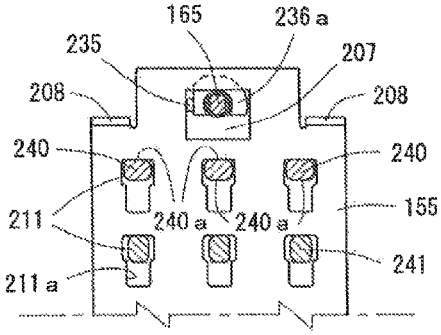
Figure 34:
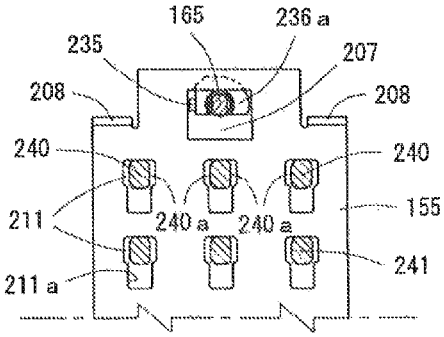
Figure 34:
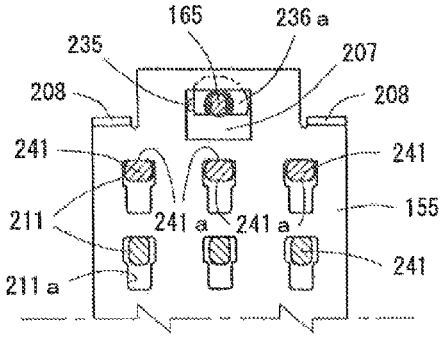

Before the security code is entered with the push button 20, the shaft head 242 and the first shaft key 240 of the lock pin 237 are positioned within the stepped hole 225. The abutment surface 241*a* of the second shaft key 241 is provided parallel to the plate lock hole 211*a* of the lock plate 155, and whereby the lock plate 155 is movable. This state is shown in FIG. 34(*a*).

On the other hand, when the security code is set with the push button 20, the lock pin 237 is pressed against the lock spring 243. The abutment surface 240*a* of the first shaft key 240 is engaged with the opening rim of the plate lock hole 211*a* of the lock plate 155, and thereby preventing the lock plate 155 from moving. This state is shown in FIG. 34(*b*).

Before the push button 20 is depressed, the engagement pawl 238 of the lock pin 237 is positioned over the memory set plate 151 and the memory reset plate 153. The engagement pawl 238 is arranged obliquely at an angle of 45 degree with respect to the square shaft portion 237*a* and is engageable with the dog 186 of the memory set plate 151 and the dog 196 of the memory reset plate 153. The position is kept by engagement between the engaging groove 174*b* of the stop washer 174 and the protrusion 173 of the controller cover 150.

Before the push button 20 is depressed, the free end of the reset spring 205 is positioned close to the smaller diameter side of the cone flange 239. After the push button 20 is depressed, the reset spring 205 is positioned on the larger diameter side of the cone flange 239 and keeps the lock pin 237 in the depressed position. Then, when the reset button 19 is depressed, the reset pin 165 is moved together and the reset plate 153 is moved upwardly. Then, the free end of the reset spring 205 is retracted and whereby the engagement is released, and the lock pin 237 is moved upwardly via the lock spring 243 and is returned to the original position.

At that time the second shaft key 241 is moved to the plate key hole 211 and the abutment surface 241*a* is positioned to engage with the plate lock hole 211*a*, and thereby preventing movement of the lock plate 155 and whereby the lock is locked. This state is shown in FIG. 34(*d*).

On the other hand, when the security code is altered by operation of the memory change knob 107, the engagement pawl 238 is engaged with the dogs 186, 196 of the memory set plate 151 and memory reset plate 153 and then rotated. The square shaft portion 237*a* is moved simultaneously and the stop washer 174 is rotated. The engaging groove 174*b* on the back side of the washer 174 is engaged with the protrusion 173, and thereby maintaining the rotational angle of the lock pin 237.

The enter pin 168 and an assembly of the enter pin 168 are attached to the corresponding position on the controller case 156, which faces the dog 30. The enter pin 168 is formed like a shaft by zinc alloy die-casting and one end of which is inserted in the pin hole 227 provided at the lower part of the controller case 156 and the end surface is engageable with the enter pin 168. A rectangular flange 244 is formed at the middle part of the enter pin 168 and has a tapered surface 244*a* on the upper part of the flange 244, and a shaft having a step is protruded at the other side of the flange 244.

The first slider 245 having a rectangular frame shape is provided outside the flange 244 and a tapered surface 245*a* engageable with the tapered surface 244*a* is formed on the upper inner surface. The second slider 246 having a rectangular frame shape is provided to engage with the outer periphery of the first slider 245, and the top and bottom end surfaces of the slider 246 are provided to engage with the inner surface of the opening 218.

The cushion plate 217 is engaged with the upper end surface of the second slider 246, the third slider 247 having a rectangular frame shape is provided outside the second slider 246 and the upper end is engageable is a projection 246*a* of the second slider 246. Legs 248 are projected from one side of the third slider 247 and disposed to engage with the outer periphery of the second slider 246, and the outer surface is provided to engage with the left and right inner surfaces of the opening 218.

When the enter button 21 is pressed, the enter pin 168 is depressed. Then, the first slider 245 is moved up via the tapered surfaces 244*a*, 245*a*, moving the second and the third slider 246, 247 simultaneously. The top end of the first slider 245 is engaged with the tapered surface 216, pushing up the tapered surface 216 and moving the lock plate 155 simultaneously. Then, the bent pieces 212, 213 are retracted from a rotational area of the driving cam 58 and enable the driving cam 58 to rotate, and whereby the lock is unlocked.

Upon unlocking the lock, in the case where the correct security code is not entered with the push button 20, the lock plate 155 is not movable engaging with the shaft key 242 of the lock pin 237, and the lock cannot be unlocked. Under these circumstances, when the enter button 21 is pressed, the first to third sliders 245 to 247 are moved upwardly by depression displacement of the enter pin 168, the brake spring 220 is compressed and moves the cushion plate 217 upwardly, and whereby shaft force of the enter pin 168 is absorbed. Therefore, the lock plate 155 is prevented from being damaged, and upward displacement of the lock plate 155 is controlled. The load on the lock pin 237 which prevents the upward movement is reduced. The lock pin 237 requires less mechanical strength and the material can be replaced from steel to zinc alloy die-casting, which is inexpensive. Further, tampering or trouble caused by erroneously pushing the push buttons 20 can be prevented.

The push button lock thus configured includes the exterior plate 3 on the exterior surface of the door 1, the changeover plate 4 and the handle-mounting plate 5 provided on the interior surface of the door 1, and they are separately manufactured and attached to the inner and outer positions of the door 1, respectively. The changeover plate 4 and the handle-mounting plate 5 are separately manufactured and provided on the interior surface of the door 1 so that the handle-mounting plate 5 becomes small and light compared to the conventional one. Further, the changeover plate 4 and the lever handle 7 can be operated independently and smoothly.

Next, the exterior plate 3 is manufactured in the following manner. The exterior plate 3 is composed of a housing assembly and the security-code controller 149. The housing assembly includes a housing 18 to which the reset button 19, the enter button 21, and the lever handle 6 are assembled. The security-code controller 149 is attached to the inner side of the assembly. After they are separately manufactured, they are integrally attached to each other.

Accordingly, the housing assembly and the security-code controller 149 can be produced in an efficient manner. Since the security-code controller 149 has a common structure, various surface designs are available, corresponding to the shapes of the housing 18, the push button 20, the reset button 19, the enter button 21, and the number and arrangement of the push button 20. In other words, since the security-code controller 149 can be used for the various surface designs of the housing 18, the design is simplified and thus provides easier maintenance of the security-code controller 149.

The housing assembly is manufactured in the following manner. The reset-button shaft 24 and the reset-button spring 28 are inserted in the reset-button insertion hole 22 from the inside of the housing 18. The push button 20 integral with the button shaft 25 and the push button spring 28 are inserted within each of the push button insertion hole 23 from the inside of the housing 18. Further, the enter button 21 is inserted in the enter-button insertion hole 31, and the enter button spring 33 is inserted in the concave hole 32 on the inner side of the button 21.

In this case, since the push button 20 is formed integral with the button shaft 25, the number of components can be reduced, and thereby making assembly of the push button 20 easier. After the insertion, the button presser plate 35 is received inside these components. The screw 34 is inserted in the screw hole 39 on the plate 35 and screwed into the screw hole 42 on the housing 18 to fix the plate 35 in place. This state is shown in FIG. 12. Thereafter, the tamper-proof plate 43 is disposed on the button presser plate 35, the bent piece 44 is engaged with the protrusion 45, the spring 47 is inserted between the bent piece 44 and a convex wall immediately above the bent piece 44, and whereby the tamper-proof plate 43 is biased downwardly.

Next, in order to attach the lever handle 6 to the lower inner part of the housing 18, the sleeve 53 is inserted in the outer side of the shaft hole 52. The shaft of the lever handle 6 is fitted within the outer side of the sleeve 53. One end of the stud 54 is joined to the inner end of the shaft via the sheet 69 and the bolt 57 is screwed into the shaft of the lever handle 6 and clamped from the inner side of the stud 54.

Then, the driving cam 58 is fitted with the periphery of the square shaft of the stud 54, the square shaft of the joint 60 is fitted within the square hole 59 formed at the end of the cam 58, and the gear 61 is rotatably attached to a boss formed at the end thereof. The square rod 62 is inserted in the inner side of the joint 60, two pins 63, 64 are inserted in the square rod 62 and one of the pins 64 is engaged with an angle regulation groove (not shown) and the other pin 63 is engaged with the end of the stud 54. Then, the rotational angle of the gear 61 is regulated at 90 degrees.

The support shaft 79 of the bevel gear 78 is rotatably inserted in the blind hole 80 at the lower part of the housing 18. The bevel gear 78 is provided to engage with the gear 61. The shaft of the bevel gear 76 engaged with the bevel gear 78 is rotatably supported in the bracket 77, and the shaft is connected to the rotation shaft 74.

On the other hand, the cylinder lock 70 is attached to the bottom of the housing 18 via a mounting cover 81. The square shaft portion 73 integral with the cylinder 72 of the cylinder lock 70 is engaged with the square hole 75 of the rotational shaft 74, and rotational displacement of the cylinder lock 70 is engageable with the gear 61. Thereafter, a plate cover 65 from which the connecting pipes 83 are projected is attached to the lower inside of the housing 18. The boss 61*a* of the gear 61 and the square rod 62 are projected from the cover 65. The support shaft of the bevel gear 78, which is the same shaft as the support shaft 79, is rotatably projected therefrom. The connecting pipes 82 are attached to the housing 18 in advance or after a series of assembly.

Next, in order to manufacture the security-code controller 149, the components, the controller case 156 and the controller cover 150 are formed by zinc alloy die-casting. The memory set plate 151, the memory change intermediate plate 152, the memory reset plate 153, and the reset plate 154 are formed by press molding of a steel plate. The memory change pin 163, the memory change cam 230, the reset pin 165, and the lock pin 237 are formed by zinc alloy die-casting. Additionally, the enter pin 168 and the first to third sliders 215 to 247 are formed by zinc alloy die-casting.

In order to assemble the components, for example, an assembling jig (not shown) is prepared for engaging the controller case 156. The controller case 156 is received in the jig with the top upward. Then, the enter pin 168 is inserted in the pin hole 227 on the lower part of the case 156. Thereafter, the lock plate 155 to which the cushion plate 217 is assembled is received inside the controller case 156. The bent pieces 208 are engaged with the opening edges of the elongated grooves 209. Springs 210 are inserted between the bent pieces 208 and the inner surfaces of the elongated grooves 209 respectively, and the lock plate 155 is biased downwardly.

The engagement pawl 216 integral with the lock plate 155 is movably received in the engaging groove 226 of the controller case 156, and the end portion is provided to face the end portion of the flange 244 of the enter pin 168. The first to the third sliders 245 to 247 are provided to engage with the flange 244 in sequence and the cushion plate 217 is engaged with the top end of the second slider 246.

Figure 27:
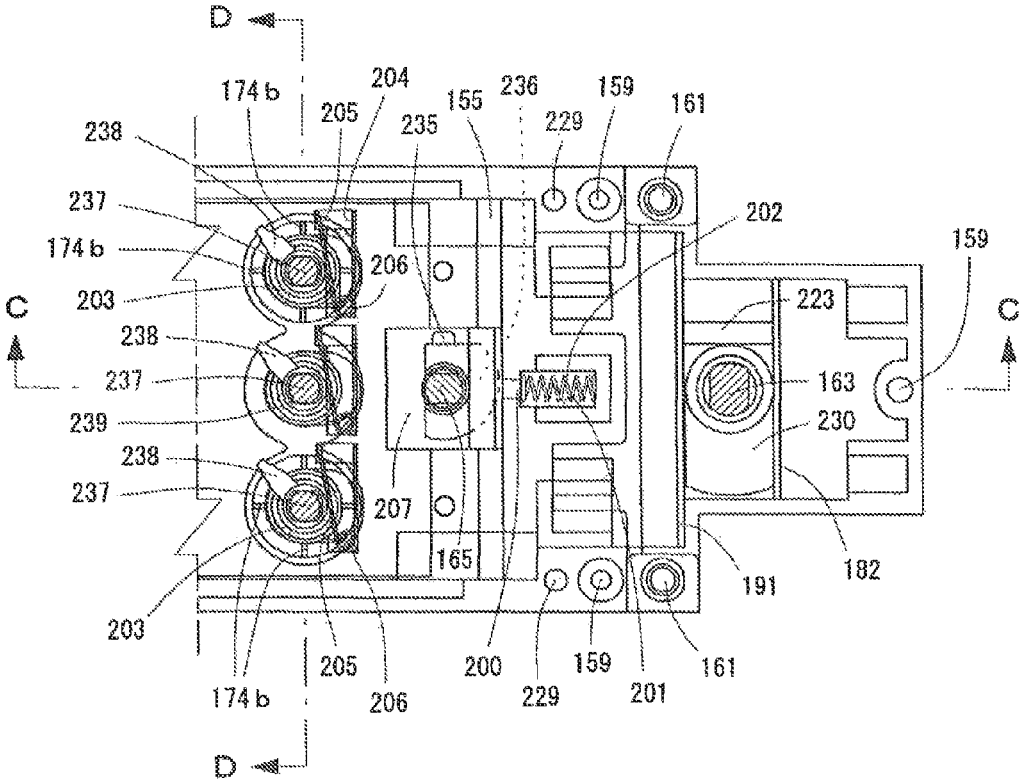
FIG. 27 is a plan view showing the principal part of an assembly of the security-code controller applied to the present invention and showing a state of the auto lock before the security code is set.
Figure 28:
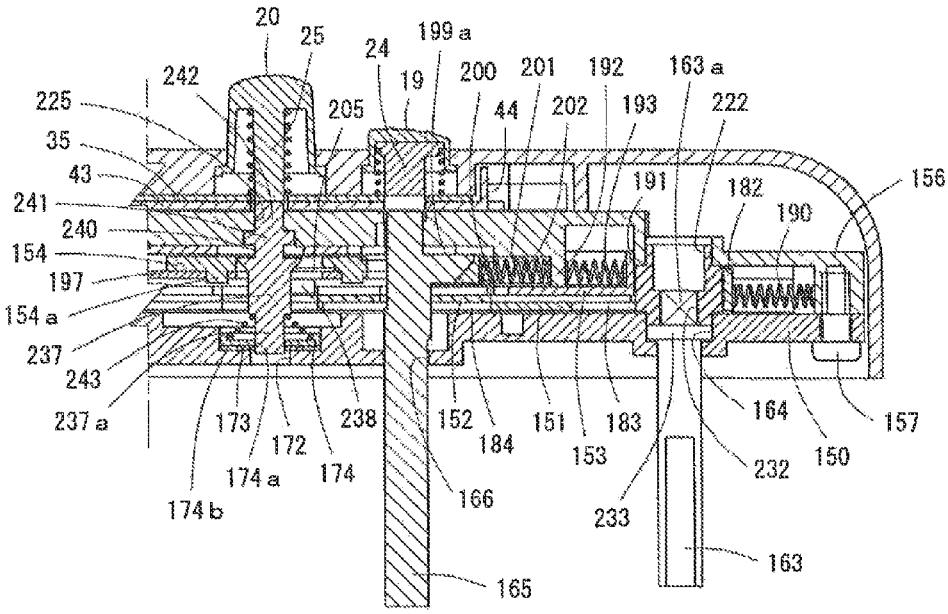
FIG. 28 is a cross section taken along line C-C in FIG. 27.

Further, the shaft head 242 of the lock pin 237 is inserted from the plate key hole 211 to the stepped hole 225 of the controller case 156. The first shaft key 240, which is the top end, intersects at the center of the plate key hole 211. The second shaft key 241 is arranged parallel to the plate key hole 211. Accordingly, the engagement pawl 238 is arranged in close proximity to the reset plate 154 and provided obliquely downward from the center of the plate key hole 211. This state is shown in FIGS. 27 and 28.

Next, the reset plate 154 into which the reset spring 205 is attached is placed on the lock plate 155. A shaft 200 is inserted in the concave portion 201 of the controller case 156 and the spring 202 is interposed therebetween to bias the reset plate 154 downwardly. The engagement pawl 238 is arranged on the periphery of the elongated hole 203. The protrusion 234, the head of the reset pin 165, is inserted in the opening 207 of the lock plate 155, and then inserted into the through hole 224 of the controller case 156 to appear from the outer surface of the case 156.

The tapered surface 236*a* of the reset pin 165 is provided to engage with the tapered surface of the reset plate 154. The legs 248 of the third slider 247 are inserted in the open window 250 of the reset plate 154, and the third slider 247 is disposed on the second slider 246. Thereafter, the memory reset plate 153 is disposed on the reset plate 154 and the reset pin 165 is inserted into the opening 194. The bent piece 191 is provided to engage with the upper wall of the protrusion 201. The spring 193 is inserted between the upper wall and the bent piece 191. The reset plate 153 is biased to move upwardly.

Figure 32:
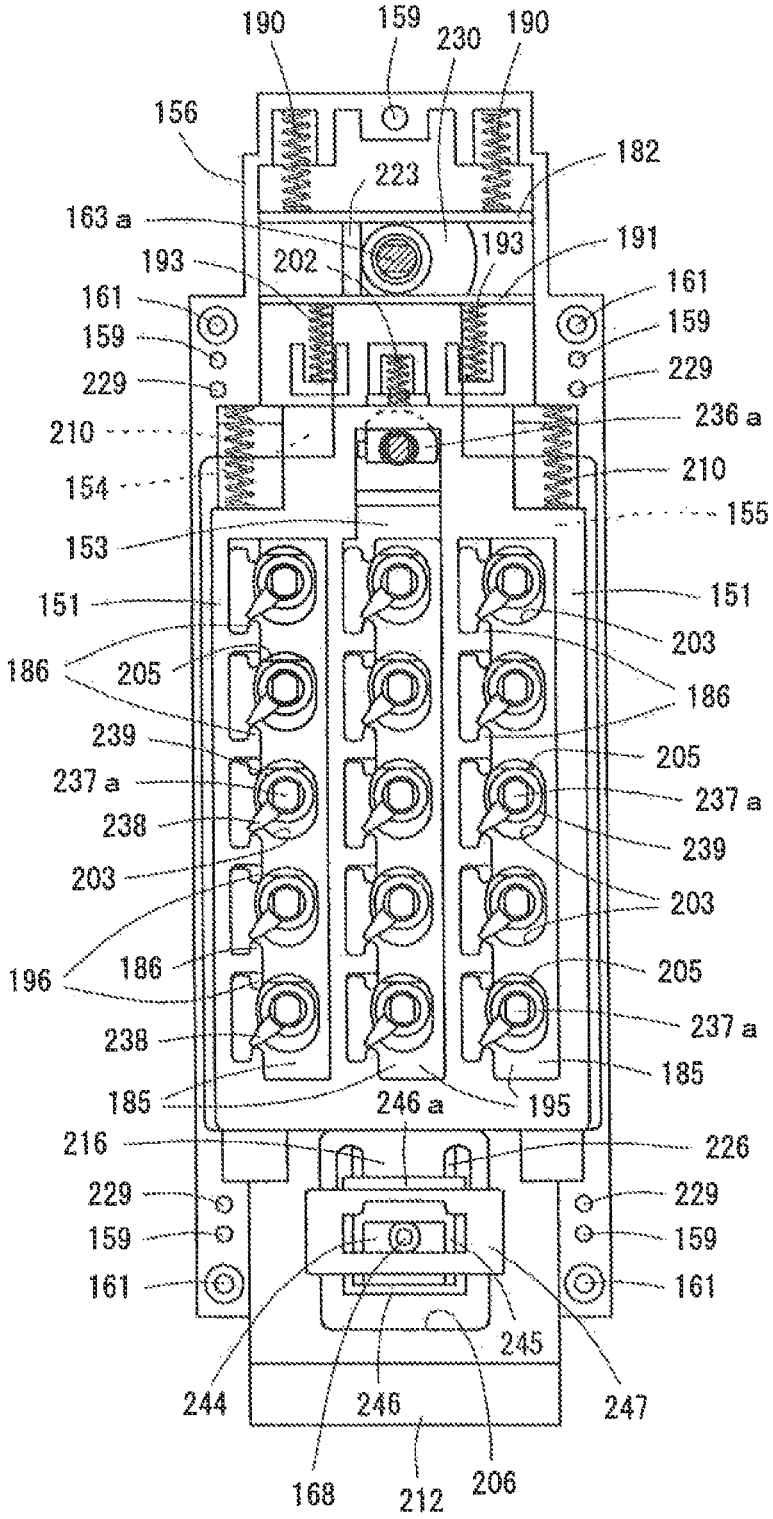
FIG. 32 is a plan view showing an assembly of the lock pin, the memory set plate, and memory reset plate of the security-code controller applied to the present invention and showing a state in which before the security code is set.

The memory change intermediate plate 152 is received on the memory reset plate 153 and the reset pin 165 is inserted into the opening 183. The shaft 231 of the memory change cam 230 is inserted in the cam hole 222 of the controller case 156. The memory change pin 163 is inserted in the square hole 232 and positioned at a neutral position, which means directing the memory change cam 230 to the right, as shown in FIG. 32.

Next, the memory set plate 151 is disposed on the memory change intermediate plate 152, and the memory change pin 163 is inserted into the opening 183. The reset pin 165 is inserted into the opening 184, and the bent piece 182 at the upper end is engaged with the upper surface of the memory change cam 230. The springs 190 interposed between the bent piece 182 and the concaved grooves on the upper end of the controller case 156. The memory set plate 151 is biased to move downwardly. Further, the memory change cam 230 is biased and positioned at the neutral position. This state is shown in FIG. 32.

Then, the controller cover 150 is put on the memory set plate 151. The memory change pin 163 is inserted into the stepped hole 164, and the protrusion 177 is provided to engage with the cutout portions 181 of the memory set plate 151. The enter pin 168 is inserted in the through hole 169 of the controller cover 150, and the concave grooves 179, 180 are put on the reset pin assembly.

Then, it should be checked that a set of assembly is properly carried out. In this case, for example, the assembling position of the lock pin 237, which is protruded from the memory set plate 151, should be checked. More specifically, the assembly can be judged to be appropriate when the cut portions on both surfaces are located on the right and left with respect to all the square shaft portions 237*a* of the lock pins 237 as shown in FIG. 32. Then, the smaller diameter side of the lock spring 243 is inserted in the square shaft portion 237*a*.

On the other hand, lubrication grease (not shown) is applied to the surface of the protrusion 173 in the washer hole 167 of the controller cover 150. The stop washer 174 is received on the grease and pressed to fit the square hole 174*a* to the square shaft portion 237*a* in the same direction. The engaging groove 174*b* on the back surface is engaged with the protrusion 173. The stop washer 174 is kept in the inner surface of the washer hole 167 of the stop washer 174 by the adhesive of the grease and engagement force.

Figure 13:
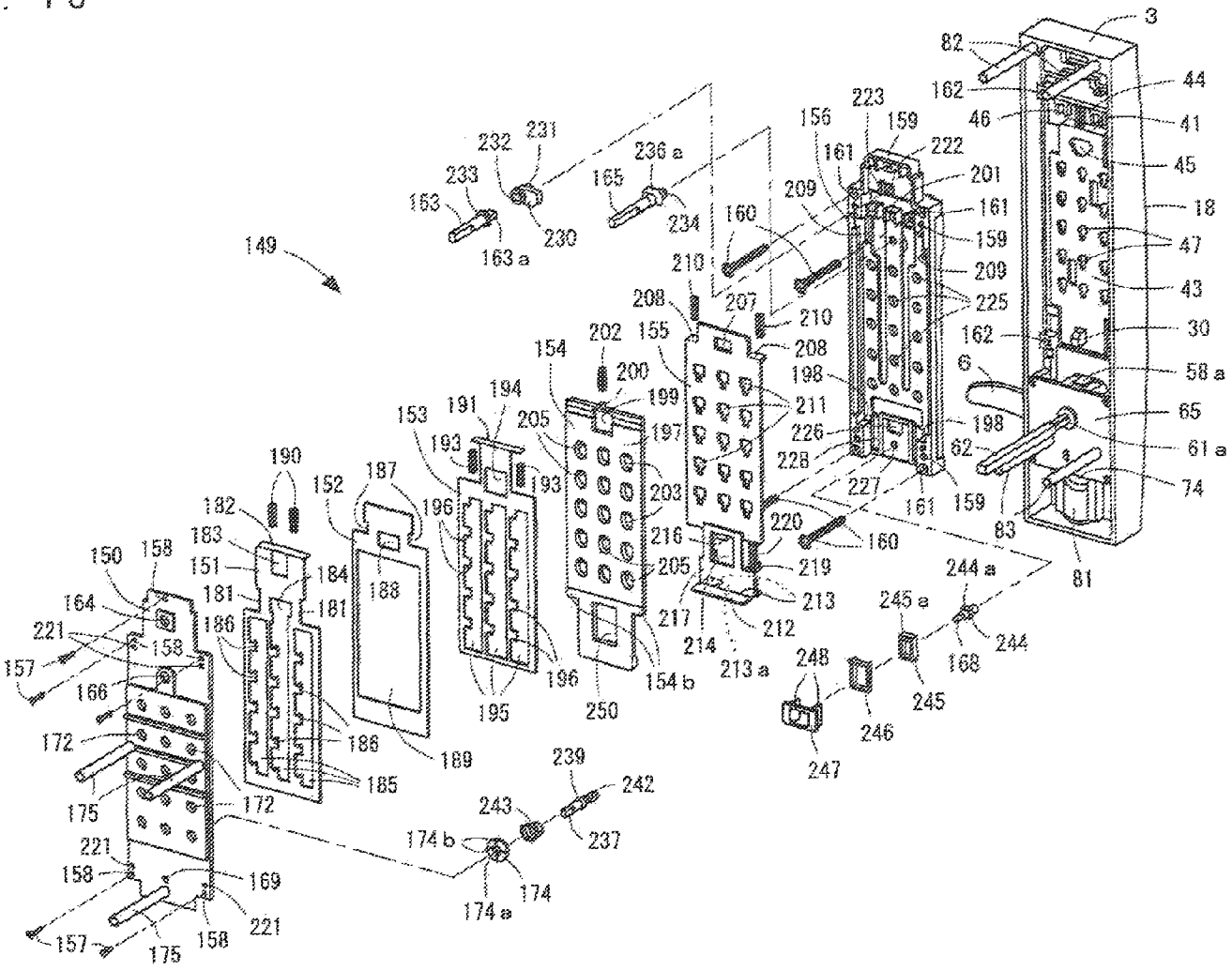
FIG. 13 is an exploded perspective view showing the exterior plate and the security-code controller applied to the present invention.
Figure 14:
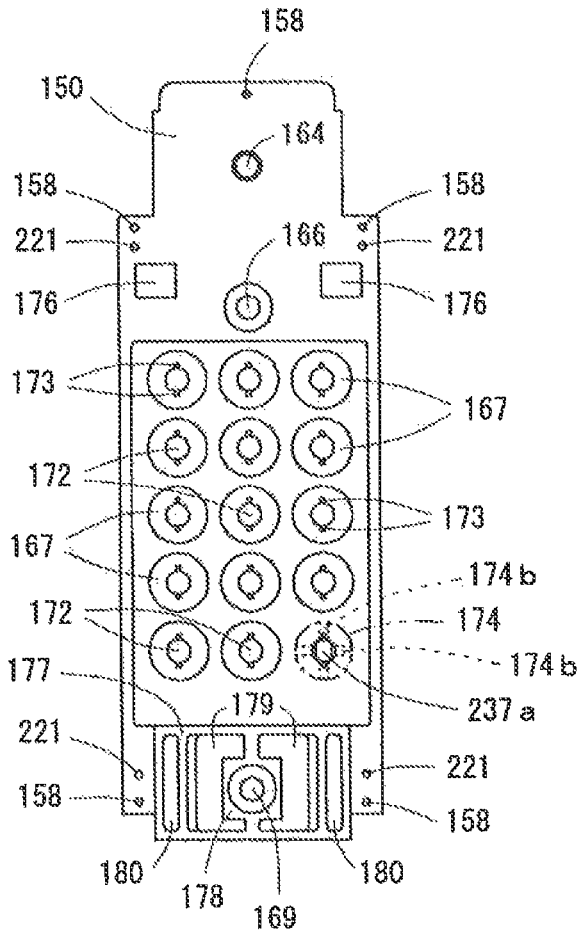
FIG. 14 is a hack view showing an example of the controller cover of the security-code controller applied to the present invention.
Figure 15:
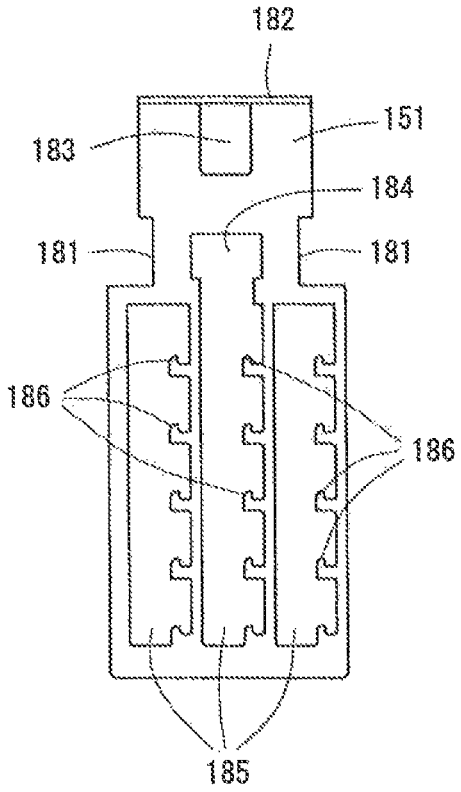
FIG. 15 is a back view showing an example of the memory set plate applied to the security-code controller of the present invention.
Figure 16:
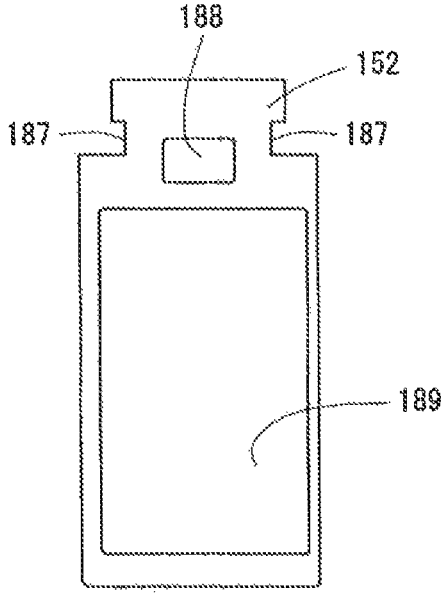
FIG. 16 is a hack view showing an example of the memory-change intermediate plate of the security-code controller applied to the present invention.
Figure 17:
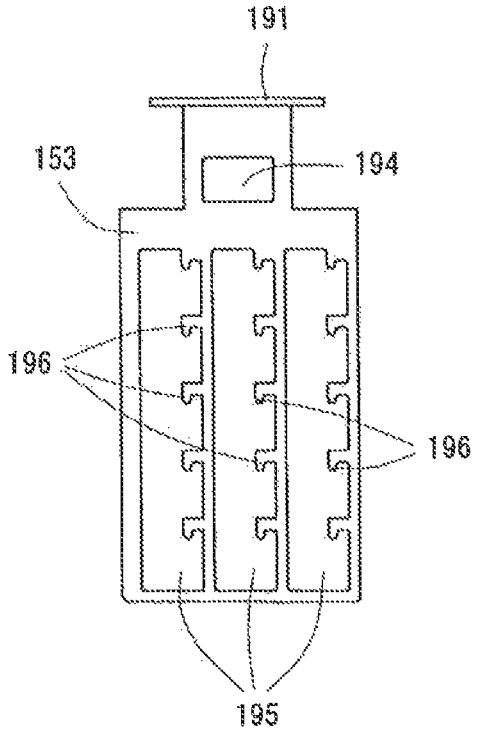
FIG. 17 is a back view showing an example of the memory reset plate of the security-code controller applied to the present invention.
Figure 18:
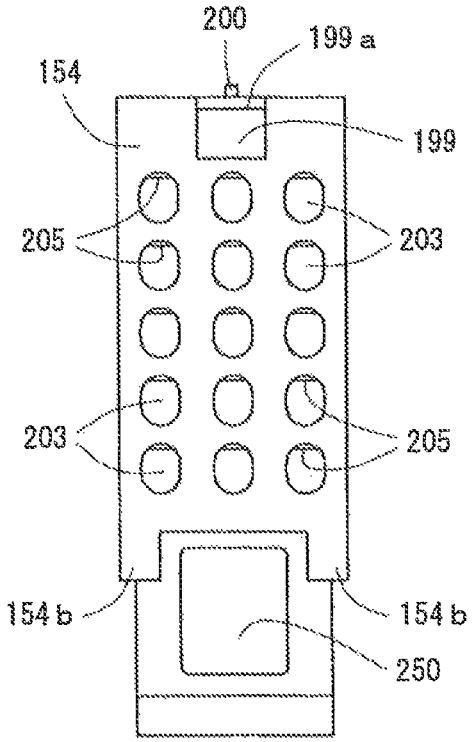
FIG. 18 is a back view showing an example of the reset plate of the security-code controller applied to the present invention.
Figure 19:
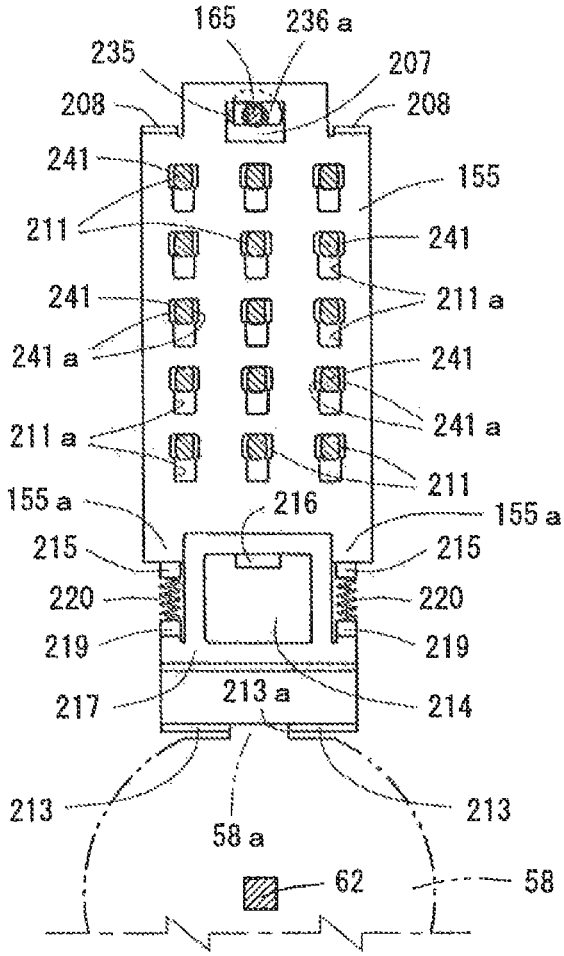
FIG. 19 shows an example of the lock plate applied to the security-code controller of the present invention.
Figure 19:
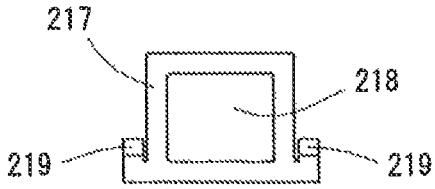
Figure 20:
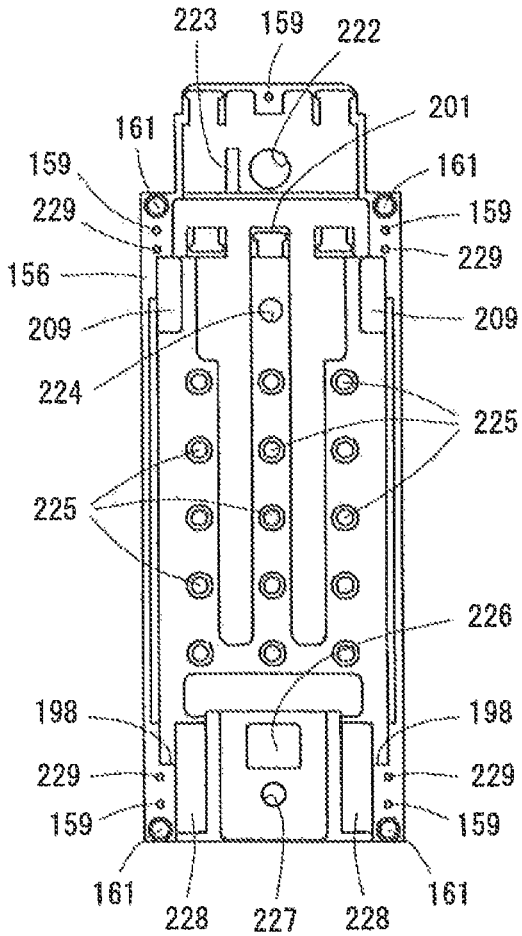
FIG. 20 is a back view showing an example of the reset plate of the security-code controller applied to the present invention.
Figure 21:
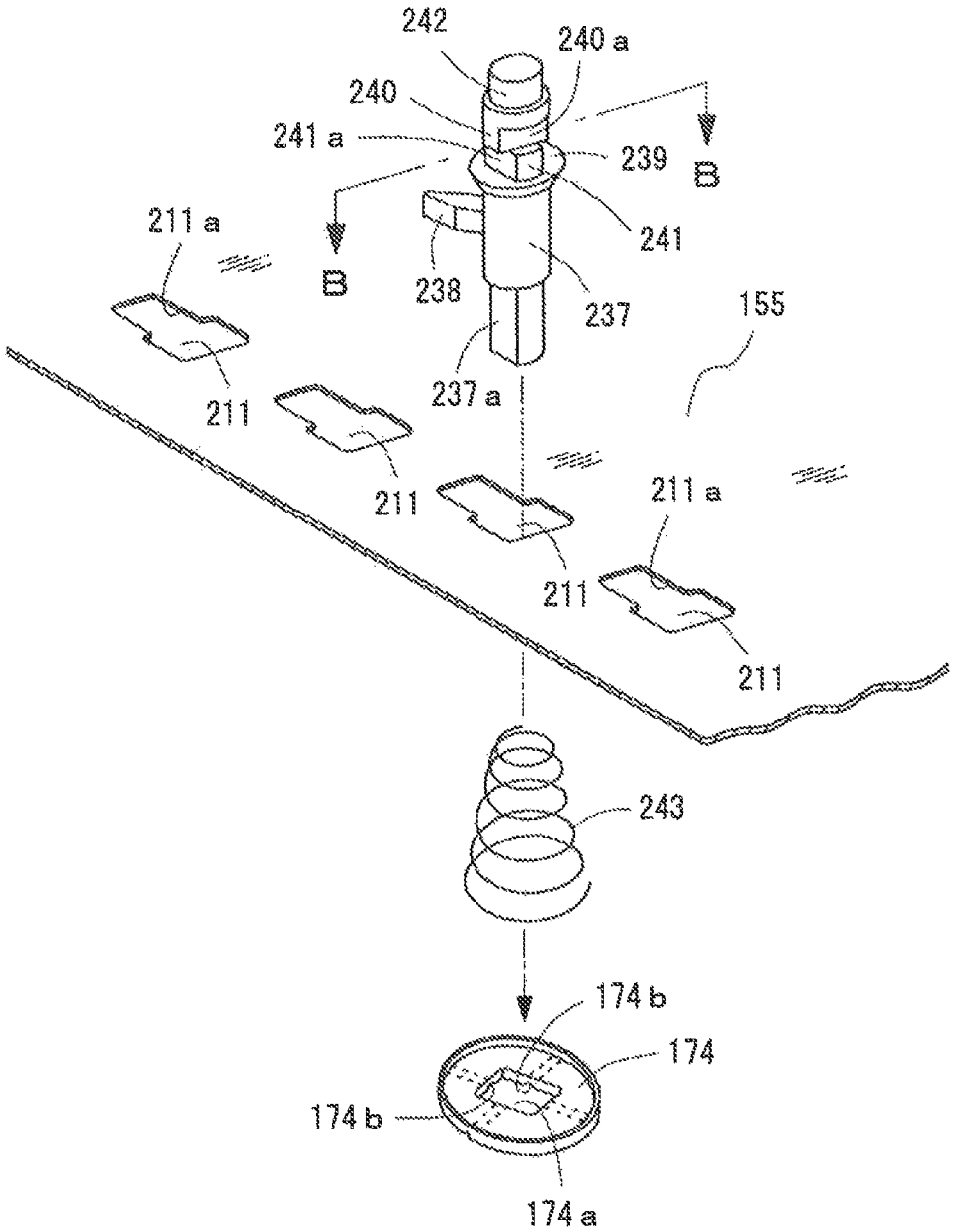
FIG. 21 is a perspective view showing an example of the lock pin of the security-code controller applied to the present invention and showing a relation between a lock spring and a stop washer.
Figure 22:
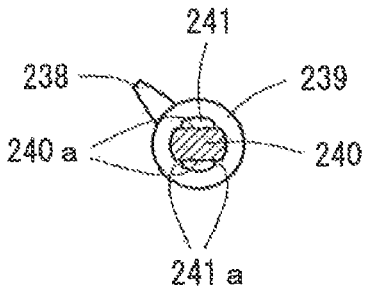
FIG. 22 is a cross section taken along line B-B in FIG. 21.

Then, the square hole 174*a* of the stop washer 174 is inserted in the square shaft portion 237*a* of the lock pin 237, and then the square shaft portion 237*a* is inserted in the through hole 172 of the controller cover ISO. Then, a plurality of pin holes 221 provided on the upper and lower ends of the controller cover 150 are fitted with a plurality of pins 229 protruded from the upper and the lower ends of the controller case 156. A plurality of screw holes 158 are positioned with the screw holes 159, the screws 157 are inserted in the screw holes 158 and screwed into the screw hole 159. Then, the controller cover 150 is closely attached and fixed to the opening edge of the controller case 156. This state is shown in FIG. 13.

Figure 8:
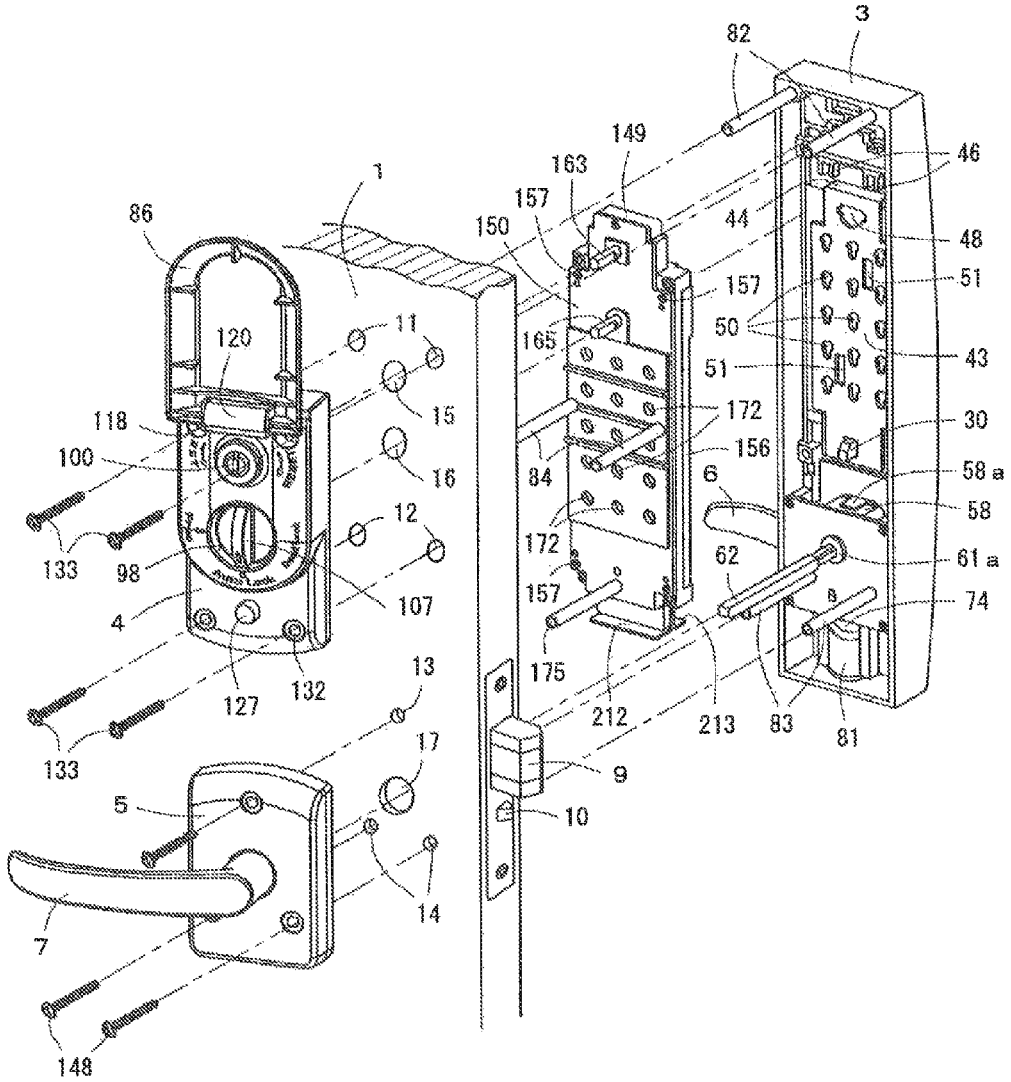
FIG. 8 is a perspective view showing the changeover plate, the handle-mounting plate, the exterior plate, and the security-code controller applied to the present invention, and they are provided separately.

The assembled security-code controller 149 is formed substantially in an oblong-box shape as shown in FIG. 8. The rigid security-code controller case 156 and the controller cover 150 are disposed outside the controller 149. The components are received inside and they are protected effectively. The security-code controller 149 is assembled while keeping its initial state, in which before entering of the security code, and then the controller 149 is assembled in the housing assembly. In this case, the controller case 156 is received in the housing 18. A plurality of screw holes 161 are positioned with a plurality of screw holes 162 of the housing 18. Screws 160 are inserted in the screw holes 161 and screwed tightly to the screw holes 162.

Next, in order to manufacture the changeover plate 4, the engaging shaft 92 is retained in the through hole 91 of the base plate 87 of the changeover plate body 85. Then, the cylinder lock 100 is inserted in the through hole 97 on the upper part of the projected portion 85*a*, and the nut 101 is screwed from the inside of the projected portion 85*a* to attach the cylinder. The changeover shaft 108 integral with the changeover knob 107 is inserted in the through hole 99 on the lower side of the projected portion 85*a*. The stopper 113, the spring 116, the washer 115 are inserted from inside of the projected portion 85*a*, and the retaining ring 114 is inserted in a rearward fitting groove to attach the head of the changeover knob 107.

Moreover, the deadlock button 127 is inserted in the through hole 126 from inside of the changeover plate body 85. The switching plate 128 is provided on the rearward step portion 125 via the spring 131. The leg portion 129 which is one end of the switching plate 128 is received on the step portion 125, while the other end of the spring 131 is engaged with the inner side of the stopper 113, and whereby the deadlock button 127 is depressible. Then, the changeover plate 85 in the process of the assembly is provided on the front surface of the base plate 87. The square shaft portion 104 of the cylinder 103 is engaged with the square hole 105 of the engaging shaft 92 and the spring 106 is interposed therebetween. A support pipe (not shown) is provided between the changeover plate 85 and the base plate 87. The changeover plate 85 and the base plate 87 are connected together by screwing a screw from the outside of the pipe.

Figure 29:
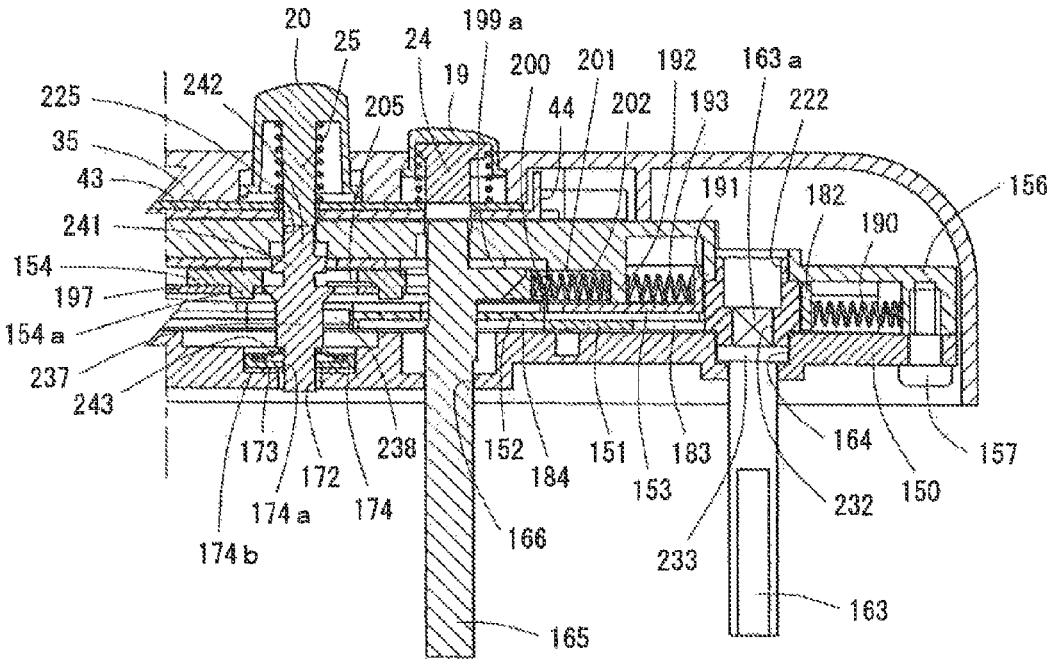
FIG. 29 is a cross section taken alone line C-C in FIG. 27 and showing a state when the security code is set.

Thereafter, a pair of pivots 122, 122 of the cover 86 is engaged with the hinge cams 123, and the spring 124 is interposed between the cams 123. After they are integrally assembled, the assembly of the pivot 122 is provided on the front surface of the projection 119 together with the cover 86, and the hinge case 120 is pressed inwardly to fit the protrusion 119. The cover 86 is attached to the top end of the changeover plate body 85 and rotatable up and down. This state is shown in FIG. 29.

Figure 9:
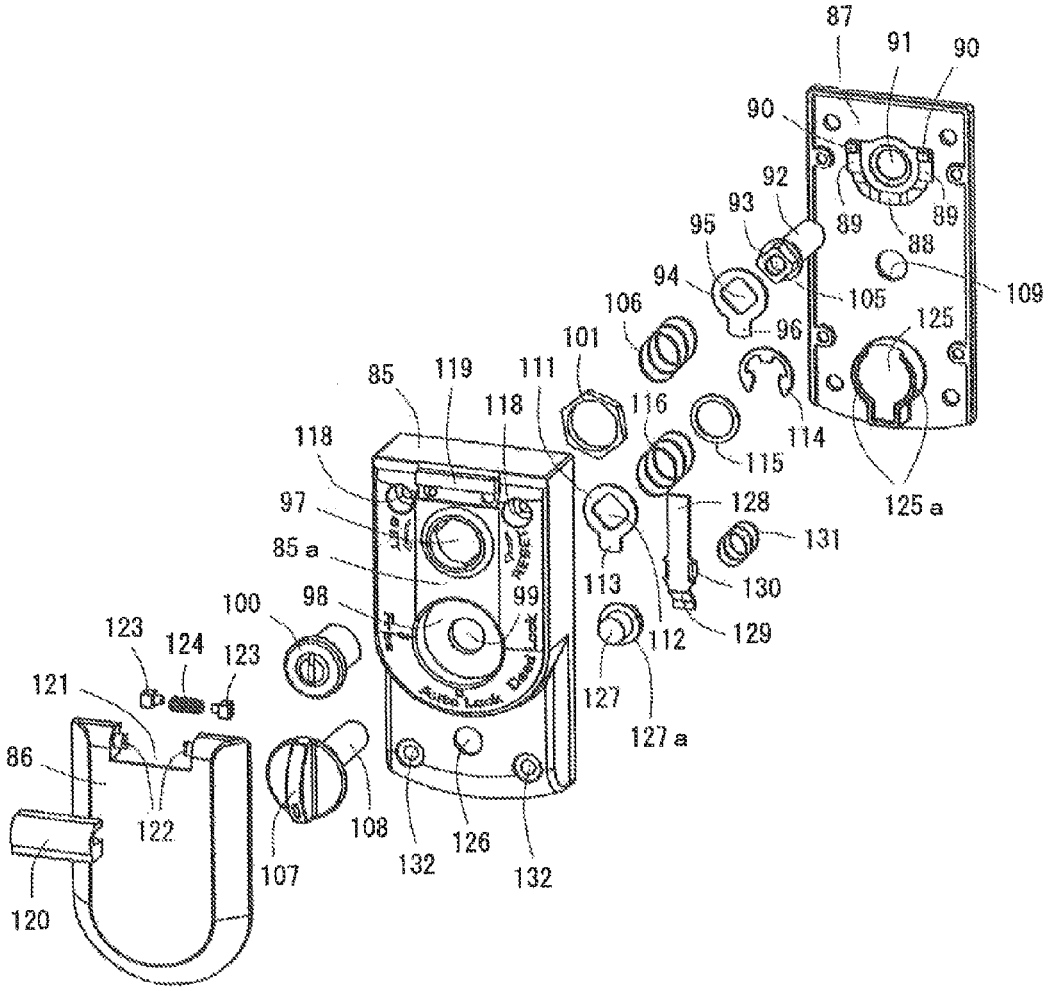
FIG. 9 is an exploded perspective view showing the changeover plate applied to the present invention.

The handle-mounting plate 5 is formed by zinc alloy die-casting. The square shaft portion 7*a* of the lever handle 7 is inserted from the outside of the through hole 134, and the washer 136 and the retaining ring 137 are attached to the square shaft portion 7*a* to prevent falling out. On the other hand, the spring bearing 141 is attached to the back surface of the back plate 139 via the torsion spring 146. The back plate 139 is fixed to the center of the concave surface on the handle-mounting plate 5 by screwing. This state is shown in FIG. 9.

The exterior plate 3, the changeover plate 4, the handle-mounting plate 5, thus manufactured, are installed to the door 1 in the following manner. A fixing hole (not shown) having a rectangular shape is formed on the middle to high position of the edge of the door 1, the deadbolt lock 8 is received in the fixing hole, and the deadbolt 9 and the latch trigger 10 are extendable from the edge the door 1. The pipe insertion holes 11, 12, 13, 14, the through holes 15, 16, and the rod insertion hole 17 are formed on the predetermined positions of the door 1, and the connecting pipes 82, 83, 84 of the exterior plate 3 are inserted in the pipe insertion holes 11, 12, 13, 14 from the outside of the door 1.

The engaging shaft 92 and the changeover shaft 108 of the changeover plate 4 are inserted in the through holes 15, 16 from the inside of the door 1. The memory change pin 163 assembled to the exterior plate 3 is engaged with the square hole 92*a* of the engaging shaft 92 from the outside of the door 1. The reset pin 165 assembled to the exterior plate 3 is engaged with the square hole 110 of the changeover shaft 108. The screws 133 are screwed into the connecting pipes 82, 84 from the outside of the changeover plate 4, and then the changeover plate 4 is attached to the inside of the door 1.

Figure 7:
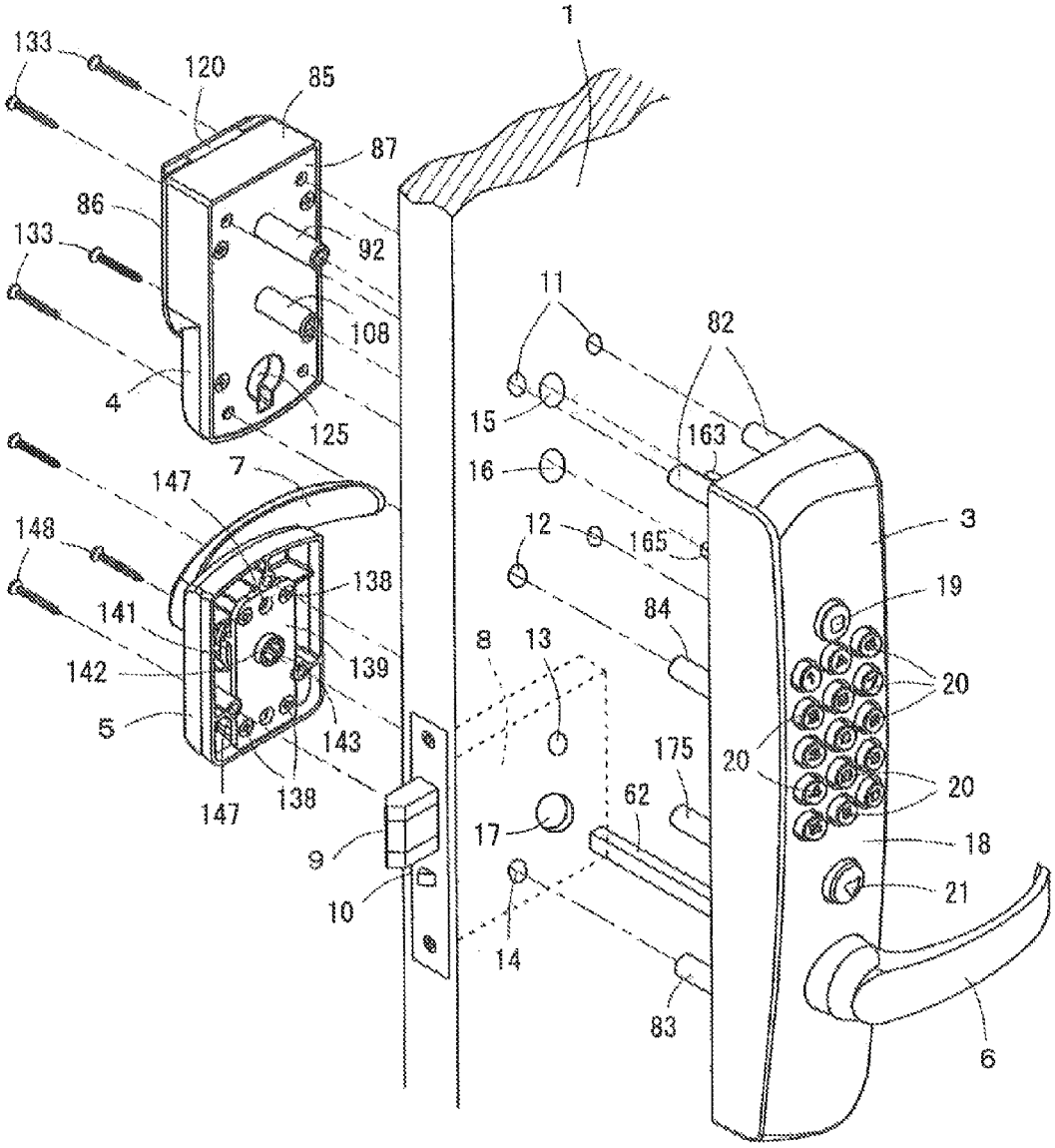
FIG. 7 is an exploded perspective view showing the exterior plate, the changeover plate, and the handle-mounting plate applied to the present invention.
Figure 10:
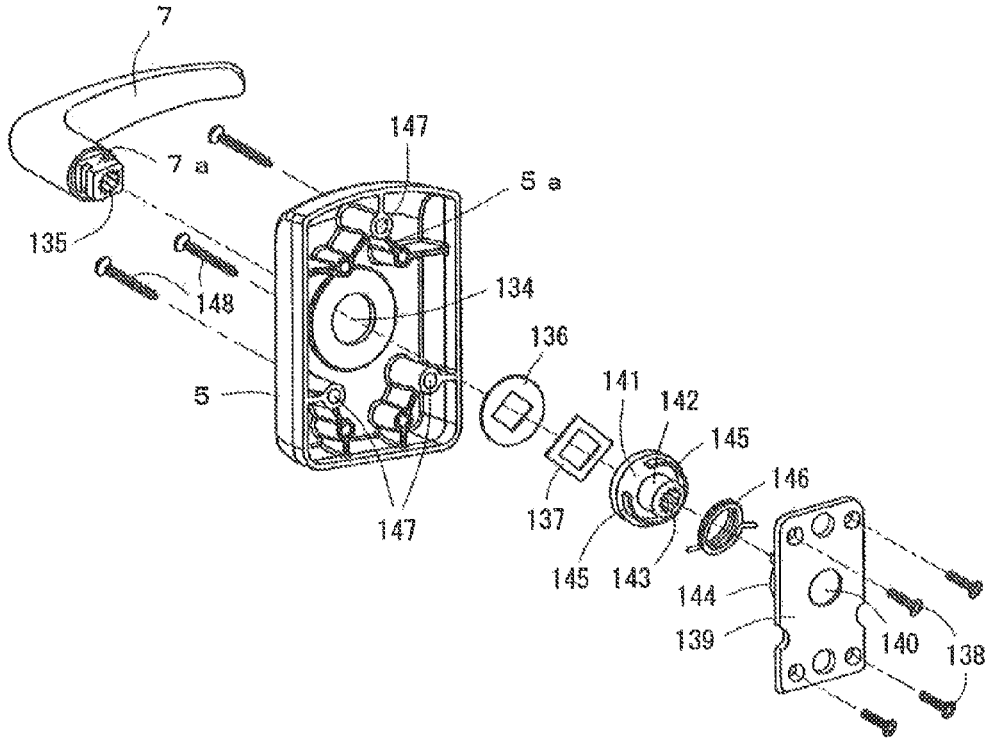
FIG. 10 is an exploded perspective view showing the handle-mounting plate applied to the present invention.
Figure 11:
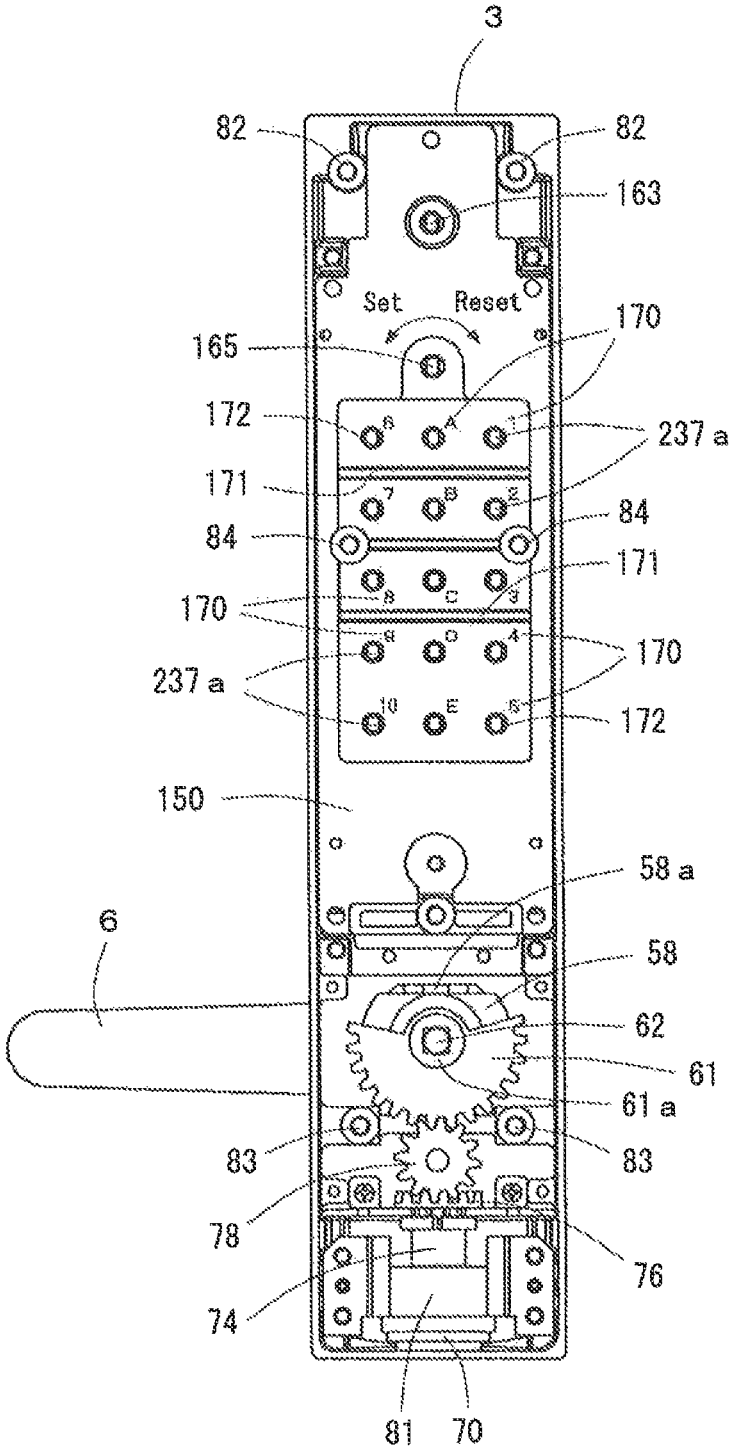
FIG. 11 is a hack view of the exterior plate applied to the present invention, with the back cover detached.

On the other hand, the screw 148 is screwed into the connecting pipe 83 from the outside of the handle-mounting plate 5. The connecting pipe 175 is inserted in the pipe insertion hole 13 of the exterior plate 3. A screw 148 is screwed into the connecting pipe 175 from the outside of the handle-mounting plate 5. Further, the square rod 62 assembled to the exterior plate 3 is inserted in the rod insertion hole 17, and then attached to engage with the engaging teeth 143 of the handle-mounting plate 5. This state is shown in FIGS. 7, 8, and 10.

FIGS. 1 to 5 show the changeover plate 4, the handle-mounting plate 5, and the exterior plate 3 attached to the inner and outer surface of the door 1 in the above-described manner. The exterior plate 3 has a vertically rectangular front surface. The side surfaces are gently curved and have convex surfaces, and a plurality of push buttons 20 having an oval shape are obliquely attached to the middle part and are arranged in rows and columns. The lower part of the push button 20 is increased in height and provides an aesthetically pleasing configuration with a simple structure and gradations. The changeover plate 4 and the handle-mounting plate 5 are provided separately on the upper and lower parts of the interior surface of the door 1 so that the structure is made simpler and more compact compared with the integrated structure. As a result, the appearance of the door 1 is simplified, a weight load on the door 1 is reduced, and the load on the hinge is reduced.

The exterior plate 3 mounted on the door 1, with the security code unset, the reset button 19 and the push buttons 20 and the enter button 21 are biased to protrude outwardly by the springs 28, 29, 33 inside, and the lever handle 6 is held stationary in a horizontal position. This state is shown in FIGS. 1 to 5. The button presser plate 35 is screwed to the inner surface of the housing 18, and the button shafts 24, 25 move in and out of the holes on the plate. The tamper-proof plate 43 is laminated on the plate 35, and is biased downwardly via the spring 47. The square hole 49 on the lower end is provided to engage with the tapered portion 30*a* of the dog 30.

Accordingly, pressing of the enter button 21 moves the tamper-proof plate 43 upwardly against the spring 47, the elongated holes 50 are moved simultaneously. Then, the part of or the whole area of the through holes 38 of the button presser plate 35 is closed. Then, pressing of the push button 20 and movement of the button shaft are limited. The combined operation of the enter button 21 and the push button 20 prevents incorrect operation for knowing whether a code has been entered to the lock pin 237.

The security-code controller 149 is provided inside the housing 18 and one side of the controller 149 is adjacent to the tamper-proof plate 43, and the other side is adjacent to the outer surface of the door 1. The controller cover 150 and the controller case 156 are disposed on the outer side of the security-code controller 149. The memory set plate 151, the memory change intermediate plate 152, the memory reset plate 153, the reset plate 154, and the lock plate 155 are laminated in the security-code controller 149. Each plate except for the memory change intermediate plate 152 is provided to move up and down slidably via springs 190, 193, 202, 210.

The memory change pin 163 on the upper end of the security-code controller 149 is engaged with the engaging shaft 92, one end of which is inserted in the door 1, and the other end of which is engaged with the memory change cam 230. When the changeover plate 4 is set to the neutral position between set and reset, the memory change cam 230 is positioned laterally, i.e., horizontally, as shown in FIG. 32.

The reset pin 165 is provided coaxially with the reset button 19. One end of the pin 165 is engaged with the square hole 110 of the changeover shaft 108. The other end is rotatably inserted in the through hole 224 on the controller case 156. The protrusion 234, which is the top end, is engageable with the concave groove 27 of the reset-button shaft 24. The engagement piece 236 of the reset pin 165 is rotatably provided on the rim of the opening 207 of the lock plate 155 and engageable with each other. By rotational operation of the changeover knob 107, the protrusion 235 is engageable with the rim and the cutout groove 207*a* of the opening 207. Thus, displacement of the upward movement of the lock plate 155 is limited, and the lock can be switched to the auto lock, latch, or deadlock. Moreover, the set position is maintainable.

The enter pin 168 is provided coaxially with the enter button 21. One end of the enter pin 168 is rotatably inserted in the through hole 224 of the controller case 156. The other end is provided to engage with the dog 30 of the enter button 21. The tapered surface 244*a* of the flange 244 is engageable with the tapered surface 245*a* of the first slider 245.

Figure 5:
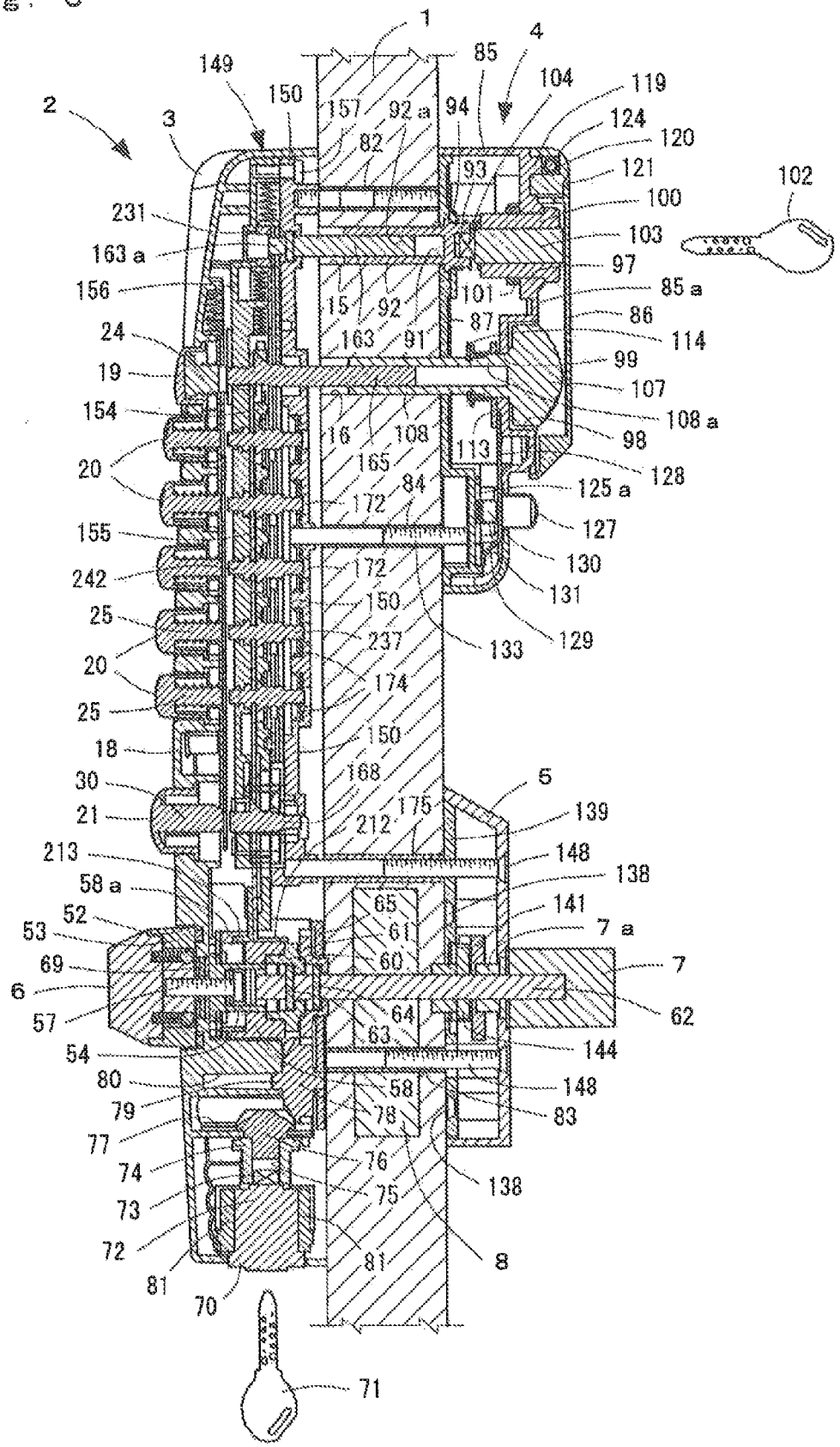
FIG. 5 is an enlarged cross section taken along line A-A in FIG. 1.
Figure 6:
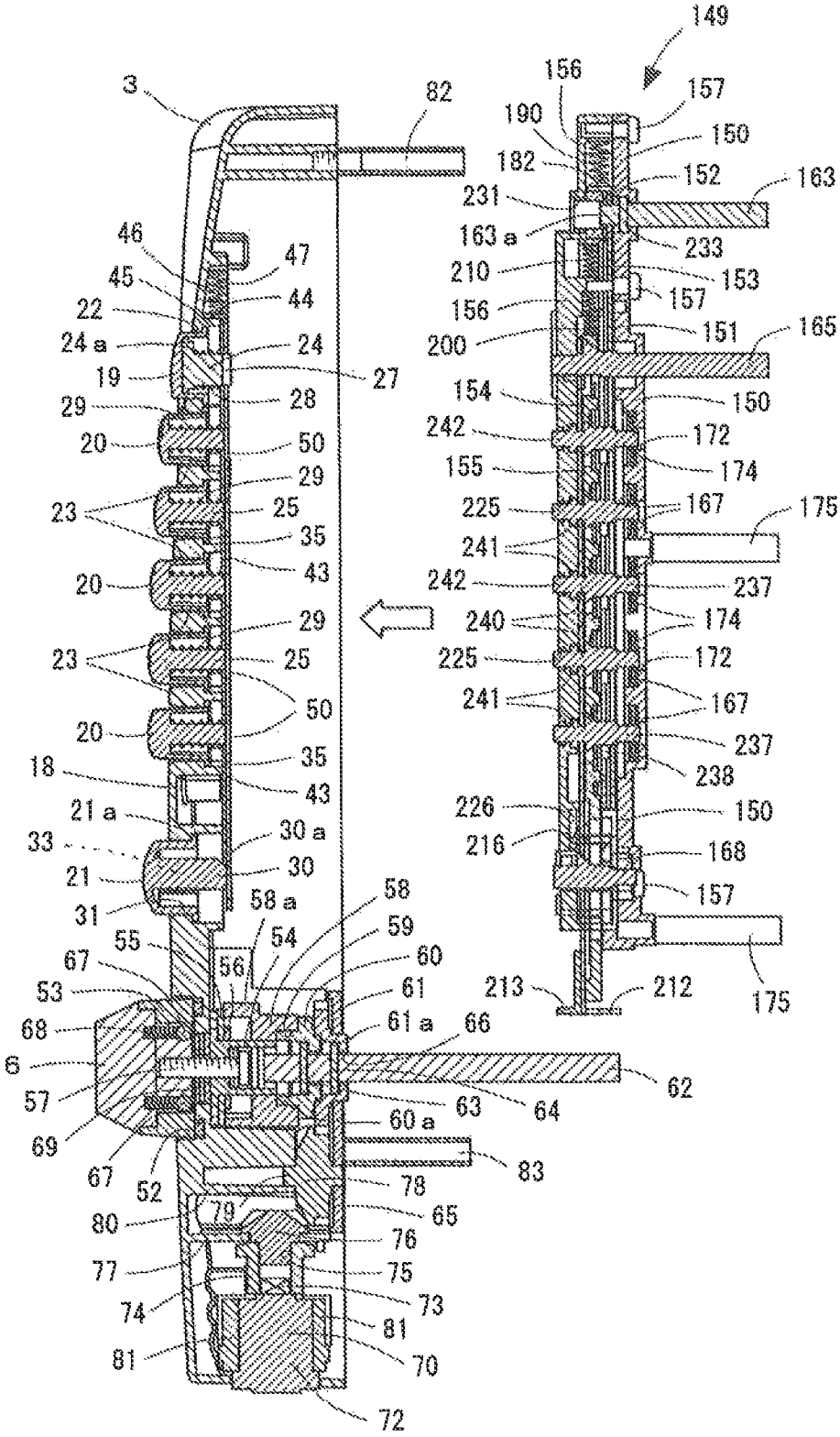
FIG. 6 is a cross section showing both the exterior plate and the security-code controller applied to the present invention and they are provided separately.

Between the square hole 174*a* of the controller cover 150 and the stepped hole 225 of the controller case 156, the lock pin 237 is disposed to pass through the laminated components 151 to 155 and rotatable and movable in the axial direction. One end, the square shaft portion 237*a*, is engaged with the square hole 174*a* of the stop washer 174. The other end, the shaft head 242, is provided on the outer side of the stepped hole 225 and the end surface is provided to engage with the push button shaft 25. The first shaft key 240 is rotatably received inside the stepped hole 225. This state is shown in FIG. 5.

One end of the lock pin 237 is biased and movable to the side of the push button 20 by the lock spring 243 received in the stop washer 174. The free end of the reset spring 205 is positioned on the smaller diameter side of the cone flange 239. Then, the lock pin 237 is pressed inwardly when the push button 20 is pressed, the larger diameter side of the cone flange 239 is engaged with the reset spring 205, and thereby maintaining the lock pin 237 at the depressed position.

The depressed lock pin 237 is returnable to its original position by pressing of the reset pin 19, which moves the reset plate 154 and retracts the reset spring 205 from the cone flange 239, and thereby releasing the engagement.

The engagement pawl 238 is protruded from the middle part of the lock pin 237. The engagement pawl 238 is provided to engage with the movement area of dogs 186, 196 of the memory set plate 151 and the memory reset plate 153. The engagement enables the lock pin 237 to rotate forwardly and reversely and the rotational position is maintainable by the stop washer 174. The memory set plate 151 and the memory reset plate 153 is moved up and down by forward and reverse rotation of the memory change cam 230. Operation of the memory change cam 230 interacts with rotation of the engaging shaft 92 by key operation of the cylinder lock 100 and with rotation of the memory change pin 163.

The memory set plate 151 is moved upwardly by key operation of the cylinder lock 100 and by rotation of the memory change cam 230 when setting the security code. The lock pin 237 is rotated 90 degrees engaging the dog 186 with the engagement pawl 238, and the rotational position is maintainable by the stop washer 174. The memory reset plate 153 is moved downwardly by key operation of the cylinder lock 100 and by the reverse rotation of the memory change cam 230 when releasing the security code. The lock pin 237 is rotated 90 degrees in the reverse direction engaging the dog 196 with the engagement pawl 238, and the rotational position is maintainable by the stop washer 174.

The stop washer 174 is rotatably received in the washer hole 167. The washer 174 is pressed into contact with the bottom of the washer hole 167 via the lock spring 243. The engaging groove 174*b* having a cross shape formed on the bottom surface is engageable with the protrusion 173 formed on the bottom of the washer hole 167. Then, when the security code is set, released, or altered, the stop washer 174 rotates on the bottom of the washer hole 167 and moves simultaneously with the rotation of the lock pin 237. The rotational position of the lock pin 237 is maintainable by engaging the engaging groove 174*b* with the protrusion 173.

The cover 86 of the changeover plate 4 fitted to the door 1 is normally closed and the cylinder lock 100 is maintained at the neutral position between the set and reset position. The memory change pin 163 is maintained at the neutral position via the engaging shaft 92 engaged with the cylinder lock 100, and the memory change cam 230 is positioned at the neutral position. The changeover knob 107 is positioned at the auto lock position. The reset pin 165 engaged with the changeover shaft 108 is positioned as shown in FIG. 25 when observed from the side of the exterior plate 3. Moreover, the deadlock button 127 is normally off and protrudes outwardly from the changeover plate 4, and the changeover knob 107 is positioned at the auto-lock position.

The handle-mounting plate 5 is fitted inside the door 1, and the lever handle 7 is interconnected with both the square rod 62 and the lever handle 6 on the exterior side via the deadbolt lock 8. In the auto lock state and before the security code is set, the lock plate 155 in the exterior plate 3 is moved down by the springs 210. The cutout portion 213*a* of the bent piece 213 on the bottom is engaged with the convex portion 58*a* of the driving cam 58, and whereby the lock is unlocked. Then, the lock is unlocked by pressing the security code with the push button 20 and pressing the enter button 21.

Under these circumstances, in order to set the security code to the push button lock, the reset button 19 of the exterior plate 3 is pressed from the outside to reset the lock while the door 1 is open. When the reset button 19 is pressed, the reset-button shaft 24 is pushed in the housing 18 against the reset-button spring 28, engaging with the end of the reset pin 165. Then, the reset pin 165 is pushed inwardly. Thus, the tapered engagement surface 236*a* of the reset pin 165 is pressed against the tapered surface 199*a* of the reset plate 154 and is engaged with each other. The reset plate 154 is moved up against the spring 202.

Figure 30:
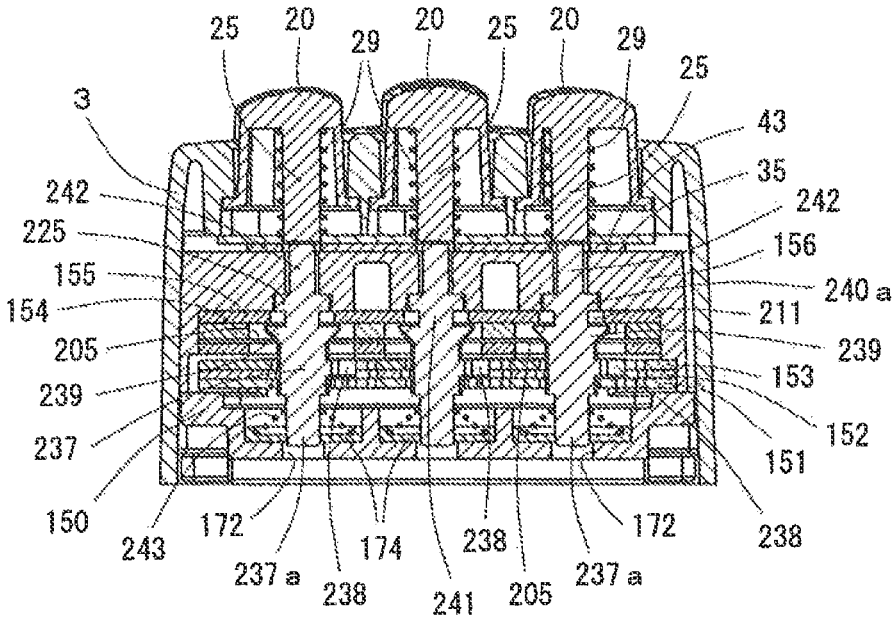
FIG. 30 is a cross section taken along line D-D in FIG. 27.

As a result, the reset spring 205 fitted inside is moved simultaneously with the reset plate 154. The reset spring 205 is moved apart from the lock pin 237 located in the elongated hole 203 and then the engagement is released. Then, the lock pin 237 is pushed back by the lock spring 243 and returned to its original position. Some push buttons 20 are pressed down erroneously or by tampering before the security code is set. The reset operation clears the depressed lock pin 237 and returns it to its initial state. This state is shown in FIGS. 27, 28, and 30.

When resetting the lock, as shown in FIG. 34(*a*), the second shaft key 241 is located in the plate key hole 211 of the lock plate 155 and the abutment surface 241*a* is located in parallel with the plate lock hole 211*a* so that the lock plate 155 is movable. Then, when the reset button 19 is released, the button 19 is pushed back by the reset-button spring 28. The engagement surface 236*a* is moved apart from the tapered surface 199*a* and the pressure is released. Then, the reset plate 154 is returned to its original position by the spring 202.

Thereafter, the security code is set by pressing the desired security code with the push button 20. For example, when the security code is 1A6, three corresponding push buttons 20 are pressed. In this case, the push buttons 20 may be pressed in any order. The push button 20 is pressed in the housing 18 against the push button spring 29, passing through the through hole 38 of the button presser plate 35 and the elongated hole 50 of the tamper-proof plate 43. Then, the push button 20 is engaged with the end surface of the shaft head 242 of the lock pin 237, and the pin 237 is pushed inwardly against the lock spring 243. Then, when the push button 20 is released, the push button 20 is pushed back by the push button spring 29. In this case, the push button 20 that have not been selected for the security code will not be pressed, and the initial state, after the assembly, is maintained.

Figure 31:
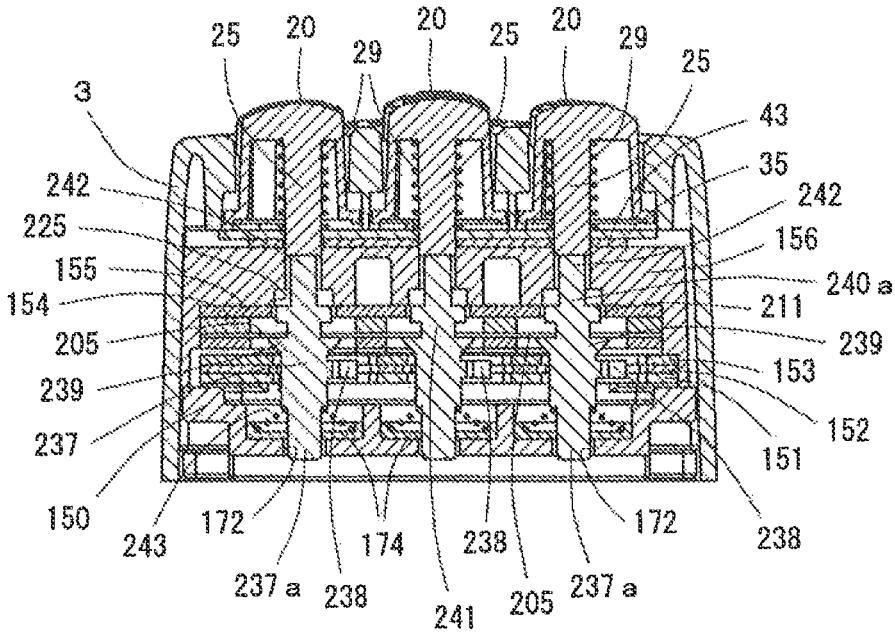
FIG. 31 is a cross section taken along line D-D in FIG. 27 and showing a state when the security code is set.

This state is shown in FIGS. 29 and 31. When the push button 20 is pressed, the lock pin 237 immediately below is engaged with the push button 20 and moved in the same direction. The cone flange 239 is pressed inwardly, pushing the reset spring 205 away. Then, the reset spring 205 is moved to immediately above the cone flange 239 and is engaged with the cone flange 239, and the depressed position of the lock pin 237 is maintained.

In this case, the engagement pawl 238 is positioned over the memory set plate 151 and the memory reset plate 153. The square shaft portion 237*a*, which is the end portion, is projected from the through hole 172 of the controller cover 150.

This state is shown in FIG. 34(*b*). The first shaft key 240 is moved to the plate key hole 211. The abutment surface 240*a* is positioned to the opening edge of the plate lock hole 211*a*, and they are engageable with each other.

While maintaining the lock pin 237 at the depressed position, the cover 86 of the changeover plate 4 is opened to insert the key 102 in the key hole of the cylinder lock 100, and the cylinder 103 is turned 90 degrees in the set direction. Then, rotational displacement of the cylinder 103 is transmitted to the engagement shaft 92 via the square shaft portion 104, which is the end portion. Then, the memory change cam 230 engaged with the change pin 163 is moved simultaneously via the memory change pin 163 engaged with the square hole 92*a* of the engagement shaft 92.

That is to say, the memory change pin 163 is rotated 90 degrees in a counterclockwise direction in FIG. 28. The memory change cam 230 engaged with the pin 163 is moved simultaneously, pressing the bent piece 182 which is engaged with the change cam 230, and whereby the memory set plate 151 integral with the bent piece 182 is moved upward against the spring 190. Then, the dog 186 formed on the memory set plate 151 is engaged with the engagement pawl 238 of the depressed lock pin 237, and the lock pin 237 is rotated 90 degrees in a clockwise direction in FIG. 28.

Figure 33:
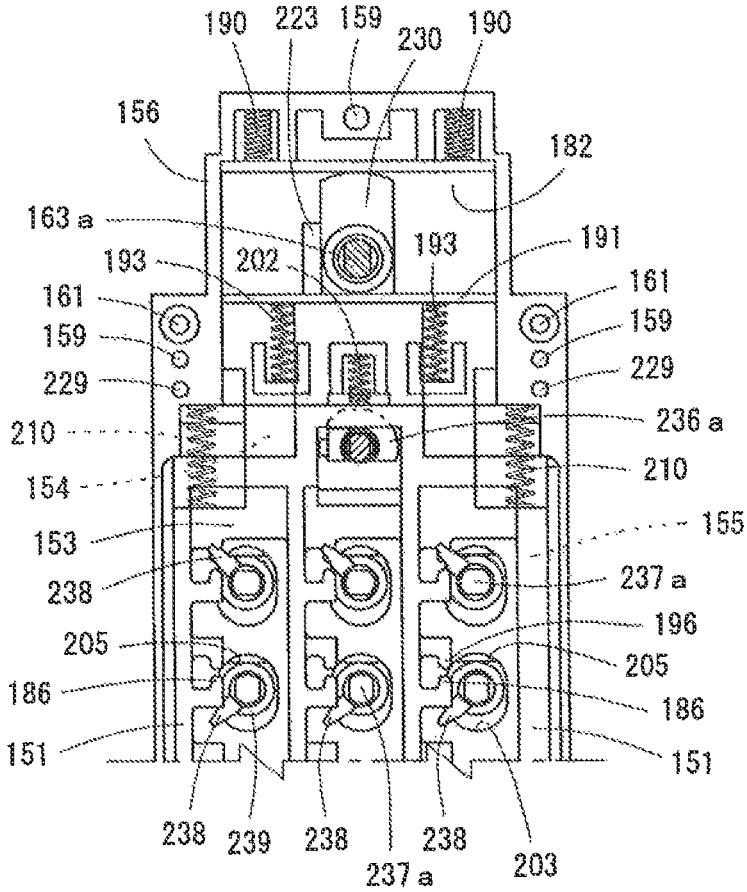
FIG. 33 is a plan view of the principal part of the security-code controller applied to the present invention and showing a state in which the security code is set.

This state is shown in FIG. 33. The engagement pawl 238 of the depressed lock pin 237 is positioned obliquely upward in FIG. 33. The first shaft key 240 is rotated 90 degrees and the abutment surface 240*a* is positioned parallel with the plate lock hole 211*a*, and whereby the lock plate 155 is movable. This state is shown in FIG. 34(*c*).

Rotation of the lock pin 237 will rotate the stop washer 174 fitted with the square shaft portion 237*a* on the washer hole 167. When the stop washer 174 is rotated to the same angle with the lock pin 237, the engaging groove 174*b* on the back surface is engaged with the adjacent protrusion 173 and becomes stationary by the pressure force of the lock spring 243. The rotational position of the lock pin 237 and the engagement pawl 238 is maintained.

After the cylinder 103 is rotated with the key 102, the cylinder 103 is rotated 90 degrees in the reverse direction. The key 102 is taken out when the cylinder 103 is returned to its original position. Thus, as described above, the memory change cam 230 is moved simultaneously with the rotational displacement of the cylinder 103, and the memory set plate 151 is pushed downward by the spring 190 and returned to the original position.

Thereafter, the reset button 19 on the exterior plate 3 is pressed from outside of the door 1 to reset the lock in the same manner as described above. The reset plate 154 is moved upward against the spring 202, the reset spring 205 is moved apart from the lock pin 237. Thus, the engagement of the reset spring 205 is released and the lock pin 237 is pushed back. Thus, the second shaft key 241 is moved to the plate key hole 211 of the lock plate 155.

The abutment surface 241*a* is engageable with the opening edge of the plate lock hole 211*a*. This state is shown in FIG. 34(*d*). Accordingly, the locked state is formed by the lock pins 237 of the push buttons 20 in which the security code is set. Thus, increased security is obtained by increasing the number of digits for the security code and by increasing the number of the lock pin 237 that functions practically.

After the security code is set in a manner as described above, it is preferable to check the setting. In this case, unlock the auto lock with the door opened in a manner as described later, and check the setting is proper by checking whether the lock is unlocked. More specifically, in order to unlock the lock, the reset button 19 is pressed from outside of the door 1. Then, the push button 20 in which the security code is set is pressed. In this embodiment, 1A6 is pressed, then the enter button 21 is pressed and the lever handle 6 is rotated to open the door. Then, check the deadbolt 9 is retracted from the side of the door 1. When the deadbolt 9 is retracted, the security code is set properly. If not, the setting needs to be set again since the setting operation is not carried out properly.

When the door is closed after confirming the setting is proper, the deadbolt lock 8 functions with the deadbolt 9 protruding toward the concave portion (not shown) of a door frame (not shown). The convex portion 58*a* of the driving cam 58 is engaged with the cutout portion 213*a* of the bent piece 213 on the bottom of the lock plate 155. The security code is set to the three lock pins 237, respectively, and the abutment surfaces 240*a* of the first shaft keys 240 of the three lock pins 237 are provided to engage with the opening edges of the plate lock holes 211*a* of the lock plate 155 as shown in FIG. 34(*d*). Thus, the lock plate 155 is prevented from moving upward, and the driving earn 58 is prevented from rotating for opening. In this manner, the locked state is formed by the lock pin 237.

Next, to unlock the push button lock after the security code is set and the door is closed, the reset button 19 of the exterior plate 3 is pressed from outside of the door 1, and reset the lock in the same manner as described. More specifically, the reset pin 165 is pressed in the housing 18, the engagement surface 236*a* is engaged with the tapered surface 199*a* of the reset plate 154 and pressed, and the reset plate 154 is moved upward against the spring 202.

Then, the reset spring 205 in the reset plate 154 is moved apart from the lock pin 237 to disengage the engagement, and the lock pin 237 is pushed back by the lock spring 243 and returned to its original position. Some push buttons 20 are pressed down erroneously or by tampering before the closed door is unlocked. The reset operation clears the depressed lock pin 237 and restores the security code set to the lock pin 237.

Figure 35:
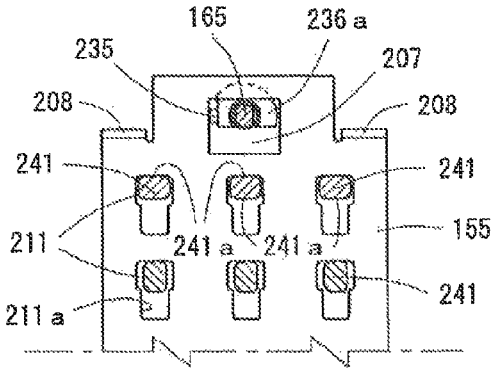
FIG. 35 is an explanatory view showing procedures of an unlocking operation after setting the security code for the security-code controller applied to the present invention.
Figure 35:
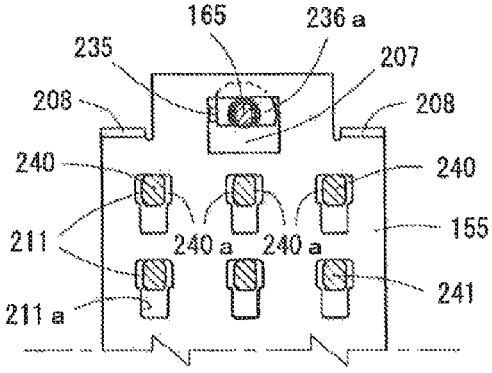

The state of the lock plate 155 after completion of the reset operation is shown in FIG. 35(*a*), which is virtually the same as FIG. 34(*d*). The security code is set to the three lock pins 237, respectively, and the abutment surfaces 240*a* of the first shah keys 240 are provided to engage with the opening edges of the plate lock holes 211*a* of the lock plate 155. Thus, the lock plate 155 is prevented from moving upward, and the driving cam 58 is prevented from rotating for opening, in this manner, a locked state is formed by the lock pin 237.

Then, the push button 20 in which the security code is set is pressed in sequence. The button shaft 25 is pressed in the housing 18 against the push button spring 29. The top end of the button shaft 25 is engaged with the end surface of the shaft head 242 of the lock pin 237, and the pin 237 is pushed inwardly against the lock spring 243. Then, the reset spring 205 is moved away by the depressed cone flange 239. The reset spring 205 is moved immediate above the cone flange 239 and engaged with the cone flange 239. Thus, the lock pin 237 is maintained in the depressed position.

This state is shown in FIG. 35(*b*). The first shaft key 240 is moved to the plate key hole 211 of the lock plate 155, the abutment surface 240*a* is parallel to the plate lock hole 211*a*, and the lock plate 155 is movable upwardly. In this case, the lock pin 237 in which the code has not been set is kept in its initial state of assembly, and is positioned in the same manner as the depressed first shaft key 240, and the lock plate 155 is movable upwardly.

The enter button 21 of the exterior plate 3 is pressed from outside of the door 1 against the spring 33. Then, the end portion of the dog 30 is engaged with the head portion of the enter pin 168. The tapered surface 244*a* of the pin 168 is pushed inward to engage with the tapered surface 245*a* of the first slider 245, and the first slider 245 is moved upwardly. Upward displacement of the first slider 245 is transmitted to the second and third sliders 246, 247 attached to the outside of the slider 245, and then transmitted to the engagement pawl 216 via the first to third sliders 245 to 247. Thus, the lock plate 155 integral with the engagement pawl 216 is moved upwardly.

Then, the bent pieces 212, 213 provided on the bottom of the lock plate 155 are moved simultaneously and are moved above the driving cam 58 and apart from the convex portion 58*a*. Thus, engagement between the convex portion 58*a* and the cutout portion 213*a* is disengaged, and the driving can 58 is rotatable. Then, the door is opened by turning the lever handle 6. The square rod 62 is rotated via the deadbolt lock 8, and the driving cam 58 is rotated. As a result, the deadbolt 9 is retracted from the concave portion (not shown) of the door frame.

When the security code is not entered correctly with the push button 20, the lock plate 155 is engaged with the second shaft key 242 of the lock pin 237 and prevented from moving, and whereby the lock is unlocked. Under these circumstances, when the enter button 21 is pressed, the first to third sliders 246 to 247 are moved upwardly by the displacement of the enter pin 168, the cushion plate 217 is moved upwardly against the resilience of the brake spring 220, and the axial force of the enter pin 168 is absorbed.

Accordingly, the lock plate 155 is prevented from being damaged, and upward displacement of the lock plate 155 is controlled. The load on the lock pin 237 when preventing the upward movement with the plate key hole 211 is reduced. The lock pin 237 is prevented from bending or breaking, and the lock pin 237 requires less mechanical strength. The material of the lock pin can be replaced from steel to zinc alloy die-casting, which is inexpensive. Further, tampering or trouble caused by erroneously pushing the push buttons 20 can be prevented.

Next, to change the previously-set code, release the existing code 1A6 once, and then set a new code. To alter the security code, the reset operation is required in the same manner as described above. The reset button 19 is pressed from the outside of the door 1 with the door opened. The reset operation clears the push button 20 and the lock pin 237 depressed erroneously or by tampering before setting the code, and returns the lock pin 237 to the original state.

After the reset operation, the cover 86 of the changeover plate 4 on the interior side is opened. The key 102 is inserted in the key hole of the cylinder lock 100, and the cylinder 103 is rotated in the reset direction 90 degrees, in this manner, rotational displacement of the cylinder 103 is transmitted to the engagement shaft 92 via the square shaft portion 104, which is the end portion. Then, the memory change earn 230 engaged with the change pin 163 is moved simultaneously via the memory change pin 163 engaged with the square hole 92*a* of the engagement shaft 92.

More specifically, the memory change pin 163 is rotated 90 degrees in a clockwise direction in FIG. 32. Then, the memory change cam 230 engaged with the pin 163 is moved simultaneously. The bent piece 191 engaged with the memory change cam 230 is pressed, and the memory reset plate 153 integral with the bent piece 191 is depressed against the resilience of the spring 193. Then, the dogs 196 formed on the memory reset plate 153 are engaged with the three engagement pawls 238 of the lock pins 237, to which the security code is set. The lock pin 237 is rotated in a counterclockwise direction in FIG. 33. The memory change cam 230 is rotated 90 degrees, and the lock pins 237 become stationary when the memory reset plate 153 is depressed to the bottom.

At that time, the stop washer 174 engaged with the square shaft portion 237*a* is rotated on the washer hole 167 with the lock pin 237. When the washer 174 is rotated the same angle with the lock pin 237, the back surface of the engaging groove 174*b* is engaged with the protrusion 173 of the bottom of the washer hole 167 and becomes stationary by pressing force of the lock spring 243, and the rotational position of the lock pin is maintained.

Figure 36:
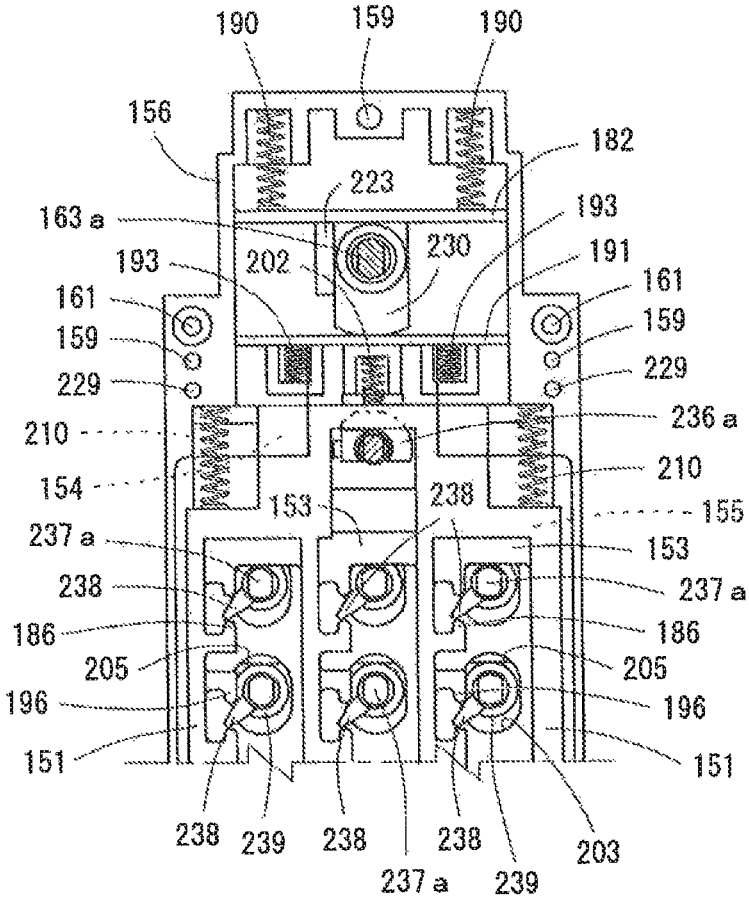
FIG. 36 is a plan view of the principal part of the security-code controller applied to the present invention and showing a state in which the security code is released.

This state is shown in FIG. 36. The engagement pawls 238 of the three lock pins 237 with the code set are positioned obliquely downward as shown in FIG. 36. The positions correspond to the original positions, that is, before the security code is set, and the current code set to the three lock pins 237 is released. Namely, the three lock pins 237 are rotated 90 degrees in a counterclockwise direction in the plate key hole 211 from the reset position as shown in FIG. 34(*d*). The abutment surface 241*a* of the second shaft key 241 is in parallel to the plate lock hole 211*a*, and recovered to its original position, which means before the code is set.

The key 102 is taken out after the cylinder 103 is rotated, then rotated 90 degrees in the reverse direction, and returned to its original position. Then, as described above, the memory change earn 230 is moved simultaneously with rotational displacement of the cylinder 103, the memory reset plate 153 is moved up by the spring 193, and the lock pin 237 is returned to the original state.

After the code is released, it is preferable to check the release operation is appropriately carried out. In this case, reset the lock in the manner as described above by pressing the reset button 19 from the outside of the door 1 with the door opened, and then, press the enter button 21 to push the enter pin 168 inwardly. Then, the first to third sliders 245 to 247 are moved up and the lock plate 155 is moved simultaneously. The bent pieces 212, 213 on the bottom of the lock plate 155 are moved above the driving earn 58, apart from the convex portion 58*a*, to disengage the engagement between the convex portion 58*a* and the cutout portion 213*a*, and whereby the driving earn 58 is rotatable.

Thereafter, the lever handle 6 is rotated, and the square rod 62 is rotated via the deadbolt lock 8. The code-release operation is confirmed to be proper when the deadbolt 9 is retracted.

After confirming the code is properly released, the security code is altered by entering a new code in a manner as described above. In the present invention, the code can be altered easily and promptly by pressing the reset button 19 and rotating the cylinder 103 of the changeover plate 4 in the reset direction. It does not require a complicated operation such as detaching the lock or the main part of the lock from the door 1, as opposed to the conventional lock. Further, use of tools such as pins or drivers is not necessary.

Next, when the push button lock in the embodiment is used in a latch mode, that is, the lock is not locked by closing the door and the door is operable from inside and outside with the lever handles 6 and 7. For example, when the lock is switched from the auto lock to the hitch mode, the reset button 19 is pressed from outside of the door 1 to reset the lock in a manner as described above. The reset operation clears the lock pin 237 depressed erroneously or by tampering after setting the security code and before switching to the latch mode. The lock pin 237 is restored to its original state in which the security code has been set.

After resetting the lock, the set security code is entered with the push button 20. In the same manner as the unlocking procedures, the lock pin 237 is positioned in the plate key hole 211 and makes the lock plate 155 movable upwardly. Then, the enter button 21 is pressed and the enter pin 168 inside is pressed inwardly. The lock plate 155 is moved upwardly via the first to the third sliders 245 to 247. When the lever handle 6 is turned down, the deadbolt 9 is retracted from the end surface of the door 1. The cover 86 of the changeover plate 4 on the interior side is opened, the changeover knob 107 on the interior side is switched from the auto lock to the latch (free) position. Then, the lever handle 6 is returned to the original position to protrude the deadbolt 9.

Then, as described, the changeover knob 107 is rotated to switch the lock from the auto lock to the latch position. The reset pin 165 connected to the changeover shaft 108 is rotated about the through hole 224 in a clockwise direction in FIG. 25(*a*). Then, the protrusion 235 is rotated within the opening 207, engaged with the upper edge, and then engaged and stopped with the cutout groove 207*a* formed on the opening. The lock is switched to the latch (free) position.

This state is shown in FIG. 25(*b*). The reset pin 165 is positioned above the upper part of the lower edge of the opening 207, and the lock plate 155 is movable in the space. Accordingly, the lever handle 6 is turnable without pushing the enter button 21. When the square rod 62 is rotated, the deadbolt 9 is retracted via the deadbolt lock 8 by operation of the lever handle 6, and whereby the door is openable.

After switching the lock to the latch, it is preferable to check the switching operation is properly carried out. In that case, check the door is openable by turning the lever handle 6 outside and without pressing the enter button 21. Then, check whether the door is openable with the lever handle 7 inside. If not, appropriate procedures are required.

On the other hand, to switch the lock from the latch state to the auto lock state, the lever handle 6 is turned with the door open. The cover 86 of the changeover plate 4 on the interior side is opened, the changeover knob 107 inside is switched from the latch (free) position to the auto lock position. Then, the lever handle 6 is returned to the original position to protrude the deadbolt 9. After switching the lock from the latch state to the auto lock state, it is preferable to check the switching operation is properly carried out.

In that case, check the door is openable in the following steps. Reset the lock by pressing the reset button 19 from outside. The security code is depressed with the push button 20. Then, the enter button 21 is pressed, the lever handle 6 is turned to open.

Next, when a deadlock mode of the push button lock in the embodiment is used, i.e. the lock is automatically locked when the door is closed and the door is opened by inserting a key into the cylinder lock 70 from outside, the cover 86 of the changeover plate 4 is opened with the door opened, and the changeover knob 107 is rotated in the deadlock direction with the deadlock button 127 depressed.

Specifically, the deadlock button 127 is depressed against the spring 131, the leg portion 129 is seated on the step portion 125. The displacement of the other end of the switching plate 128 is increased by leverage of the switching plate 128, the spring 116 is compressed via the lip portion 113 and the stopper 111 to disengage the engagement, and then the changeover knob 107 is rotated in the deadlock direction.

In this manner, the reset pin 165 engaged with the changeover shaft 108 integral with the changeover knob 107 is rotated, the protrusion 235 of the pin 165 is rotated in the opening 207 and engaged with the lower edge. The middle part of the lower edge of the opening is engaged with the protrusion 235 and the lock is switched to the deadlock position.

This state is shown in FIG. 25(*c*). The protrusion 235 of the reset pin 165 is engaged with the middle part of the lower edge of the opening 207 and prevents the lock plate 155 from moving upwardly. Accordingly, the lock cannot be unlocked with the push button 20. When the depressed deadlock button 127 is released, the button 127 is protruded outwardly by the spring 131 and returned to its original position.

Then, insert the key 71 in the key hole of the cylinder lock 70 on the bottom of the exterior side and rotate the cylinder 72. Then the bevel gears 76, 78 are rotated and the gear 65 engaged with the gear 78 is rotated. Then, the square rod 62 pinned inside the gear 65 is rotated. Accordingly, the deadbolt 9 is retracted from the concaved portion of the door frame via the deadbolt lock 8. Then, the door is opened by pulling the lever handle 6. In this case, the door is opened from inside by turning the lever handle 7.

On the other hand, to release the deadlock, open the cover 86 of the changeover plate 4 inside and rotate the changeover knob 107 in the auto-lock direction against the spring 116. In this manner, the reset pin 165 engaged with the changeover shaft 108 integral with the changeover knob 107 is rotated in the reverse direction, and the protrusion 235 of the pin 165 rotates in the opening 207 and releases engagement and engagement force between the protrusion and the lower edge. Then, the lock plate 155 is returned to its original position and becomes stationary when the protrusion 235 is positioned laterally, and the lock is switched to the auto lock position. This state is shown in FIG. 25(*a*). The reset pin 165 is positioned immediately above the lower edge of the opening 207 such that the lock plate 155 is movable upwardly in the space, and whereby the lock is restored to the auto-lock state.

Figure 37:
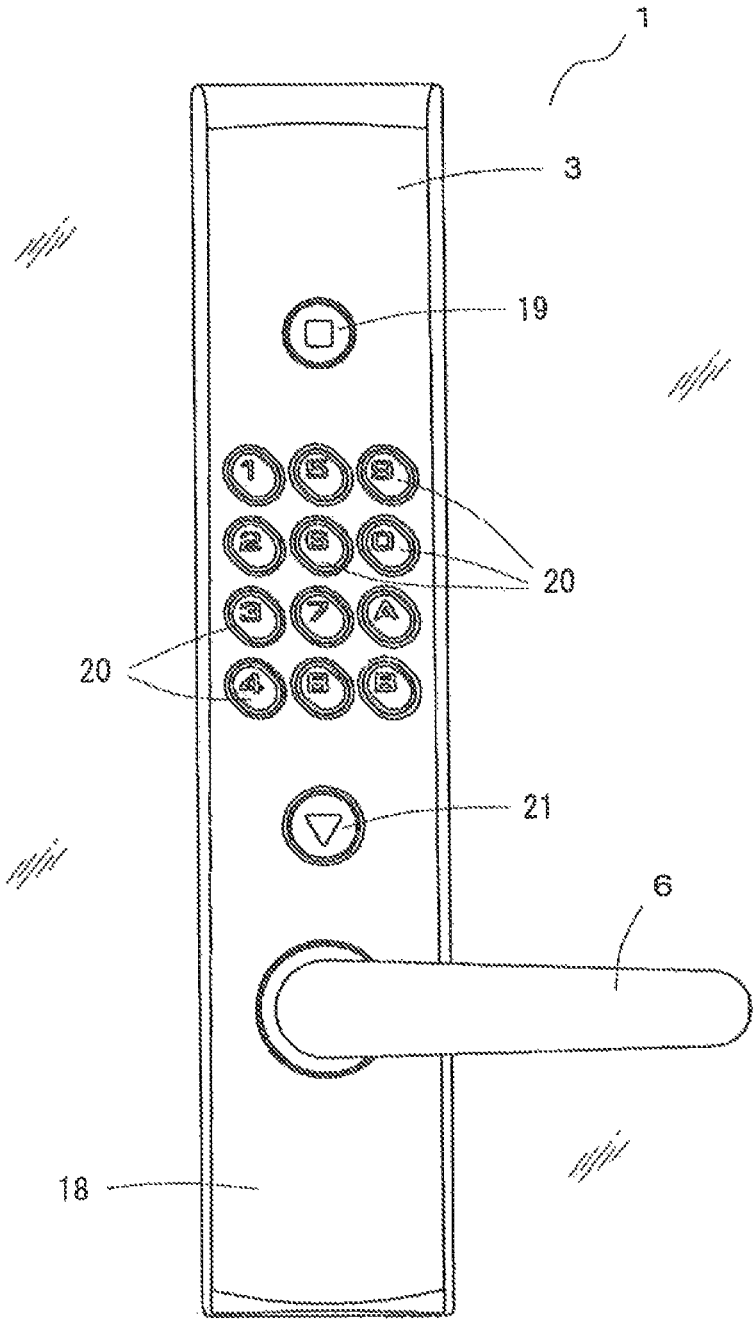
FIG. 37 shows another embodiment of the present invention and is a front view showing an example of a design change of the surface of the housing.
Figure 38:
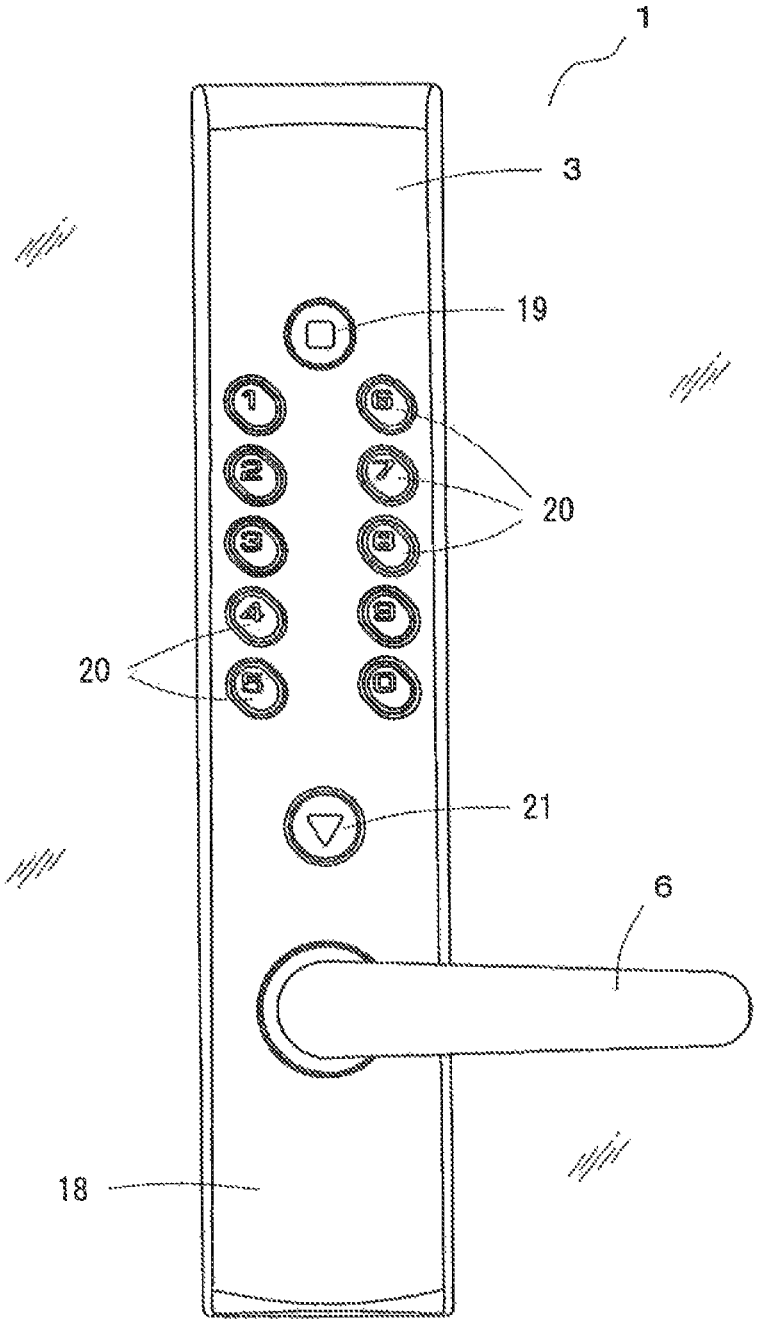
FIG. 38 shows the other embodiment of the present invention and is a front view showing the other example of a design change of the surface of the housing.

FIGS. 37 and 38 show different embodiments of the present invention, in which the constituent elements corresponding to those of the previous embodiment are given the same reference numerals. In the embodiments, various designs of the housing 18 are shown with the number and arrangement of the push button 20 changed. The outer size and the basic design of the housing 18 is the same as described above, and the security-code controller 149 which is the same as described above is used inside the housing 18.

The embodiment shown in FIG. 37 comprises twelve push buttons 20 in total. The push button 20 of the above-described embodiment on the top row is omitted. The solid space is formed by closing the push-button insertion hole 23. Four push buttons are arranged in three rows. There are two push buttons 20 with alphabets, A, B. In this case, the mechanisms such as the lock pin 237 and the stop washer 174 of the security-code controller 149 that correspond to the omitted push buttons 20 are left as they are and respond to the design change of the housing 18, and so that the design is simplified and the production efficiency is improved.

The embodiment shown in FIG. 38 comprises ten push buttons 20 with numbers. The second row of the push button 20 with alphabets of the above-described embodiment is omitted and solid space is formed by omitting the push-button insertion hole 23. In this case, the mechanisms such as the lock pin 237 and the stop washer 174 of the security-code controller 149 that correspond to the omitted push button 20 are left as they are, as described above. They respond to design changes of the housing 18 so that the design is simplified and the production efficiency is improved.

Industrial Applicability

The push button lock according to the present invention is suitable for doors of houses, stations, stores, and hospitals. A mechanism for setting and storing the security code for unlocking and its components are assembled in a cartridge and the cartridge is detachably attached in the housing. Thus, various surface designs are available. The lock is produced in an efficient manner, the design is streamlined, and less maintenance is required. Further, the mass production is facilitated. The security code for the lock is easily and readily set or altered with the lock attached to a door and without using a tool. Further, the push button lock has increased security, and thereby improving convenience and safety. The streamlined design of the lock reduces the load applied to the lock pin, prevents damage by tampering and erroneously pushing the push buttons, and thereby enhancing safety in use and increasing productivity.

The invention claimed is:

1. A push button lock comprising:

a housing on which a plurality of depressible push buttons are located;

lock pins for setting and changing a security code, and which are engageable with the push buttons and movable coaxially with the push buttons;

a lock plate formed with both plate key holes into which the lock pins are insertable and plate lock holes with which the lock pins engage, the plate lock holes comprising portions of the plate key holes;

a reset plate arranged in parallel with the lock plate and provided inside with reset springs, the reset springs maintaining or releasing axial displacement of the lock pins;

a driving cam which is rotatable and engageable with a lower end of the lock plate;

a deadbolt lock linked to the driving cam;

whereby upon depression of the push buttons the lock pins control a movement of the lock plate and cause the lock plate and the driving cam to be disengageable relative to one another; and a security-code controller for setting storing, releasing, and changing the security code entered via the push buttons that comprises a controller case and a controller cover, the lock plate and the reset plate being slidably arranged in parallel and adjacent to each other between the controller case and the controller cover, the lock pins being mounted on the security-code controller, the security-code controller being removably attached inside the housing.

2. The push button lock according to claim 1, wherein the housing is adapted to be disposed on a surface of an exterior side of a door, and the security-code controller is adapted to be disposed between the housing and the door.

3. The push button lock according to claim 1, wherein a number, an arrangement and a shape of the push buttons arranged on the housing are selectable so as to be cooperable with the configuration and functionality of the security-code controller and a shape of the housing.

4. The push button lock according to claim 1, wherein the lock pins are rotatably supported by the security-code controller and each of the lock pins has an engaging pawl protruded from a middle thereof.

5. The push button lock according to claim 4, further comprising a memory set plate movably disposed between the controller cover and the reset plate, wherein the memory set plate is formed with a plurality of dogs each of which is engageable by a respective engaging pawl.

6. The push button lock according to claim 4, further comprising a memory set plate movably disposed between the controller cover and the reset plate, a memory reset plate movably disposed between the memory set plate and the reset plate, wherein the memory reset plate is formed with a plurality of dogs each of which is engageable by a respective engaging pawl.

7. The push button lock according to claim 6, wherein the engaging pawl of each of the lock pins is engageable with the memory set plate and the memory reset plate.

8. The push button lock according to claim 6, wherein each of the memory set plate and the memory reset plate has an end portion which is engageably linked to a memory change cam which rotates forwardly and reversely, and rotation of the memory change cam enables the memory set plate or the memory reset plate to move in an opposite direction.

9. The push button lock according to claim 8, further comprising a cylinder lock which rotates forwardly and reversely and which is adapted to be provided on an interior side of a door, movement of the memory change cam corresponding to the rotational displacement of the cylinder lock.

10. The push button lock according to claim 5, wherein when setting a security code: the memory set plate is movably arranged, each of the dogs is engaged by a respective engaging pawl of the lock pins, and the lock pins are rotatable.

11. The push button lock according to claim 4, wherein the lock pins are kept in a rotational position when setting, releasing, or altering the security code.

12. The push button lock according to claim 11, wherein the security-code controller comprises the controller cover and the push button lock further comprises stop washers rotatably received inside the controller cover on which a protrusion is formed, each of the stop washers has a square hole into which an end portion of a respective lock pin is engageably inserted, wherein the washers are biased to press against an inner side of the controller cover, the washers have a cross-shaped engaging groove formed on a reverse side engaged by the protrusion, and the washers move in accordance with rotation of the lock pins and keep the rotational position.

13. The push button lock according to claim 5, wherein when setting the security code: the lock pins are moved in axial directions via the push buttons, keeping moving positions of the lock pins in the security-code controller, the lock pins being rotated while each dog of the memory set plate is engaged by a respective engaging pawl of the lock pins, the lock pins being moved to original positions of the lockpins in the axial directions while maintaining the rotational positions of the lock pins, and the lock pins being engageably arranged in the plate lock holes, whereby the lock is lockable.

14. The push button lock according to claim 11, wherein after setting the security code: respective lock pins are movable axially via respective, predetermined push buttons, thereby keeping moving positions of the lock pins in the security-code controller, engagement between the lock pins and the plate lock holes being releasable, whereby the lock is unlockable.

15. The push button lock according to claim 14, wherein after setting the security code: the engagement between the lock pins and the plate lock holes is releasable, and the lock plate is moved back from the driving cam via an enter pin, whereby the lock is unlockable.

16. The push button lock according to claim 15, wherein the enter pin is provided movably in an axial direction at a lower side of the security-code controller, the enter pin is arranged at an open window of the lock plate, a slider movable in an orthogonal direction is attached to the enter pin, and the slider is engageably mounted on an edge of the open window.

17. The push button lock according to claim 7, wherein when releasing a security code set by a user: the memory reset plate is arranged movably in an opposite direction of movement of the memory set plate at a time of setting the security code, each of the dogs of the memory reset plate is engaged with an opposite side of a respective engaging pawl at a time of setting the security code, and the lock pins are rotatable in an opposite direction from when setting the security code.

18. The push button lock according to claim 9, wherein after releasing a security code set by a user: the rotator is rotated in an opposite direction from when setting the security code, the lock pins are moved axially via the push buttons that correspond to a new security code, keeping moving positions of the lock pins in the security-code controller, the dogs of the memory reset plate are engaged with respective engaging pawls of the lock pins and the lock pins are rotated, the lock pins are moved to original positions of the lock pins in axial directions while keeping rotational positions of the lock pins, and the lock pins are engageably arranged in the plate lock holes, whereby the security code is alterable.

19. The push button lock according to claim 1, wherein the security-code controller which is adapted to be disposed on an exterior side of a door is provided with a reset pin which is axially movable, and the push button lock further comprises a changeover knob adapted to be rotatably provided on an interior side of the door, the reset pin being rotatable with rotational displacement of the changeover knob, the reset pin having an engagement piece and a protrusion, and an end face of the engagement piece and the protrusion are engageable with an edge of an opening of the lock plate, whereby operation of the lock plate is controllable via a rotational position of the reset pin.

20. The push button lock according to claim 19, wherein the end face of the engagement piece and the protrusion of the reset pin are positioned in the opening of the lock plate, thereby increasing operational displacement of the lock plate.

21. The push button lock according to claim 19, wherein the protrusion of the reset pin is engaged with a cutout groove formed on an upper-opening edge of the opening of the lock plate, thereby making operational displacement of the lock plate controllable.

22. The push button lock according to claim 19, wherein the protrusion of the reset pin is engaged with a lower-opening edge of the opening of the lock plate, thereby preventing operational displacement of the lock plate.

23. The push button lock according to claim 9, further comprising a changeover plate adapted to be disposed on the interior side of the door and provided with the rotator interconnected with the memory change pin and a changeover knob interconnected with a reset pin.

24. The push button lock according to claim 23, wherein the rotator rotates forwardly and reversely when setting or releasing a security code and is normally positioned at a neutral position.

25. The push button lock according to claim 24, wherein the rotator is rotatable with a key, thumbturn, or coin.

26. The push button lock according to claim 23, wherein the changeover knob is changeable to a position of a latch, an auto lock, or a deadlock and is normally positioned at the auto lock.

27. The push button lock according to claim 23, wherein the changeover plate is provided with an openable cover, and the rotator and the changeover knob are disposed under the cover.

28. The push button lock according to claim 23, wherein the changeover plate is provided with a depressible deadlock button, the deadlock button comprising a flange engageable with a first side of the changeover plate, and the push button lock further comprises a stopper mounted on a base part of the changeover knob and is axially movable, the stopper being engageable with a second side of the changeover plate and movable axially via a depression of the deadlock button that releases engagement from the base part of the changeover knob, thereby making the changeover knob rotatable, rotational displacement of the changeover knob being interconnected with the reset pin, and a protrusion of the reset pin being engageable with a lower-opening edge of the lock plate.

29. The push button lock according to claim 23, further comprising a handle-mounting plate adapted to be disposed on the interior side of the door, wherein the handle-mounting plate and the changeover plate are disposed-separately, and the handle-mounting plate is disposed below the changeover plate.

30. The push button lock according to claim 23, further comprising a cylinder lock provided in a lower part of the housing and interconnected with a rotational mechanism of a square rod of the deadbolt lock, and an unlocking operation of the cylinder lock allows the door to be opened when the door is deadlocked.

31. The push button lock according to claim 1, further comprising a button presser plate disposed in the housing and having a plurality of apertures for push-button shafts, a tamper-proof plate disposed adjacent at one side of the button presser plate and having a plurality of elongated holes and being biased to move downwardly, wherein the tamper-proof plate has a square hole into which an enter button is insertable, and a tapered portion of the enter button is provided so as to be engageable with a rim of the square hole.

32. The push button lock according to claim 1, wherein the lock pins are formed by die-casting.

33. The push button lock according to claim 17, further comprising a cushion plate movably attached to a lower side of the lock plate via a brake spring, a slider being engageably arranged on the cushion plate, and an enter pin, wherein the enter pin is moved axially and the slider is moved in the orthogonal direction, and the cushion plate is movable against the brake spring.

* * * * *